US009980533B2

(12) United States Patent
Huber

(10) Patent No.: US 9,980,533 B2
(45) Date of Patent: May 29, 2018

(54) SOLE PART

(71) Applicant: Flexheel GmbH, Müncher (DE)

(72) Inventor: Christian Huber, Munich (DE)

(73) Assignee: FLEXHEEL GMBH, Munich (DE)

( * ) Notice: Subject to any disclaimer, the term of this patent is extended or adjusted under 35 U.S.C. 154(b) by 0 days. days.

(21) Appl. No.: 14/419,292

(22) PCT Filed: Aug. 2, 2013

(86) PCT No.: PCT/EP2013/066339
§ 371 (c)(1),
(2) Date: Feb. 3, 2015

(87) PCT Pub. No.: WO2014/020175
PCT Pub. Date: Feb. 6, 2014

(65) Prior Publication Data

US 2015/0201704 A1 Jul. 23, 2015

(30) Foreign Application Priority Data

Aug. 3, 2012 (DE) ..... 10 2012 213 809

(51) Int. Cl.
*A43B 21/42* (2006.01)
*A43B 3/24* (2006.01)
(Continued)

(52) U.S. Cl.
CPC ..... *A43B 21/42* (2013.01); *A43B 3/246* (2013.01); *A43B 21/36* (2013.01); *A43B 21/40* (2013.01); *A43B 7/38* (2013.01); *A43B 13/183* (2013.01)

(58) Field of Classification Search
CPC ..... A43B 21/42; A43B 21/433; A43B 21/437; A43B 21/39; A43B 21/40; A43B 21/44;
(Continued)

(56) References Cited

U.S. PATENT DOCUMENTS 1,301,404 A * 4/1919 Des Moineaux ..... A43B 21/39 36/42
1,354,499 A * 10/1920 McLean ..... A43B 21/39 36/36 R
(Continued)

FOREIGN PATENT DOCUMENTS

DE 102010043214 A1 5/2012
DE 10 2011 108 131 A1 1/2013
(Continued)

OTHER PUBLICATIONS

First Office Action for Chinese Patent Application No. 201380052189.2, dated Dec. 15, 2015, 14 pages.
(Continued)

*Primary Examiner* — Megan Lynch
(74) *Attorney, Agent, or Firm* — Westman, Champlin & Koehler, P.A.

(57) ABSTRACT

The invention relates to a sole component for a shoe suitable for use with different heels. The sole component comprises a front, a middle and a rear sole portion and comprises a mechanism for adjusting the sole curvature in a transition region between the front and the middle sole portion. The mechanism comprises a rotatable supporting element which is provided in such a way that it may have a first angular position which causes a first sole curvature in the transition region and a second angular position which causes a second sole curvature in the transition region, wherein the first sole curvature is different from the second sole curvature.

22 Claims, 31 Drawing Sheets

Figure 1A:
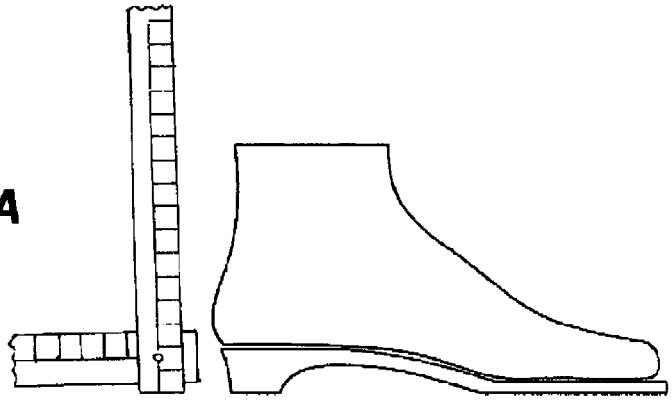

(51) Int. Cl.

| | |
|---|---|
| ***A43B 21/40*** | (2006.01) |
| ***A43B 21/36*** | (2006.01) |
| *A43B 7/38* | (2006.01) |
| *A43B 13/18* | (2006.01) |

(58) Field of Classification Search
CPC ..... A43B 21/45; A43B 21/47; A43B 21/48; A43B 21/50; A43B 21/51; A43B 21/52; A43B 21/36; A43B 3/246; A43B 7/38; A43B 13/41; A43B 13/141
See application file for complete search history.

(56) References Cited

U.S. PATENT DOCUMENTS

| | | | | |
|---|---|---|---|---|
| 2,258,265 | A * | 10/1941 | Schwartz | A43B 21/433 36/100 |
| 2,285,738 | A * | 6/1942 | Melchionna | A43B 7/144 36/34 R |
| 3,481,332 | A | 12/1969 | Arnold | |
| 4,416,072 | A | 11/1983 | Sarkissian | |
| 4,670,996 | A * | 6/1987 | Dill | A43B 21/36 36/36 C |
| 5,309,651 | A * | 5/1994 | Handel | A43B 21/433 36/100 |
| 5,347,730 | A * | 9/1994 | Rodriguez Colon | A43B 3/24 36/100 |
| 2003/0163934 | A1 | 9/2003 | Wallin et al. | |
| 2006/0075662 | A1* | 4/2006 | Schupbach | A43B 3/24 36/100 |
| 2006/0130361 | A1* | 6/2006 | Robinson, Jr. | A43B 1/0072 36/25 R |
| 2007/0266598 | A1* | 11/2007 | Pawlus | A43B 13/141 36/102 |
| 2007/0289167 | A1* | 12/2007 | Pieriboni | A43B 3/24 36/100 |
| 2008/0271343 | A1* | 11/2008 | Ordenes Haag | A43B 3/24 36/101 |
| 2010/0139123 | A1* | 6/2010 | Alan | A43B 3/24 36/100 |
| 2011/0119954 | A1* | 5/2011 | Ortiz | A43B 21/39 36/42 |
| 2012/0055048 | A1* | 3/2012 | Haupt | A43B 3/24 36/34 R |
| 2013/0247413 | A1* | 9/2013 | Cumbus | A43B 21/42 36/42 |
| 2013/0326913 | A1* | 12/2013 | Weller | A43B 21/42 36/105 |
| 2015/0201704 | A1 | 7/2015 | Huber | |

FOREIGN PATENT DOCUMENTS

| | | | | |
|---|---|---|---|---|
| EP | 2074900 | A1 * | 7/2009 | A43B 3/24 |
| FR | 2813508 | A1 * | 3/2002 | A43B 5/14 |
| FR | 2959646 | A1 * | 11/2011 | A43B 3/24 |
| NL | 1029372 | C2 | 1/2007 | |
| NL | 1029372 | C2 | 2/2007 | |

OTHER PUBLICATIONS

International Preliminary Report on Patentability for PCT Application No. PCT/EP2013/066339, dated Feb. 3, 2015, 7 pages.
International Search Report for PCT Application No. PCT/EP2013/066339, dated Nov. 6, 2013, 4 pages.
German Office Action for German Patent Application No. 10 2012 213 809.9, dated Jul. 2, 2013, 5 pages.
Patent Examination Report No. 1 for Australian Patent Application No. 2013298456, dated Aug. 15, 2016, 3 pages.
First Office Action from Canadian Patent Application No. 2,880,689, dated Jul. 31, 2017, 7 pages.
Office Action from German Patent Application No. 10 2012 213 809.9, dated Nov. 17, 2014, 10 pages.

* cited by examiner

Fig. 3A
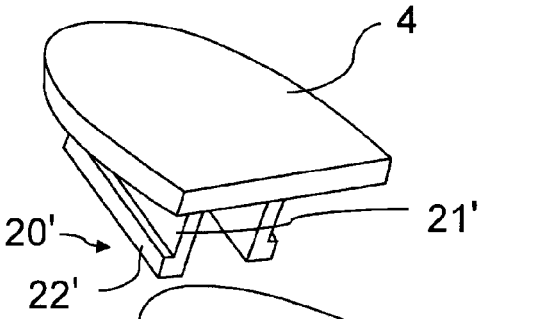
Fig. 3B
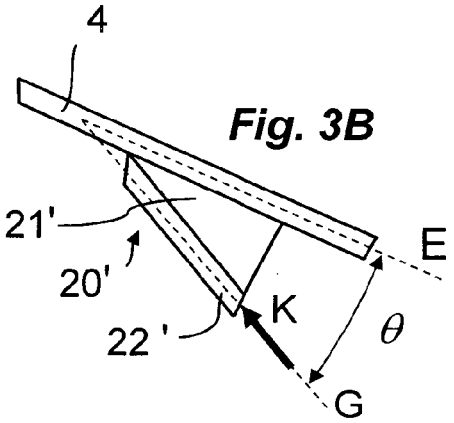
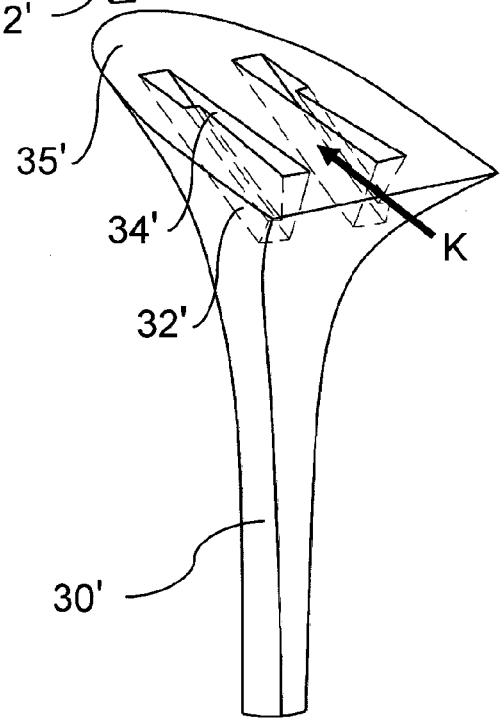
Fig. 3C
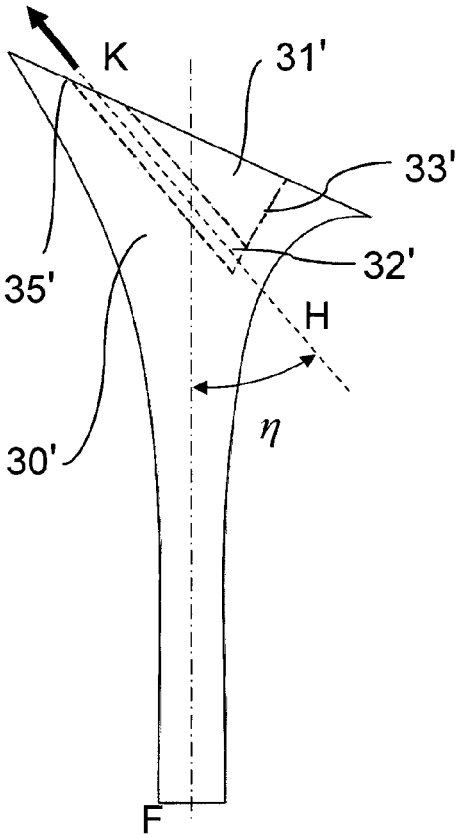
Fig. 3D

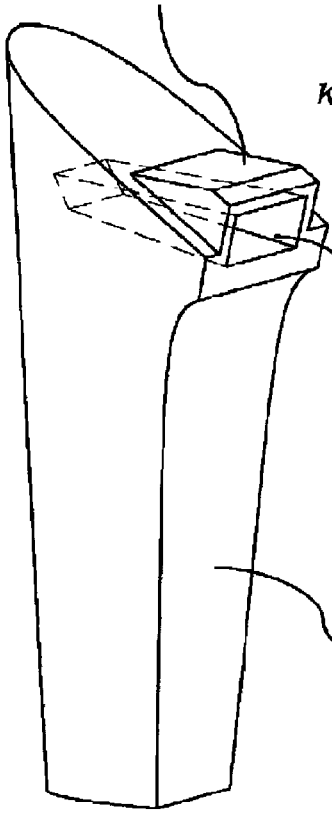
Fig. 5E
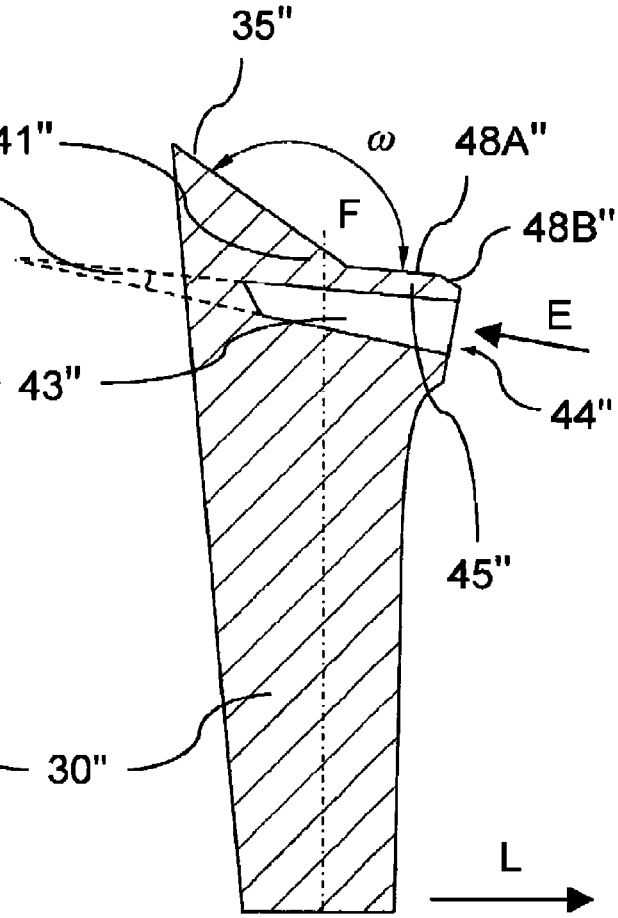
Fig. 5F
Fig. 5G
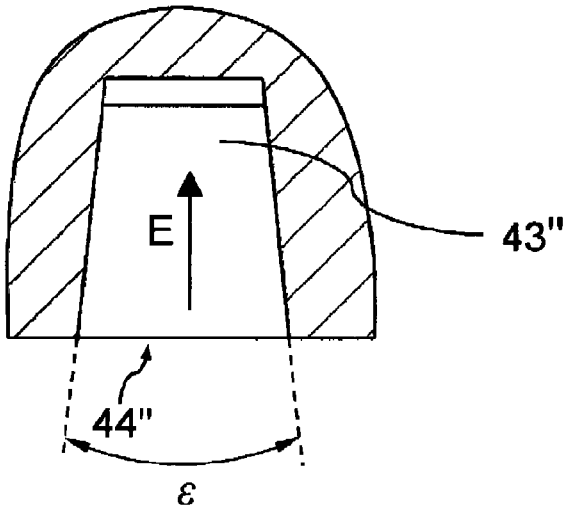

Fig. 7E
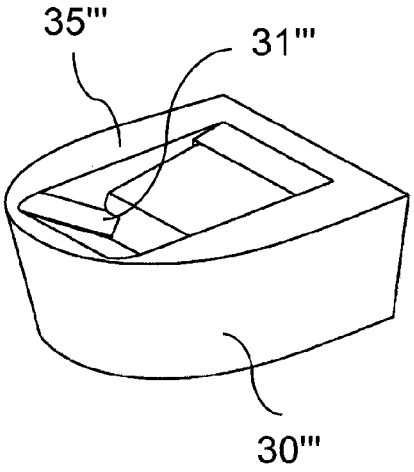
Fig. 7F
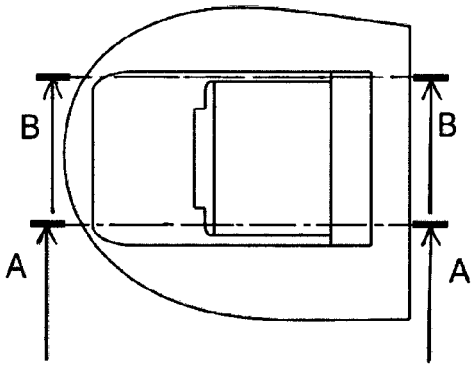
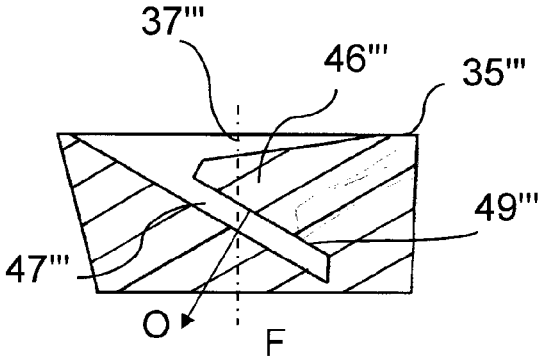
Fig. 7G
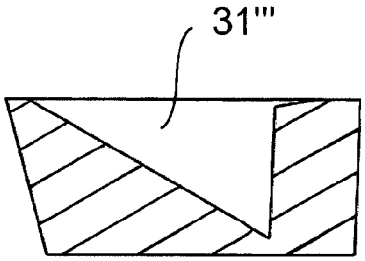
Fig. 7H

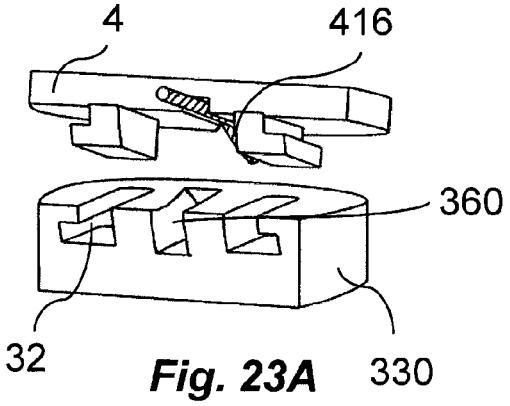
Fig. 23A
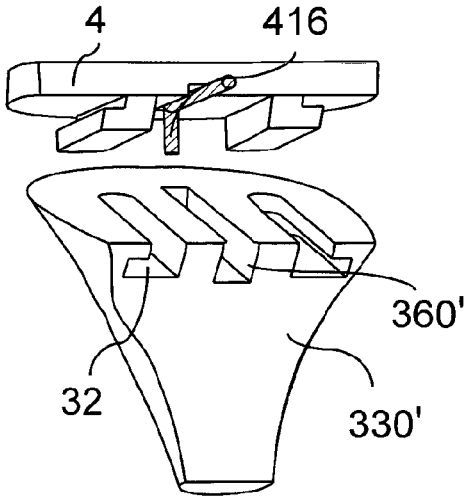
Fig. 23B
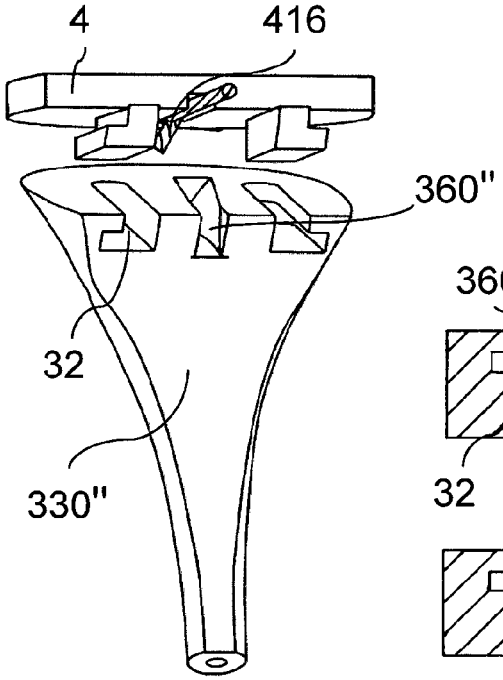
Fig. 23C
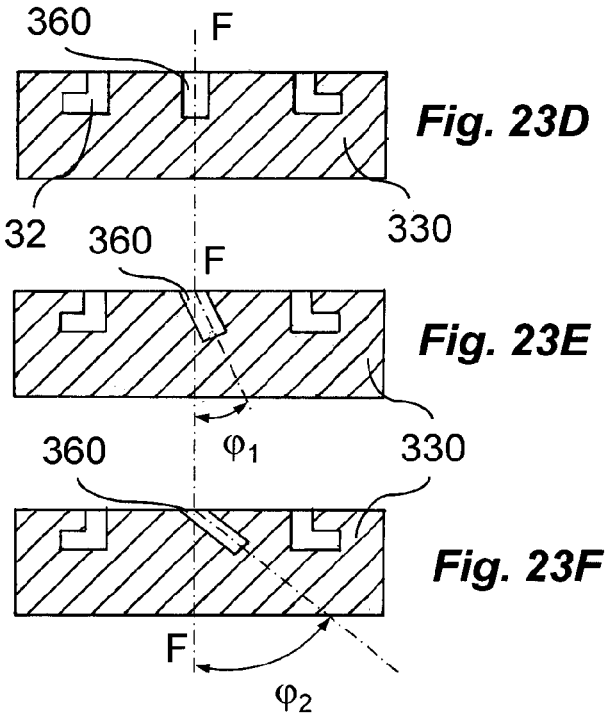
Fig. 23D
Fig. 23E
Fig. 23F

SOLE PART

CROSS-REFERENCE TO RELATED APPLICATION

This Application is a Section 371 National Stage Application of International Application No. PCT/EP2013/066339, filed 8 Aug. 2013 and published as WO 2014/020175 A1 on 6 Feb. 2014, in German, the contents of which are hereby incorporated by reference in their entirety.

The present application claims priority of German patent application no. 10 2012 213 809, which is herewith incorporated in its entirety into the present application by means of reference.

The present invention relates to a shoe suitable for use with changeable heels as well as a sole component for such a shoe. The invention in particular relates to a women's shoe suitable for use with heels having different heights as well as a sole component and changeable heels for such a shoe. The sole component may comprise one or more mechanisms for adjusting the curvature in one or more sole portions.

High heels may cause significant inconveniences and even pain when wearing them for a long time. Wearing high heels leads, in particular, to an uneven strain on the foot since the forefoot carries a major part of the body weight. In the long run, this may lead to different deformations, for example fallen arches, flat feet or splayfeet. Furthermore, the ball of the foot is exposed to heavy load which may lead to wear of the big toe joint. Similarly, backache and shortening of the calf musculature are linked to wearing high heels.

Despite of this, high heels are highly popular and are often used, for example, to accentuate certain body regions by a certain posture or to look taller. However, high heels are often worn solely for certain occasions, and women often carry alternative shoes with them in order to change them when necessary, in particular in order to counteract the disadvantages described above.

Document EP-A1-2 074 900 discloses a shoe with an adaptable sole component and a changeable shoe heel. The heel comprises a pressure-generating element which is intended to act on a pressure-transferring element in the sole component and apply pressure in the direction of the toes. According to EP-A1-2 074 900, this leads to an upward bending of a middle sole portion.

The present invention has the object to provide improved shoes and sole components for which the heel may be changed, as well as improved heels for such shoes. Said object is achieved by the features of the claims. Preferred embodiments can be taken from the dependent claims.

The sole component according to the present invention may comprise a front, a middle and a rear sole portion. According to embodiments of the invention, said portions may substantially correspond to a portion of the ball of the foot or a forefoot, an arch or midfoot portion, and a foot's heel portion of the sole component, respectively. The sole component may comprise an insole, a liner and/or an outsole and may possibly be used instead of an insole. Liner, insole and outsole each may be formed as one piece or by several segments.

In the context of the present description, the term "longitudinal direction of the sole" preferably relates to the direction which corresponds to the longitudinal direction of the foot from the foot's heel ("rear") to the toes ("front"). For better explanation of the invention, the term "longitudinal direction of the sole" is also used in connection with heels which are not necessarily mounted to the sole component. The "longitudinal direction of the sole" in this case refers to the axis corresponding to the axis of coordinates which extends parallel to the floor plane along the longitudinal direction of the sole when the heel is mounted to the sole component.

One thought behind the invention is that the optimal geometry of the sole, in particular the sole's curvature in the region of the foot's ball and/or the heel, should vary depending on the height of the heel.

According to embodiments, the sole component of the present invention has a front, a middle and a rear sole portion as well as a mechanism (first mechanism) for adjusting the sole curvature in a transition region between the middle and the rear sole portion (first transition region). The mechanism preferably has a supporting element (first supporting element) which is provided or configured in such a way that it may be pushed away from the sole component in the region of the rear sole portion in order to reduce the sole component's curvature in the first transition region and/or that it may be pushed towards the sole component in the region of the rear sole portion in order to increase the sole component's curvature in the first transition region.

The mechanism, the supporting element and the transition region are referred to as "first" mechanism, "first" supporting element and "first" transition region. They may be provided independently of a "second" mechanism, which is described further below, or in combination therewith.

The first supporting element is preferably relatively rigid, whereas the sole component preferably is relatively flexible at least in the first transition region. The first supporting element is thus preferably more rigid than the sole component at least in the first transition region. The transition region may be configured in a more flexible way than the rear and/or the middle sole component. Alternatively or additionally, a joint and/or a hinge is provided in the first transition region so that the middle sole component may be rotated or inclined along an axis of rotation relative to the rear sole portion. The axis of rotation preferably extends transversely to the longitudinal direction of the sole. The rear sole part may be hingedly connected to the first supporting element and/or hingedly supported in the first supporting element, wherein the hinge may for example be provided at the front end region of the rear sole part.

The sole component may comprise a leaf spring which is firmly connected to the rear and middle sole part, in order to provide a defined curvature to the first transition region. This may be advantageous for example when using a hinge in the first transition region, in order to determine the position of the sole portions relative to one another in a neutral position of the first mechanism.

Preferably a front part of the first supporting element extends into the region of the middle sole portion and is at least partially firmly connected to the middle sole portion. According to embodiments of the invention, the front part of the supporting element is integrally formed with the middle sole portion.

A rear part of the first supporting element extending along the rear sole portion is preferably not fixed to the sole component or not connected to the sole component so that an angle and/or a distance between the rear part of the first supporting element and the rear sole portion is adjustable. When the front part of the supporting element is fixed to the middle sole portion or in case they are integrally formed, the adjustment of the angle and/or of the distance preferably leads to an adjustment of the angle between the rear and the middle sole portion and thus to an adjustment of the curvature in the first transition region. Preferably, the reduction of the angle and/or of the distance between the rear part of the first supporting element and the rear sole portion leads to an increased curvature. An enlargement of the angle and/or of the distance preferably leads to a reduction of the curvature. Preferably, the supporting element is loose from the rear sole portion along its entire rear end region. The rear end region preferably extends below the rear sole portion.

When amending the sole curvature in the first transition region, the first supporting element preferably retains its shape substantially or completely. Hence, the angle between the rear end region of the supporting element and the middle sole portion preferably remains substantially or completely constant when changing the sole curvature in the first transition region.

Depending on the point of view, the rear sole portion and/or the first supporting element may be configured in such a way that the rear sole portion may be pushed away from the first supporting element and/or the first supporting element may be pushed away from the rear sole part. Here, the rear part of the supporting element may be pushed away from the rear sole portion for example by means of a wedge-shaped structure at the heel which is slid between the supporting element and the rear sole portion. For this purpose, the rear end of the supporting element may be spaced apart from the rear sole portion in the neutral position (i.e. without heel).

According to an embodiment of the invention, the first supporting element comprises a projection. The projection preferably extends away from the supporting element laterally or downwards. According to embodiments of the invention, the projection provides at least one surface which substantially extends transversally to the longitudinal direction of the sole. The normal vector of said surface, which points away from the projection, preferably points forward in the longitudinal direction of the sole and upwards in the longitudinal direction of the heel so that the surface extends obliquely to the surface of the rear sole portion and in the longitudinal direction of the sole towards the front extends away from the plane of the rear sole portion. The projection may be used for adjusting the first mechanism and/or for fixing a heel to the rear sole portion.

According to further embodiments of the invention, which may be combined with the embodiments above, the first supporting element is provided or configured such that it extends away from the sole component in the region of the rear sole portion in the neutral state of the first mechanism. The distance between the supporting element and the rear sole portion preferably increases rearwards in the longitudinal direction of the sole. In this case, the rear part of the supporting element may be pushed against the rear sole portion, for example by means of the heel.

Along the middle sole portion, the first supporting element preferably has a substantially flat and elongate configuration. The supporting element may comprise a cutout in the rear part, through which elements of the second mechanism, which is described further below, may extend.

The first supporting element may be configured as a rail, which extends along the middle sole portion and is firmly connected thereto. The rail may comprise first holes for receiving a first axis, via which the rear sole portion is hingedly connected to the first supporting element and/or second holes for receiving a second axis, via which the front sole portion is hingedly connected to the first supporting element. The rail may substantially be made of flat steel which is arranged perpendicular to the middle sole portion. It is also possible to use a plurality of (preferably two) rails, which preferably extend substantially parallel or have a slightly tapering configuration in the sole's longitudinal direction towards the rear. The rails may be connected by means of pins. Elements of the second mechanism, elements of a fixture for the heel and/or elements of a donning aid for the heel, which are described further below, may be arranged between the rails.

The one or more rails may be configured such that they may be inserted from the lower side of the middle sole portion into the middle sole portion. In this case, they preferably may be secured by means of a counterpart, which may be inserted from the upper side of the middle sole portion into the middle sole portion. Said counterpart may be a flat plate which is arranged substantially parallel to the middle sole portion, wherein the one or more rails may comprise cutouts for receiving the plate. The plate may be optionally fixed to the middle sole portion, for example by means of screws, adhesion, welding, snapping or similar techniques.

The rear part of the first supporting element may taper along its course in the longitudinal direction of the sole towards the rear. In this context, the rear part of the first supporting element may become narrower in one or more directions. Thus, it can taper in one or more views of the sole component, for example in a view from below and/or in a view from the side. In case the first supporting element is formed by a plurality of rails, the rear part may be tapering in that the rails are converging at least along the rear part. Due to such a shape, a free-from-play fixation of different heels to the sole component may be achieved despite manufacturing tolerances of the sole component and/or the heels.

According to embodiments of the invention, the sole component comprises a front, a middle and a rear sole portion, wherein the sole component has a mechanism (second mechanism) for adjusting the curvature of the sole in a transition region (second transition region) between the front and the middle sole portion. The mechanism preferably comprises a slidable and/rotatable supporting element (second supporting element) which is provided or configured such that a sliding movement and/or rotation of the supporting element causes a change of the curvature of the sole in the transition region. Thus, the sliding movement and/or rotation of the supporting element preferably causes a change of the angle between the front sole portion and the middle sole portion.

The second mechanism and/or the second supporting element is preferably integrated into the sole component and/or into a shoe sole comprising the sole component.

The mechanism, the supporting element and the transition region are referred to as "second" mechanism, "second" supporting element and "second" transition region, although, they may be provided independent of the "first" mechanism, which is described above, or in combination therewith.

In the second transition region, the sole component is preferably more flexible than the second supporting element. Thus, it is preferred that the second transition region substantially corresponds to the shape which is predetermined by the second supporting element. Optionally, the second transition region may be provided with a hinge and/or be configured more flexibly than the front, middle and/or rear sole portion. In this case, the front sole portion preferably may be rotated relative to the middle sole portion along an axis of rotation. The axis of rotation preferably extends transversely to the longitudinal direction of the sole. The front sole portion may for example be hingedly connected to the first supporting element and/or hingedly positioned in the first supporting element.

For the first and/or second supporting element, materials such as steel, metals, metal alloys, plastics, composite materials and the like may be used. Hence, for example V2A steel plate or V2A steel may be used for the first supporting element, however, other materials which are sufficiently stable and corrosion-resistant may be used as well. The second supporting element is preferably made of an elastic material which is substantially not plastically deformed due to the bending of the sole when walking and is nevertheless sufficiently stable. For example, a spring steel or other alloys having similar properties may be used.

The sole component may comprise a second leaf spring which is firmly connected to the middle and the front sole portion in order to provide a defined curvature to the second transition region. This may for example be advantageous when using a hinge in the second transition region in order to define a neutral position of the second mechanism.

According to one embodiment of the invention, the second supporting element is slidable and provided or configured such that it may be moved along the longitudinal direction of the sole from a first position which causes a first sole curvature in the second transition region into a second position which causes a second sole curvature in the second transition region. Here, the first sole curvature is different from the second sole curvature.

The second supporting element is preferably configured as an elongate supporting sheet. The supporting element is preferably slid as a whole from the first into the second position.

In the region of the middle sole portion, the second supporting element preferably is, at least in sections, guided in a guide (for example a rail) which is firmly connected to the sole component, in particular to the middle sole portion. Here, according to embodiments of the invention, it is preferred that the second supporting element is guided in a rail and/or in the sole (for example in the sole component), at least along a front region of the middle sole portion, in such a way that buckling or bending of the second supporting element is prevented in said region.

In the first position, the second supporting element does preferably not extend into the front sole portion. Thus, in this case, the sole curvature in the second transition region preferably corresponds to the manufacturing curvature of the sole component or the sole. When the supporting element is moved into the second position, it preferably extends into the second transition region and more preferably into the front sole portion. Since it is guided along the second transition region and/or along the front sole portion (for example by means of a rail or in an opening of the sole component), the transition region and/or the front sole portion substantially corresponds to the shape of the supporting element. In the second position the shape of the supporting element preferably defines the curvature of the second transition region.

As far as the sole is manufactured with a great curvature in the transition region (manufactured as high heel), a supporting element with smaller curvature or a substantially straight supporting element may be used in order to reduce the curvature in the second transition region when putting on a flatter heel. However, when the sole component is manufactured with a smaller curvature in the second transition region (manufactured as flat shoe), said curvature may be increased by a more strongly curved supporting element when a higher heel should be used.

According to embodiments of the invention, the second mechanism further comprises a moving device which is provided or configured such that the second supporting element is slidable when putting the heel on and when taking the heel off. The moving device preferably comprises a transmission link which extends from the rear sole portion to the second supporting element. The transmission link is preferably firmly connected to the second supporting element so that an adjustment of the moving device causes the movement of the supporting element from the first position into the second position.

The transmission link is preferably bendable. This is for example advantageous when also the curvature in the first transition region is adjustable (for example by means of a first mechanism).

According to embodiments of the invention, the moving device may be configured as a Bowden mechanism, wherein the transmission link is formed by a Bowden cable which extends within a Bowden cable sleeve. Near the rear end of the Bowden cable an actuator (for example a block) may be provided which may interact with changeable heels in order to allow for a movement of the moving device when putting the heel on and/or when taking the heel off. The actuator is preferably firmly connected to the Bowden cable. The Bowden cable sleeve may be fixed to the sole component and/or to the first supporting element. The Bowden mechanism may extend through the cutout of the first supporting element.

According to a further embodiment of the second mechanism, the second supporting element is rotatable. It is provided or configured such that it may be in a first angular position which causes a first sole curvature in the second transition region and a second angular position which causes a second sole curvature in the second transition region. Here, the first sole curvature is different from the second sole curvature and is preferably smaller.

The second supporting element may be provided such that the active rotation of the second supporting element by a user (which may be effected by further mechanical means) leads to a change in the sole curvature in the second transition region. The second supporting element may thus serve as an active element which causes a certain arrangement and/or angular position of the middle sole portion relative to the front sole portion. The middle and/or the front sole portion may be configured as passive elements.

In this embodiment, the supporting element is preferably elongate and more preferably configured as a shaft. The shaft's profile may be round or oval (for example circular), however, basically may have any cross-sectional shape (for example also angular or polygonal). The shaft may comprise a curved and/or angled portion.

The second supporting element and/or the shaft preferably extends from the rear sole portion via the middle sole portion up into the second transition region and more preferred into the front sole portion. Preferably, it is rotatably supported in a mounting arrangement at least in the region of the middle sole portion and/or the rear sole portion. Therefore, for example one or a plurality of sleeves (for example brass tubes) may be used, which are preferably firmly connected to the corresponding sole portion and/or the first supporting element (for example by adhesion, welding, brazing, etc). Alternatively or additionally the support in a corresponding opening of the middle sole portion is also possible. Preferably, also an axial movement of the second supporting element in the longitudinal direction of the sole is prevented by the mounting arrangement. The second supporting element may extend substantially in the longitudinal direction of the sole at least in the middle sole portion.

In the front end portion, the second supporting element preferably has a first curved and/or angled portion which comprises a predetermined, defined curvature. Said first portion is preferably at least partially located in the second transition region. Said first portion can substantially or completely keep its shape when the second supporting element is rotated. The curvature and/or angular deflection of the first portion preferably remains substantially or completely constant when the second supporting element is rotated.

A front end portion of the supporting element, which preferably is straight, may follow the first curved portion. The front end portion may be movably received at the front sole portion. Preferably, the front end portion is received in an opening in the region of the front sole portion, which allows a movement of the end portion in the plane of the front sole portion (horizontal). Since the second supporting element is rotatably mounted along the middle sole portion and curved or angled along the transition region, the rotation of the second supporting element preferably leads to a rotation of the front end portion in the opening. Here, the second supporting element or its front end portion possibly extends further into the front sole portion in the longitudinal direction of the sole when the second supporting element adopts the second angular position. An opening of the front sole portion here also means an opening that is provided in a further element which is firmly connected to the front sole portion.

The projection of the first curved portion onto a projection plane extending along the axis of rotation of the supporting element and being perpendicular to the plane of the front sole portion preferably comprises a first curvature when the supporting element adopts the first angular position. Since the supporting element is rotatably supported along the middle sole portion, the front sole portion follows the end portion so that the projection of the curvature of the supporting element determines the angle between the front and the middle sole portion and/or the curvature in the second transition region. The curvature in the transition region may thus substantially correspond to the projection of the curvature of the supporting element.

The curved portion of the second supporting element preferably spans an imaginary plane of curvature in which also the radius of curvature lies. Rotating the second supporting element preferably causes a rotation of the plane of curvature. According to embodiments of the invention, the plane of curvature is substantially perpendicular to the plane of the front sole portion when the second supporting element is rotated into the second angular position.

The second mechanism according to this embodiment preferably allows a continuous adjustment of the sole curvature in the second transition region by setting arbitrary angular positions.

The second supporting element may be configured such that it is rotated by attachment and/or removal of a heel. Hence, a correct sole curvature for the corresponding heel (i.e. in particular for the corresponding height of the heel) may automatically be achieved in the second transition region by attaching and/or removing a heel (which is usually fixed in the rear sole region).

The second supporting element of the sole component according to the present invention may optionally comprise a crank by means of which the supporting element may be rotated. The crank is preferably provided in the region of the rear sole portion and may be rotated depending on the heel type and/or the heel height. The crank may be provided by a sleeve (for example a brass tube) that is slid over the rear end portion of the second supporting element and then bend along with it.

According to preferred embodiments of the invention, the crank is provided such that the second supporting element is rotated when attaching and/or removing a heel.

Alternatively or additionally, the second mechanism may be provided with a gear to rotate the second supporting element. Said gear may for example be configured as worm gear, in which case the supporting element is preferably provided with a screw thread and is rotated via an axially movable sleeve. Furthermore, the gear may also be configured as gear drive or rack and pinion gear.

Alternatively or additionally, the second supporting element may comprise a second curved and/or angled portion in its rear end region, which has a predetermined, defined curvature. Said second portion preferably lies at least partially in the first transition region. The second portion may substantially or completely keep its shape during the rotation of the second supporting element. The curvature and/or angular deflection of the second portion remains preferably substantially or completely constant during the rotation of the second supporting element.

A rear end portion of the second supporting element which may for example be straight, may follow the second curved portion. The rear end portion may be movably received at the rear sole portion. The rear end portion is preferably received in the region of the rear sole portion in an opening, which allows a movement of the rear end portion in the plane of the rear sole portion (for example horizontal). When the second supporting element is rotatably mounted along the middle sole portion and curved or angled along the first transition region, the change in sole curvature in the first transition region and/or the change of the angle between the rear sole portion and the middle sole portion preferably leads to the rotation of the second supporting element, which again may lead to a rotation of the front end portion, which leads to a change in sole curvature in the second transition region. The second supporting element and/or its rear end portion possibly extends further into the rear sole portion in the longitudinal direction of the sole when the second supporting element adopts the second angular position. The opening in the rear sole portion and/or the second supporting element may be configured such that the adjustment of the angle between the rear sole portion and the middle sole portion and/or the adjustment of the sole curvature in the first transition region leads to the rotation of the second supporting element when attaching and/or removing a heel. Hence, for example by correctly adjusting the first transition region for the particular heel, a correct adjustment of the second transition region for the corresponding heel may be achieved automatically and/or simultaneously. An opening of the rear sole portion does also mean an opening that is provided in a further element which is firmly connected to the rear sole portion.

The first supporting element may extend above the second supporting element, at least along segments thereof. The second supporting element may extend through a cutout in the first supporting element. Alternatively or additionally the second supporting element may extend substantially parallel to the first supporting element along the middle sole portion, preferably between two first supporting elements which are substantially parallel or slightly tapering. The second supporting element may extend under a counterpart for securing the rails of the first supporting element.

The second supporting element may be formed by a plurality of elements (for example a plurality of separate elements), which may each be configured in accordance with the above description. In particular, it is possible to form the second supporting element by two or more shafts, in order to make the sole component more stable. Both shafts may comprise a first curved portion and/or a second curved portion according to the above description, wherein in each case a corresponding front end portion may be arranged in an opening of the front sole portion and/or a rear end portion in an opening of the rear sole portion. Said two or more shafts may be arranged directly adjacent to each other and/or touch each other, which provides for a particularly space-saving arrangement. The shafts may be arranged in a common opening of the front, middle and/or rear sole portion. The two or more shafts may all be arranged substantially in one plane which extends parallel to the front, middle and/or rear sole portion.

The invention further relates to a sole component with one or more fixtures for changeable heels. The fixture may be provided in combination with one or more of the above described mechanisms.

The sole component according to the present invention comprises, in the region of the rear sole portion, preferably one or more fixtures for fixing different heels. The fixture may be provided for example at the rear sole portion or at the first supporting element. The fixture may comprise one or more projections. The projection's profile is preferably provided and/or configured such that it may engage with a recess of the heel and thus prevents the heel from falling off of when the shoe is lifted. Suitable profiles include, i.a., dovetail profiles, T profiles and L profiles, in which context the skilled person will notice that a plurality of different designs is possible.

According to embodiments of the invention, the fixture is preferably configured such that a relative movement between the heel and the sole component is required for fixing the heel on the sole component, said relative movement having at least one directional component in the longitudinal direction of the sole. According to embodiments of the invention, this may cause the adjustment of the second supporting element.

According to a first option, the fixture is provided such that the heel may be slid onto the sole component substantially in the longitudinal direction of the sole. The projections of the sole component and/or the grooves of the heel are preferably configured such that the heel may be slid onto the sole component from the rear to the front along the longitudinal direction of the sole. For this purpose the projection may extend, for example, substantially in the longitudinal direction of the sole. The projection preferably extends substantially parallel to the plane of the rear sole portion.

According to embodiments of the option, the projection may have a tapering shape (in one or more views) and be for example substantially trapezoidal. In this case, the projection may be provided by the rear end region of the first supporting element, but also by a separate component.

According to a second option, the fixture may be configured such that when the heel is exposed to load, for example, along the (vertical) longitudinal axis of the heel upon treading and/or standing, the fixation is reinforced. For this purpose, the projection of the fixture is provided and/or configured such that a self-reinforcing positive lock is provided when attaching the heel. The projection, in particular the profile of the projection, which is provided to engage with a recess of the heel, for this purpose preferably extends along a first imaginary straight line which forms an angle with the rear sole portion of $89° > \theta > 1°$, preferably $70° > \theta > 20°$. The angle preferably lies within a plane that is perpendicular to the plane of the rear sole portion and extends along the longitudinal direction of the heel. The profile of the projection thus preferably extends in a direction comprising at least one component in the longitudinal direction of the heel. Preferably, along the rear sole portion, in the longitudinal direction of the sole from the rear to the front, the profile extends away from the rear sole portion.

In a cross-section transverse to the longitudinal direction of the sole, the profile is preferably broader than a part of the projection that is located thereover and connects the profile with the rear sole portion.

According to embodiments of the second option, the projection may have a substantially triangular or trapezoidal shape, wherein the distance between the lower edge of the projection and the rear sole portion preferably increases towards the front in the longitudinal direction of the sole.

The invention further relates to changeable heels which may be provided in combination with the above described sole components or as separate components. Hence, the sole component according to the present invention may be provided with one or more changeable heels (for example as a set). Preferably, one changeable heel may be slid onto the sole component in the region of the rear sole portion and fixed thereto at a time.

In accordance with the first fixture option, the heels according to the present invention may comprise a groove at their upper side. Said groove preferably has a contour that is formed in correspondence with the profile of the projection. The profile and the groove are preferably configured such that they may engage in order to prevent the heel from falling off when the shoe is lifted. The groove may extend parallel to the upper side and in the longitudinal direction of the sole. It is preferably open towards the front in the longitudinal direction of the sole so that the heel may be slid onto the rear sole portion in the longitudinal direction of the sole towards the front.

In accordance with the second fixture option, the changeable heels according to the present invention may comprise a groove or a recess that extends from the upper side of the heel into the heel along a second imaginary straight line. The second imaginary straight line preferably extends at an angle of $1° < \eta < 89°$ preferably $20° < \eta < 70°$ with respect to the longitudinal direction of the heel, wherein the straight line preferably lies in a plane that is parallel to the longitudinal direction of the heel and to the longitudinal direction of the sole. The second imaginary straight line preferably coincides with the first imaginary straight line, when the heel is mounted to the sole.

Along the second imaginary straight line, the recess preferably comprises a contour that is formed in correspondence with the profile of the fixture. The profile of the fixture may thus preferably be slid into the heel along the contour.

The contour is preferably configured such that the recess provides a plane which may interact with the profile, in order to prevent the heel from falling off (for example when lifting the shoe). The plane preferably extends rearwards/upwards along the longitudinal direction of the sole and is transverse and thus oblique relative to the longitudinal direction of the heel. The normal vector of the plane, which points into the clearance of the cutout, is thus preferably directed rearwards in the longitudinal direction of the sole and downwards in the longitudinal direction of the heel. The normal vector is preferably perpendicular to the second imaginary straight line. In a cross-section transverse to the longitudinal direction of the sole, the contour is preferably broader than the part of the recess that is located thereover.

The recess preferably provides a stop which the projection of the fixture may abut when the heel is completely slid onto the rear sole portion. The stop is preferably provided at a front end region of the recess. Said front end region may be a front wall at the end of the recess.

The recess preferably lies within the heel and is open only at its upper side. The remaining outer surfaces of the heel are preferably not penetrated by the recess.

The heel is preferably slid onto the shoe along the second imaginary straight line. The projection of the fixture is thus pushed into the corresponding recess of the heel when loading the heel in the direction of the degree of freedom (direction in which the heel is pushed on). Also in this case a locking system may be provided at the shoe and/or the heel, which however has to absorb only low forces. The locking may thus for example be carried out not only mechanically but also by means of magnets. The heel furthermore does not comprise any openings on the side. This improves the appearance and prevents the recess from becoming dirty.

As can be recognized by the skilled person, the above described fixtures may also be provided by corresponding projections at the heel and recesses in the sole component. Hence, also the use of one or more projections at the heel, which interact with one or more recesses in the sole components as described above, is taken into consideration as an alternative or in combination with the above described embodiments.

According to embodiments of the invention, the heel is configured such that an adjustment of the first mechanism is achieved by fixing the heel to the sole component.

According to one embodiment of the invention, the heel may comprise a recess or opening at its upper side and/or front side for receiving the first supporting element. The recess is preferably elongate. The depth of the recess varies depending on the height of the heel so that the rear part of the first supporting element is pushed against the rear sole portion to a greater or lesser extent when the heel is fixed to the sole component.

According to a further embodiment, the heel may comprise a cutout or opening which extends from the upper side and/or the front side of the heel rearwards in the longitudinal direction of the sole and downwards in the longitudinal direction of the heel into the heel and which is open towards the front in the longitudinal direction of the sole. The opening is preferably provided such that it receives the rear part of the first supporting element when the heel is fixed to the sole component. Thus, the opening preferably has an entrance opening which is open towards the front. The recess or opening may extend, depending on the height of the heel, with a different angle relative to the longitudinal axis of the heel.

The opening may taper starting from its entrance opening and, for example, may narrow (e.g., continuously) in the inserting direction of the rear part of the first supporting element. The opening may for example be configured such that it narrows and/or tapers in a first sectional plane which is parallel to the longitudinal direction of the heel and the longitudinal direction of the sole. Alternatively or additionally, the opening may be configured such that it narrows and/or tapers in a second sectional plane that is perpendicular to the first sectional plane and extends in the inserting direction of the rear part of the first supporting element. The opening may taper substantially linearly (for example at an angle of 2° to 70°, 5° to 40°, 5° to 15° or approximately 10°), alternatively or additionally, the opening may comprise also a plurality of portions which taper and/or are curved to a different degree.

The opening and a face of the upper side of the heel preferably form a structure which is substantially wedge-shaped. The face of the upper side of the heel, which forms the wedge-shaped structure, may abut on a first abutment surface for the sole component, when the heel is mounted to the sole component. The face of the upper side of the heel which forms the wedge-shaped structure together with the opening, may be provided as a bottom of a U-shaped recess, wherein the recess is preferably provided at the upper side of the heel.

The wedge-shaped structure is preferably provided and/or configured such that it is pushed between the first supporting element and the rear sole portion when the heel is slid forwards onto the sole component in the sole's longitudinal direction. The tapering front end of the wedge-shaped structure is thus preferably substantially directed forwards in the longitudinal direction of the sole. The opening preferably receives the rear end of the first supporting element. Thus, the embodiment allows pushing the first supporting element away from the rear sole component when the heel is slid forwards onto the sole component in the longitudinal direction of the sole. Alternatively or additionally, the wedge-shaped structure may interact with a projection or a rail of the first supporting element.

The opening may at least be partially arranged in a projecting structure which projects upwards from the heel's upper side in the heel's longitudinal direction and/or forwards in the sole's longitudinal direction. The projecting structure may comprise an upper inclination (for example an upper inclined surface) which is arranged at an angle ω of 20° to 70°, 30° to 60° or 40° to 50° relative to the face of the heel's upper side that forms the wedge-shaped structure together with the opening. The projecting structure may be arranged in the U-shaped recess wherein the angle ω may be configured between the upper inclination and the bottom of the recess.

The projecting structure may provide an end stop surface which may be substantially parallel (for example at a deviation of at most ±1°, at most ±5° or at most ±10°) relative to the face of the heel's upper side, which forms the wedge-shaped structure together with the opening. The upper inclination and/or the end stop surface may be configured such that they come into contact with the sole component when fixing the heel to the sole component. According to embodiments of the invention, the projecting structure may have a substantially T-shaped configuration in a top view of the heel, wherein a projecting ridge which preferably forms the leg of the T-shape may extend rearwards from the inclined surface in the sole's longitudinal direction (for example to the hook of a locking mechanism which is described in detail further below). The bottom of the T-shaped structure may be arranged completely within the U-shaped recess. The projecting structure may comprise a right and/or left horn at the right and/or the left tip of the T-shape, which may project further than a middle region of the T-shape. The right and/or left horn may each comprise one end stop surface. The projecting structure may be recessed between the horns and may comprise for example a substantially rectangular recess.

According to a further embodiment of the invention, which is particularly advantageous when the heel is slid rearwards onto the sole component in the longitudinal direction of the sole, the heel may comprise an opening which extends into the heel from the upper side of the heel forwards in the sole's longitudinal direction and downwards in the heel's longitudinal direction. The opening is preferably provided such that it receives the projection of the supporting element when the heel is slid onto the rear sole portion. Depending on the height of the heel, the opening may be configured steeper or less steep.

The opening preferably provides at least one surface which extends transversely to the heel's longitudinal direction. Preferably, the normal vector of the surface which points into the clearance of the opening, is directed rearwards in the sole's longitudinal direction and downwards in the heel's longitudinal direction.

In a sectional plane extending parallel to the sole's longitudinal direction and parallel to the heel's longitudinal direction through the opening, the heel preferably comprises, according to this embodiment, a substantially wedge-shaped structure, wherein the tapering front end of the wedge-shaped structure is directed substantially rearwards in the sole's longitudinal direction.

The opening may be provided as part of a recess for the second fixture option which is described above.

According to embodiments of the invention, the heel may further comprise a recess which is provided for receiving the pressed-down rear part of the supporting element.

According to embodiments of the invention, the heel is configured such that an adjustment of the second mechanism is achieved when fixing the heel to the shoe. For this purpose, the heel preferably comprises a recess which is provided and/or configured such that it interacts with an element of the second mechanism when fixing the heel or, depending on the heel's height, an interaction is prevented. Depending on the heel's height, the recess may thus also be configured such that the element of the second mechanism finds room in the recess and is not contacted when attaching the heel.

According to an embodiment, the recess has a contour which is provided and/or configured such that it interacts with a gear of the second mechanism. The recess may, for example, comprise a screw thread and/or a threaded sleeve for engaging with a thread of the second supporting element so that, when sliding the heel along the supporting element, the thread is rotated (worm gear). When a slidable threaded sleeve is provided on the supporting element, the recess may be configured such that it receives and slides the threaded sleeve. Alternatively or additionally, the recess may comprise a contour in the form of a toothed rack that is provided and/or configured such that a pinion that interacts with the supporting element is rotated when fixing the heel to the shoe.

According to one embodiment of the invention, the recess has a contour which is provided and/or configured such that the crank of the second supporting element may be adjusted when sliding the heel onto the shoe. The recess may have the shape of a groove which narrows, rotates and/or winds along the direction in which the heel is moved relative to the rear sole portion for fixation.

The recess may have, for example, one or more surfaces which extend along the direction of fixation and are, at least along segments thereof, oblique to a plane which is spanned by the heel's longitudinal direction and the sole's longitudinal direction. Thus, the surface is oblique relative to the heel's longitudinal direction in a cross-section which extends parallel to the heel's longitudinal axis and transversely to the sole's longitudinal direction. Preferably, each different angle causes a certain rotation of the crank when attaching the heel. Preferably, a plurality of surfaces having different angles or a curved surface are/is provided so that the angle is gradually changed. Alternatively or additionally, the depth of the recess diminishes in the sole's longitudinal direction (for example rearwards), wherein the angle may remain substantially constant in this case. The inclined surface may be provided by a lateral surface of the recess.

Alternatively or additionally, the groove may rotate (for example along the groove's longitudinal direction and/or the sole's longitudinal direction). In different cross-sections that extend parallel to the heel's longitudinal direction, the groove preferably has different angles relative to the heel's longitudinal direction. The groove may, for example, have a first angle relative to the heel's longitudinal direction in a first cross-section, and a second angle relative to the heel's longitudinal direction in a second cross-section, wherein the second angle is preferably larger than the first angle and the second cross-section is preferably further away from an entrance opening of the groove through which the crank may enter the groove than the first cross-section. In the region of the entrance opening, the groove may extend substantially parallel to the heel's longitudinal direction.

The cutout is preferably open towards the front side of the heel and/or to the upper side of the heel.

Optionally, the groove is wider in the region of the entrance opening through which the crank enters the groove and/or symmetrical relative to the heel's longitudinal direction so that the heel may be slid on for different initial positions of the crank.

The recess may thus be provided such that it interacts with the crank when fixing the heel to the shoe, in order to adjust the angular position of the supporting element.

According to an embodiment of the invention, the heel is designed such that, when it is fixed to the sole component, the angle between the rear sole portion and the middle sole portion is adjusted such that a correct adjustment of the second supporting element (for example a rotation corresponding to the heel's height) is achieved. This is particularly advantageous for embodiments in which the second supporting element comprises a second curved and/or angled portion in the rear end region as described above, which is movably received at and/or in the rear sole portion. By adjusting the first transition region, the heel simultaneously leads to a correct rotation of the second supporting element.

The heel and/or the sole component may further comprise a locking system which locks the heel when a defined position is reached. This is, in particular, a position which is reached when the heel is completely slid onto the rear sole portion. Depending on the configuration of the first and/or the second mechanism of the sole component and/or the fixation of the heel to the sole component, the locking system may be configured such that it counteracts a rearward and/or forward movement of the mounted heel in the sole's longitudinal direction and/or a downward movement in the heel's longitudinal direction.

For the purpose of locking, the heel may comprise an interlocking element at its upper side, which may for example be configured in the shape of a projection, a hook and/or a snap-in lug. When fixing the heel to the sole component, the interlocking element preferably engages with a recess of the sole component, which is preferably provided at the rear sole portion. An undercut, with which the interlocking element engages, may be provided in the recess of the sole component. Alternatively or additionally, the sole component (in particular the rear sole portion) may comprise an interlocking element (for example a projection, a hook, a ratchet and/or a snap-in lug) which engages with a recess of the heel (for example a recess at the upper side of the heel).

The interlocking element preferably provides, in particular when it is configured as a hook, an undercut for locking the heel at the sole component. The undercut may for example provide a clearance which is opened towards the front or the rear in the sole's longitudinal direction.

Furthermore, the interlocking element, in particular when it is configured as a hook, may provide an inclined surface preferably provided at the side of the interlocking element which faces away from the undercut and/or is opposite the undercut. The inclined surface is thus preferably arranged at the rear side of the hook when the undercut provides a clearance which is opened towards the front and at the front side of the hook when the clearance is opened towards the rear. The inclined surface of the hook may be arranged at an angle $\gamma$ of 90° to 150°, 91° to 120° or 95° to 110° relative to the upper side of the heel. If a recess is provided at the upper side of the heel, in which the sole component (in particular the rear sole portion) is received, the angle $\gamma$ may be provided between the bottom of the recess and the inclined surface.

The recess for receiving the interlocking element at the sole component may comprise a deflectable and/or movable locking element which is moved when inserting the interlocking element and engages with the undercut of the interlocking element when the heel is completely slid onto the sole component. Preferably, the locking element is pushed forwards or rearwards by the interlocking element in the sole's longitudinal direction when the heel is slid onto the sole component. The locking element may for example be coupled with one more springs (for example one or more coil springs), which are elastically deformed when inserting the interlocking element into the receiving portion. The locking element may for example be provided by a cylindrical or prism-shaped body, which is preferably hollow. For example, a hollow little tube may be used. The locking element may be made of a different material than the rear sole portion, for example metal.

According to embodiments of the invention, the rear sole portion may provide a first, second and/or third abutment surface for the heel (preferably for the upper side of the heel). Optionally, a fourth abutment surface may additionally be provided. The first abutment surface is preferably configured such that it abuts the bottom of the recess at the upper side of the heel when the heel is mounted to the sole component. The second abutment surface is preferably arranged at an angle $\lambda$ of 10° to 60°, 20° to 40° or 25° to 35° relative to the first abutment surface. Preferably, it is contiguous with the first abutment surface or is provided adjacent thereto. The third abutment surface is preferably arranged substantially parallel to the first abutment surface, but not in the same plane, wherein the third abutment surface is arranged preferably adjacent to the second abutment surface and/or connected to the first abutment surface via the second abutment surface. The fourth abutment surface is provided preferably substantially parallel to the first abutment surface. Preferably, it is not arranged in the same plane as the first abutment surface, but closer thereto than the third abutment surface. The fourth abutment surface may extend around the first, the second and/or the third abutment surface in a U-shaped manner. The heels according to the present invention may, therefore, be configured at their upper sides such that they contact the first, second, third and/or fourth surface in the fixed state. Hence, the bottom of the recess at the upper side of the heel may abut the first abutment surface, the upper inclination the second abutment surface, and/or the end stop surface the third abutment surface. The angle $\lambda$ may be 180° minus the angle $\omega$.

The recess for receiving the interlocking element may comprise a wall, which is arranged at an angle $\pi$ relative to the first abutment surface. The angle $\pi$ may be 60° to 140°, 80° to 120° or 91° to 110° and preferably amounts to between 180° minus the angle $\gamma$ of the interlocking element (angle between the bottom of the recess and the inclined surface). Said wall may be a rear wall of the receiving portion to which the inclined surface of the interlocking element abuts when the heel is mounted to the sole component. The angular dimensions of the angles $\pi$ and $\lambda$ may be different.

The sole component and/or the heel may further comprise a mechanism for releasing the locking system, for example when the heel should be taken off from the sole component. The mechanism preferably allows an elastic deflection of the interlocking element and/or the locking element, so that the undercut of the interlocking element and the locking element may be decoupled and/or released from each other.

The mechanism for releasing the interlocking system may for example comprise an actuation element which provides an interface for the user. Said actuation element may for example be a lever which is mechanically coupled to the locking element so that the actuation of the lever leads to a movement of the locking element. The lever may for example be rotatably mounted to the sole component (for example at the middle sole portion). The locking element may be connected to the actuation element (for example the lever) via one or more strings (for example nylon strings) or wires. When actuating the actuation element (for example by swivelling the lever), preferably a tensile force is applied on the strings which leads to a movement of the locking element. If the actuation element is configured as a hollow body, a string or a wire is guided preferably from the actuation element through the hollow body and subsequently back to the actuation element.

According to embodiments of the invention, the locking system may be reversed. The interlocking element (for example the hook, the ratchet or the snap-in lug) may be provided for example at the sole component (for example at the rear sole portion) and the receiving portion for the interlocking element may be provided at the heel.

The heel and/or the sole component may further provide a donning aid. By means of the donning aid the heel may preferably be retained and/or provided at the sole component, before the heel is locked at the sole component by the locking system. The donning aid thus preferably allows a preliminary fixation of the heel at the sole component.

The heel is preferably retained and/or provided at the sole component by the donning aid in such a way that the heel is locked when the sole component (in particular the rear sole portion) is loaded with weight. Due to the donning aid, the heel may thus first be put onto the donning aid (for example by using both hands), wherein the shoe may subsequently—preferably without the heel falling off—be put on the ground and loaded (for example by the wearer's weight) in order to lock the heel to the sole component with the locking system.

The donning aid according to the present invention may be provided at the sole component by means of a cantilevered arm (which may also be referred to as cantilever), which preferably extends rearwards from the middle sole portion in the sole's longitudinal direction and/or is provided below the rear sole portion. Preferably, the arm provides a latching or snap-fit mechanism, by which the heel is retained when the heel is put onto the donning aid. For this purpose, the rear end region of the arm may for example comprise a locking protrusion which engages with a corresponding recess of the heel. Alternatively or additionally, the arm may comprise a recess for a projection provided at the heel. It is also possible to provide the cantilevered arm at the heel and a corresponding opening for the cantilevered arm at the sole component.

The recess or the projection of the donning aid at the heel is preferably provided inside the heel, for example such that it is not visible from the outside. When the heel comprises an opening for receiving the rear part of the first supporting element when the heel is fixed at the sole component (see above), the recess or the projection may be provided in said opening, for example at the end of the opening which is farthest away from the entrance opening. The recess or the projection preferably form an undercut into which the locking protrusion or the recess at the cantilevered arm may engage. The undercut may for example be provided at the (upper) ceiling of the opening.

The cantilevered arm is preferably configured such that it is elastically deflected when the heel is put onto the sole component and/or onto the donning aid and snaps into the undercut when reaching it. This prevents an accidental removal and/or detachment of the heel before it is ultimately locked. Preferably, the cantilevered arm is deflected downwards in the heel's longitudinal direction when the heel is put on. Thereby it may be achieved that the arm presses the heel against the rear sole portion after snapping into the undercut, which makes an accidental removal and/or detachment of the heel even more difficult.

According to embodiments of the invention, the cantilevered arm may be coupled with the first supporting element or be formed by the first supporting element. However, the cantilevered arm is preferably movable with respect to the rear end of the first supporting element. When the first supporting element is formed by two or more rails (see above), the cantilevered arm may be configured between and/or along two of said rails.

The sole component and/or the heel may further comprise a mechanism for releasing the donning aid. Said mechanism is preferably configured such that it pushes the cantilevered arm (in particular its locking protrusion and/or recess) out of the undercut which is provided at or in the heel, so that the heel may be removed from the sole component (in particular from the cantilevered arm and/or from the rear end region of the first supporting element). The mechanism for releasing the donning aid preferably allows an elastic downwards deflection of the cantilevered arm in the heel's longitudinal direction.

The mechanism for releasing the donning aid may for example be provided as knob or lever at the heel, by means of which the cantilevered arm may be pushed out of the undercut at the heel.

The mechanism for releasing the donning aid may alternatively or additionally be configured at the sole component. Here, the cantilevered arm is preferably deflected via a knob or lever which may be operated by the user. For this purpose, for example one or more levers that are pivotally mounted about a first fulcrum may be arranged at the sole component. The first end of the crank/s may engage with the cantilevered arm whereas the second end of the lever/s serves as user interface or is connected to a user interface. The first fulcrum is preferably arranged between the first and the second end and/or in the middle sole portion.

The user interface may be configured as a lever or tab which may preferably be grasped at one end with the hand and interact at its opposite other end with the pivotally mounted levers and deflect the cantilevered arm via said levers. Here, the user interface may also be mounted at a second fulcrum, which is provided between its ends. When a mechanism for releasing the locking system as well as a mechanism for releasing the donning aid is provided at a sole component according to the invention, the actuation element of the mechanism for releasing the locking system and the user interface of the mechanism for releasing the donning aid may be configured as a single element that fulfils both functions (for example as a lever or knob).

The pivotally-mounted levers may have a curved shape, wherein the first end may extend substantially along the rear end portion of the first supporting element and the second end may extend substantially along the middle sole portion. The first rotation axis around the first fulcrum and/or second rotation axis around the second fulcrum may substantially extend in the plane of the middle sole portion (in particular transverse to the sole's longitudinal direction and/or transverse to the heel's longitudinal direction).

The first fulcrum and/or the second fulcrum may, according to the invention, be provided by the first supporting element, for example in that the pivotally-mounted lever(s) and/or the user interface are attached to the first supporting element via pins. When the first supporting element is formed by two or more rails (see above), the pivotally-mounted lever(s) may be arranged between and/or along two of said rails.

The mechanism for releasing the donning aid may further be configured such that after releasing the cantilevered arm is prevented from again snapping into the undercut. For this purpose, the cantilevered arm may for example be locked in its deflected position. Alternatively or additionally, the opening of the heel, into which the cantilevered arm is inserted, may comprise an inclination which leads to a sliding movement of the heel in the sole's longitudinal direction when the donning aid is released (i.e. preferably when the cantilevered arm is deflected). Thus, the cantilevered arm may preferably no longer engage with the undercut of the heel. In particular, the opening in the heel may be configured such that the heel is moved rearwards in the sole's longitudinal direction due to the downwards deflection of the cantilevered arm. The cantilevered arm then preferably abuts the upper ceiling of the opening in the heel after the donning aid is released, without being able to engage with the undercut again. When the mechanism for releasing the donning aid deflects the cantilevered arm upwards (for example since the undercut is provided at the bottom of the opening), the cantilevered arm may subsequently abut the ceiling of the opening, without being able to engage with the undercut again. Preferably, the heel may subsequently be removed from the sole component, for example rearwards in the sole's longitudinal direction. The inclination may for example be arranged at an angle of 5° to 85°, 20° to 70° or 30° to 60° relative to the heel's longitudinal direction (depending on the embodiment in a clockwise direction or in a counter-clockwise direction).

According to embodiments, the invention relates to a set with heels of different heights, wherein the heels of different heights are configured such that their fixation to the shoes described above leads to different adjustments of the first and/or second mechanism.

According to embodiments of the invention, the sole component according to the invention may comprise one or more of the mechanisms described above for adjusting the curvature in the first transition region and/or one or more of the mechanisms described above for adjusting the sole's curvature in the second transition region. When in one of the transition regions no mechanism is provided, the sole component may for example be configured so flexible in said transition region that it deforms due to the weight of the wearer.

The invention further relates to shoes having one of the described sole components and/or one of the described heels.

The described mechanisms, sole components and heels may each be provided separately or in any combination and set.

The rear sole portion, the middle sole portion and/or the front sole portion may be made of polyamide (for example PA12). For the production (also for production in series) of the rear sole portion, the middle sole portion and/or the front sole portion for example rapid prototyping may be used.

Preferred embodiments of the invention are exemplarily described in the following by reference to the Figures. The Figures are merely schematic illustrations which often do not show other (optional) structures in order to illustrate certain aspects. Different aspects of the invention which are shown in different Figures, may, however, also be provided in a single sole component, heel or shoe according to the invention. In this context, common reference signs may indicate equivalent, similar, comparable or equal components in the shown embodiments. Different embodiments or modifications of the invention may be indicated by apostrophes.

The shown embodiments may be modified in many ways within the scope of the claims. The disclosure of the Figures is not intended to limit the scope of protection of the invention. It has to be noted that the features of the above described embodiments may be combined in a single embodiment. Embodiments of the invention may, depending on the configuration, thus comprise all or only a few of the above-mentioned features.

Figure 1B:
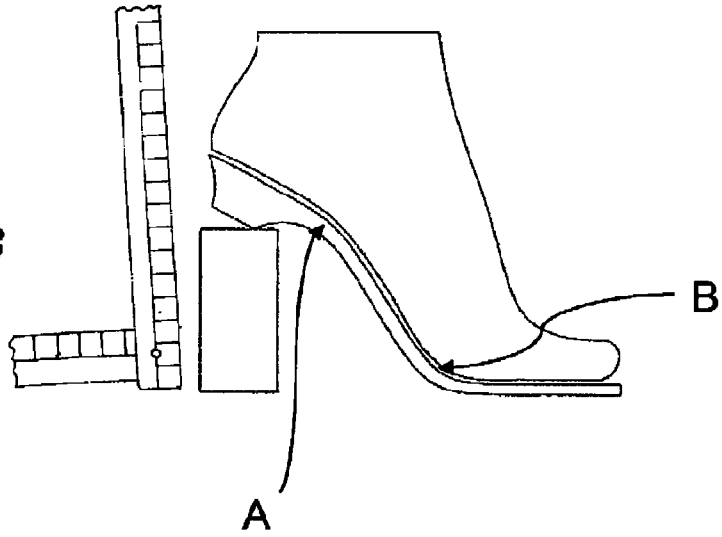
Figure 1C:
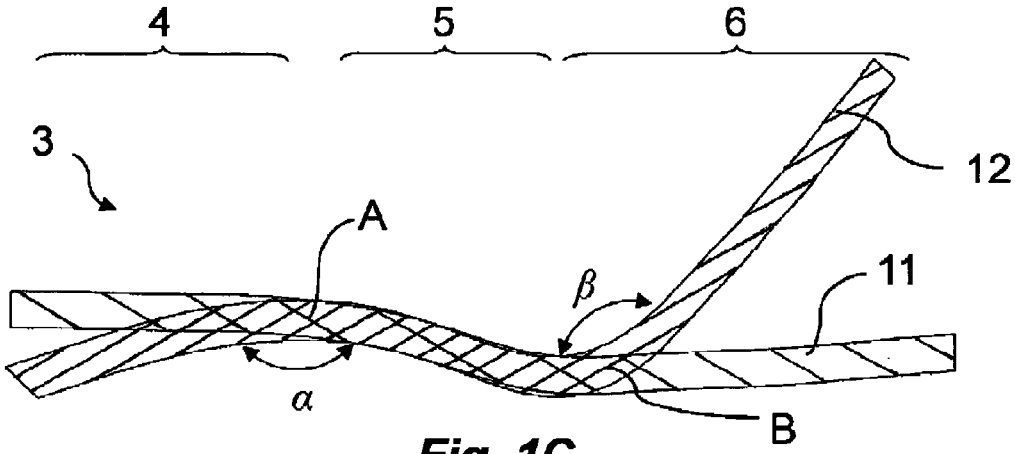
Figures 2A, 2B, 2C, 2D:
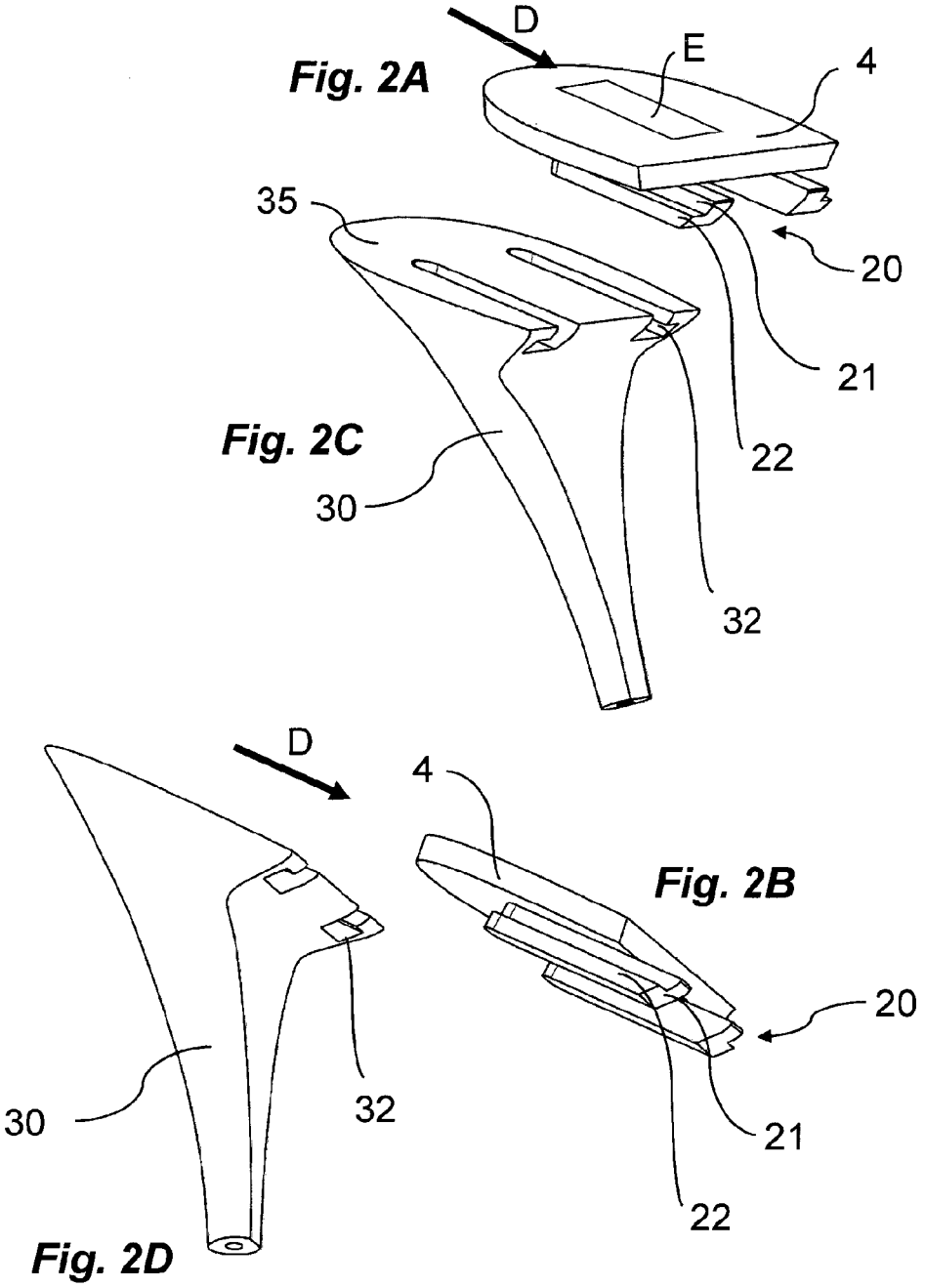
Figure 4A:
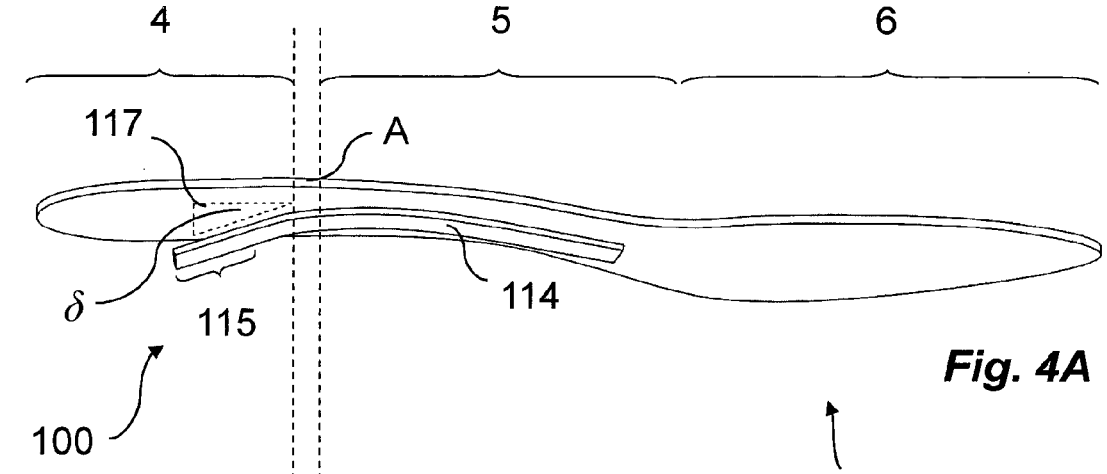
Figure 4B:
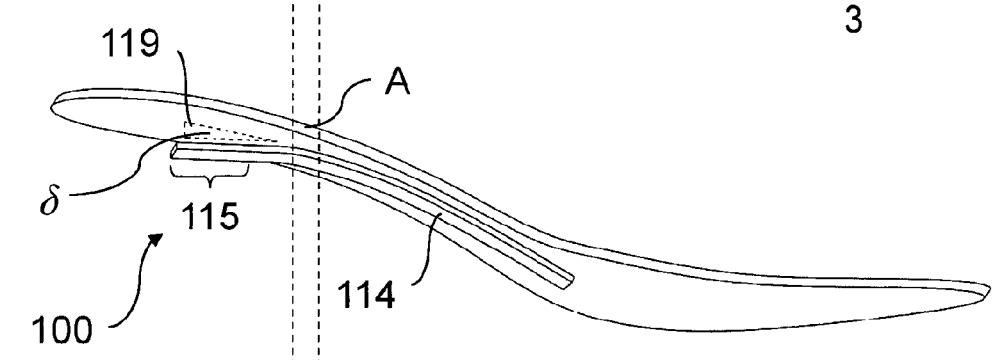
Figure 4C:
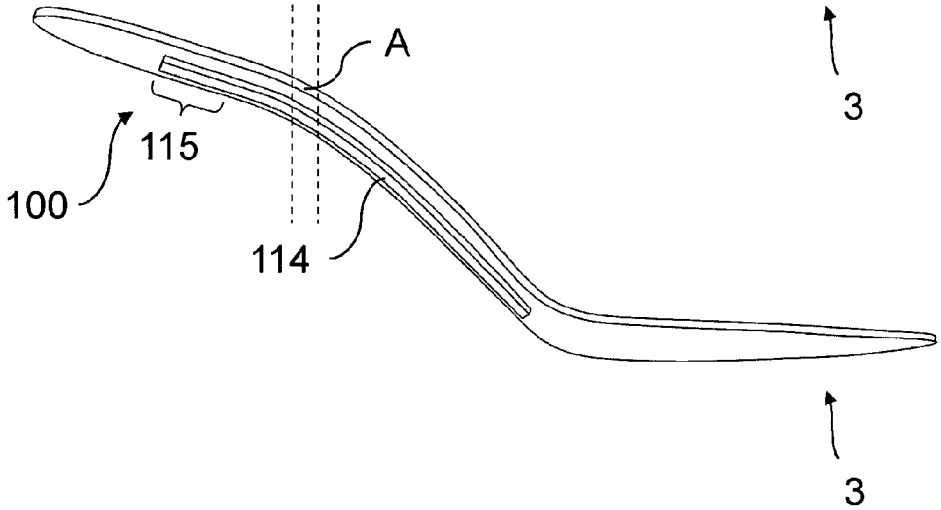
Figure 5A:
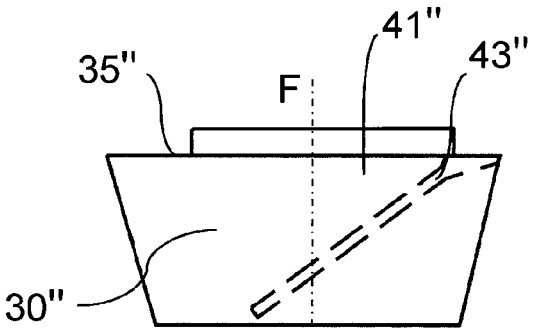
Figure 5B:
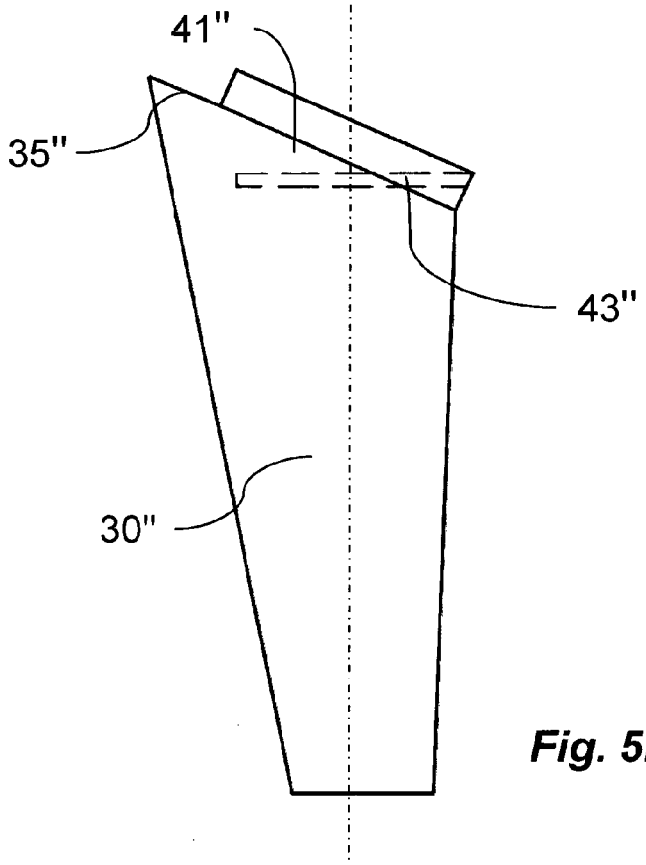
Figure 5C:
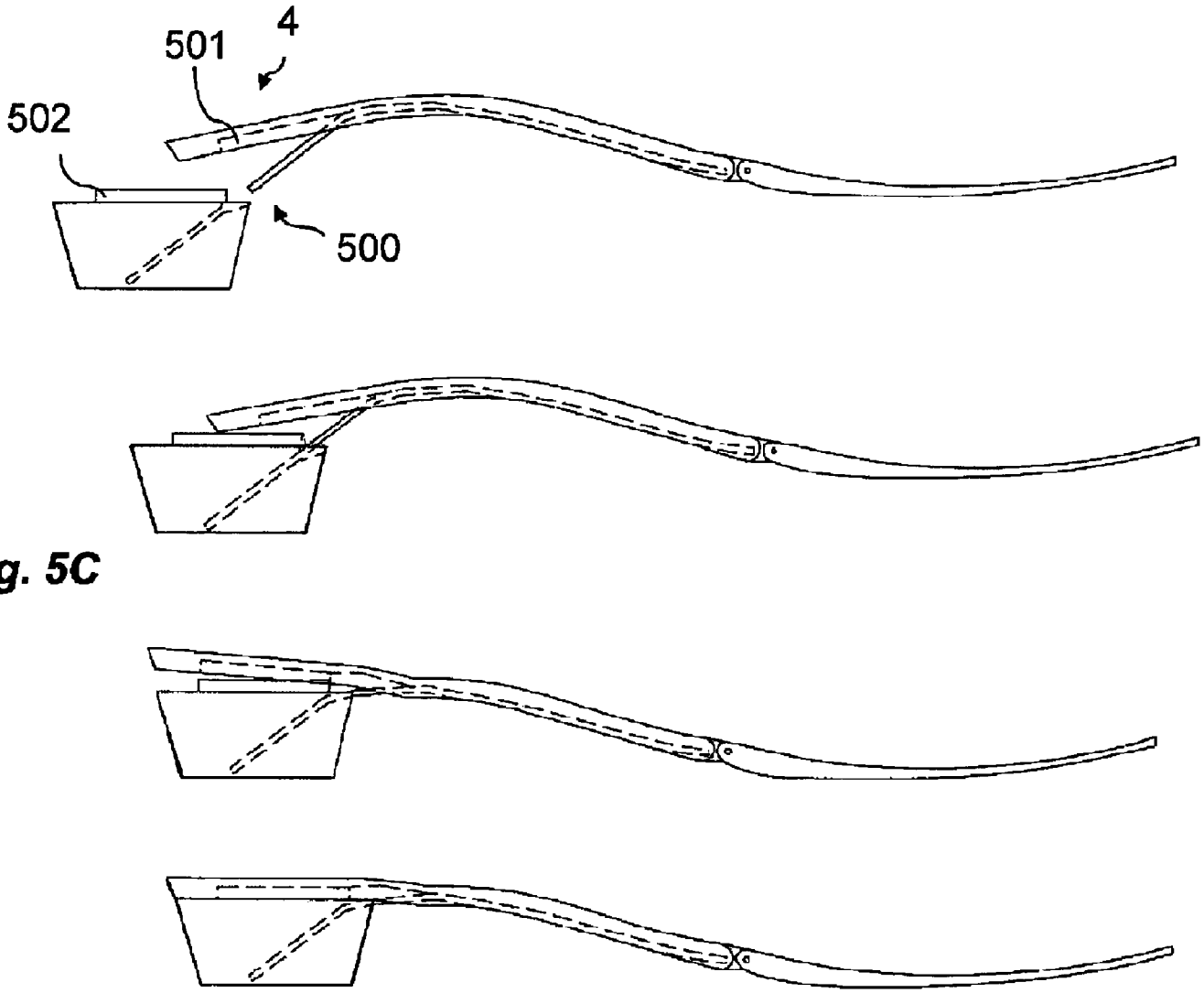
Figure 5D:
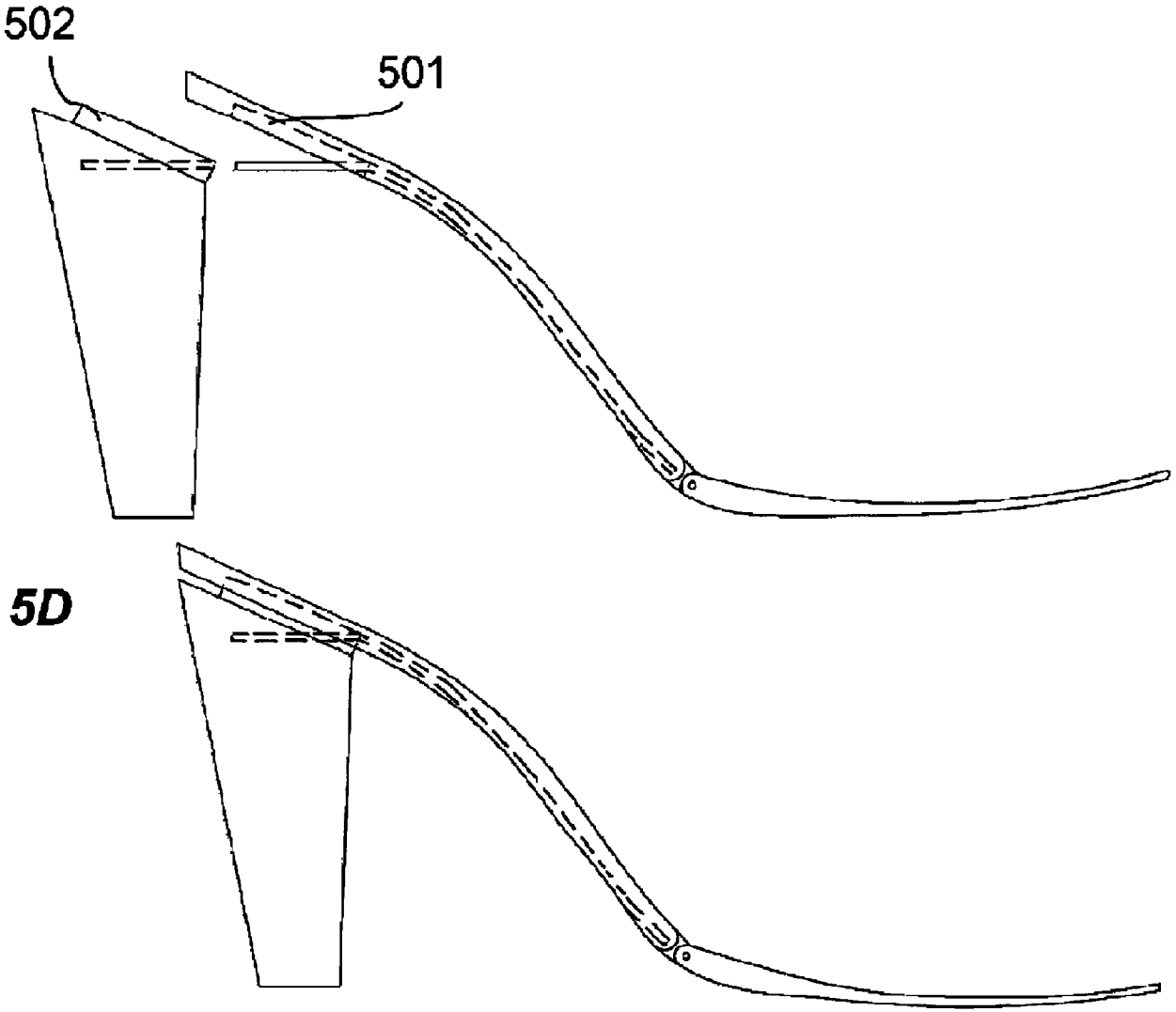
Figure 5J:
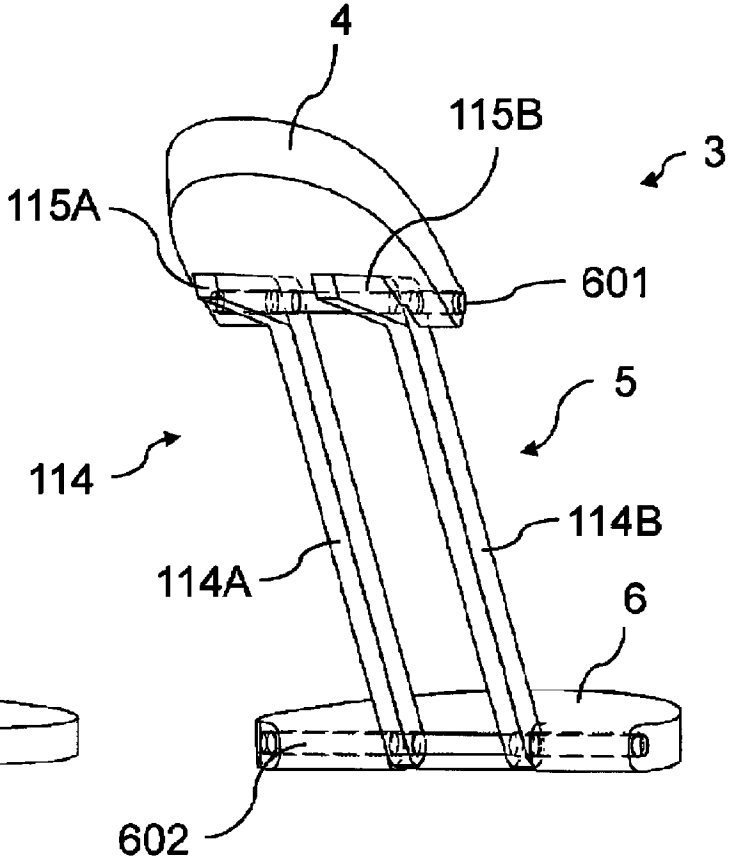
Figure 5H:
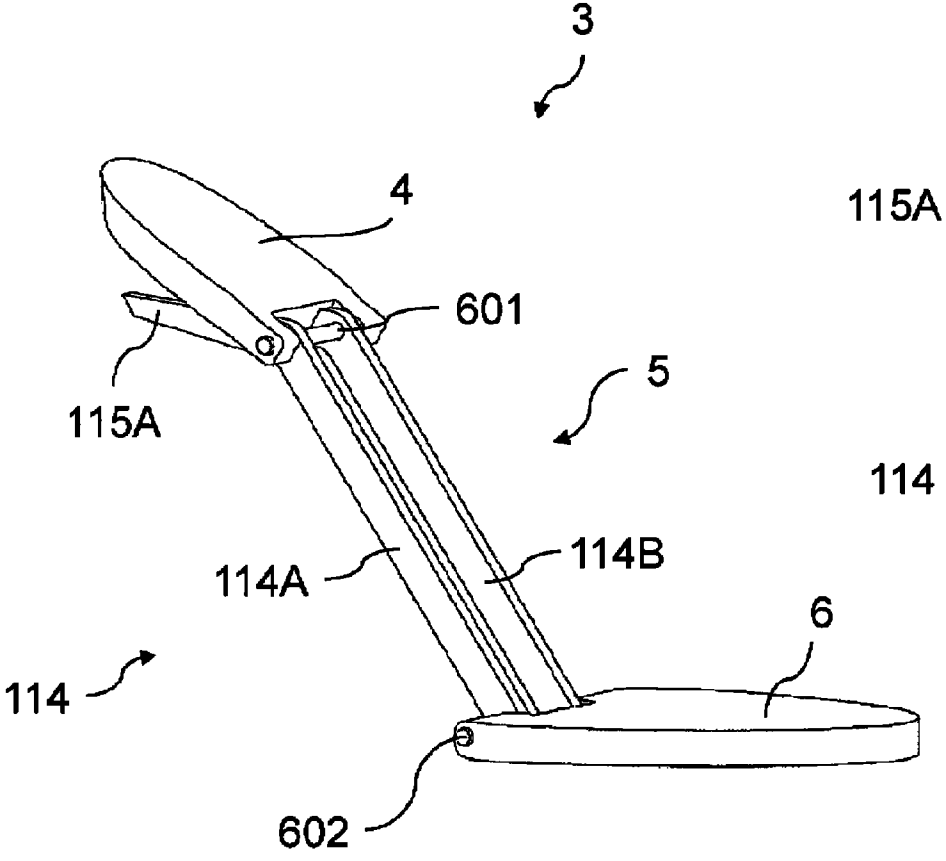
Figure 6A:
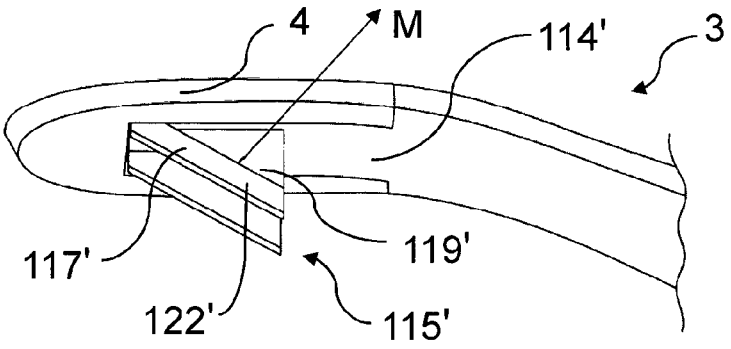
Figure 6B:
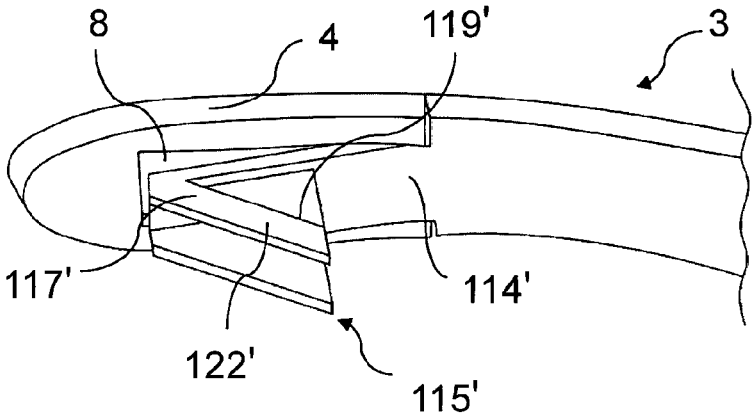
Figure 7A:
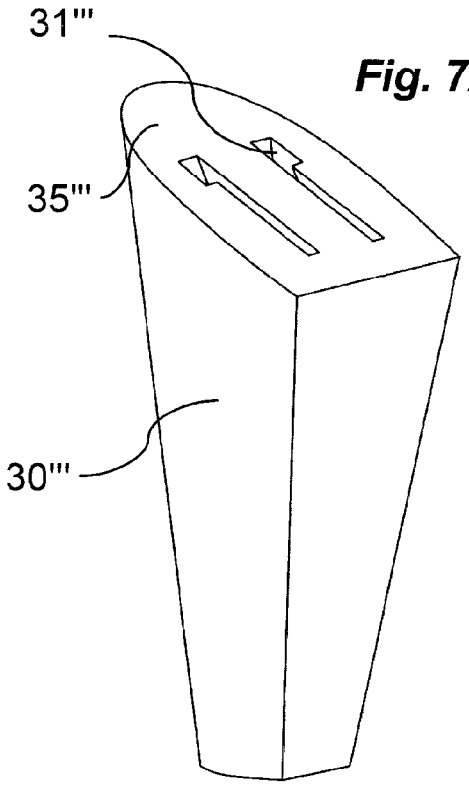
Figure 7B:
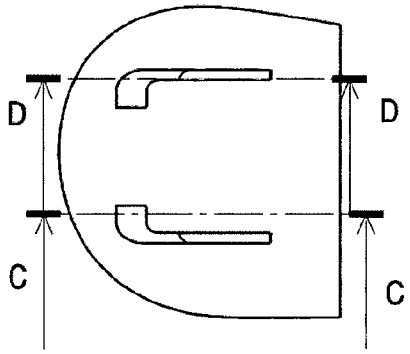
Figure 7C:
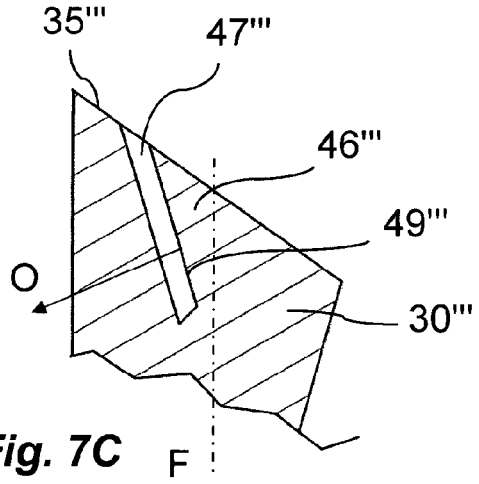
Figure 7D:
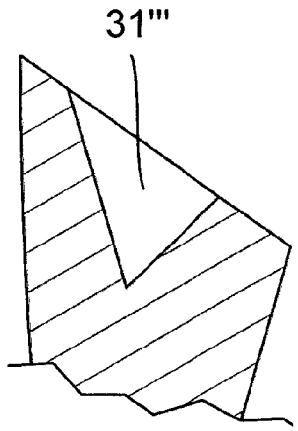
Figure 8A:
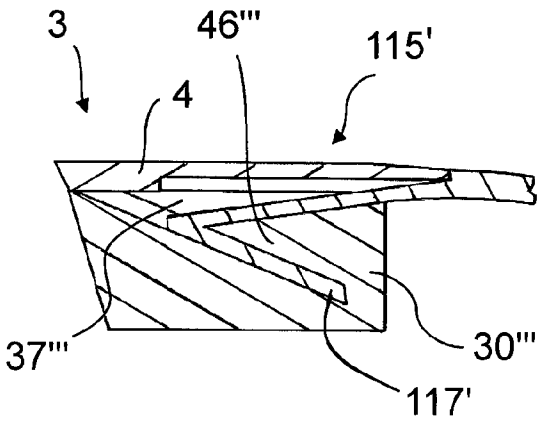
Figure 8B:
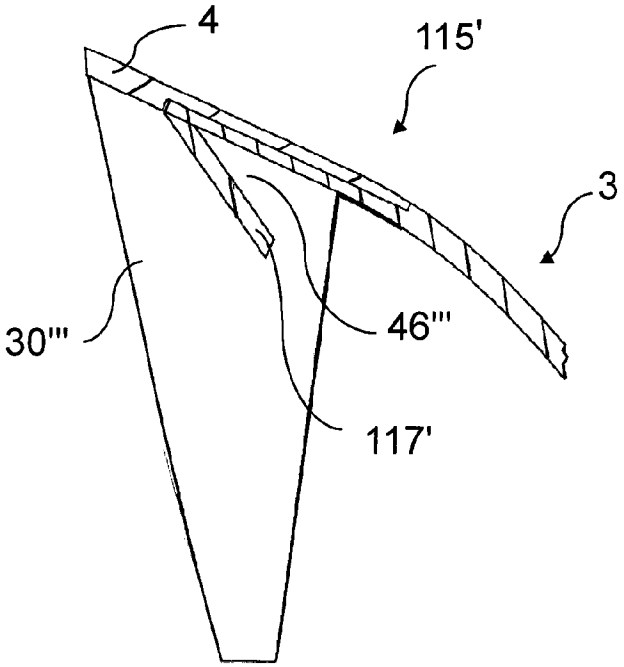
Figure 10A:
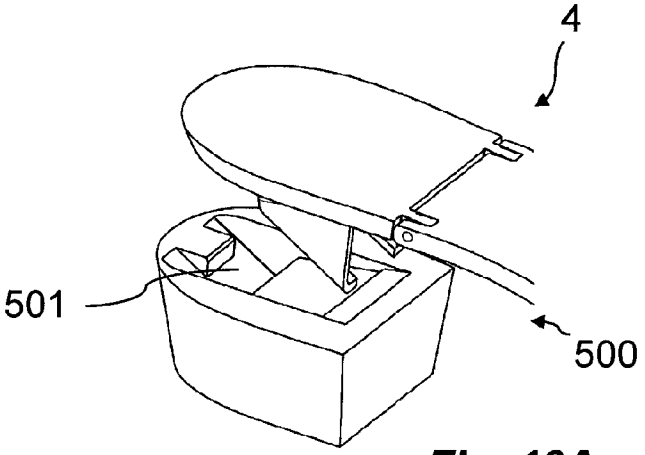
Figure 10B:
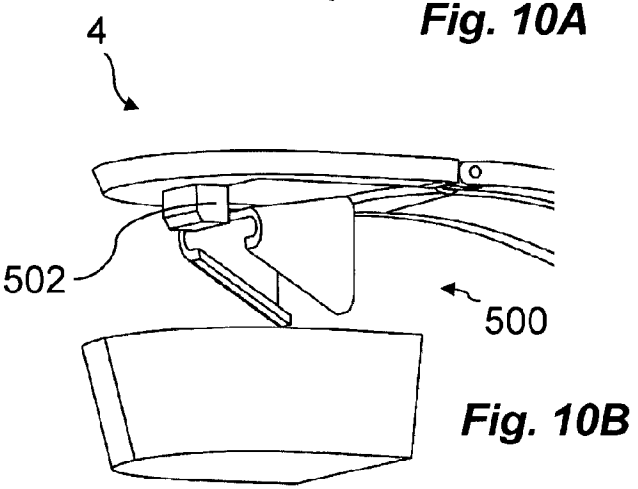
Figure 9A:
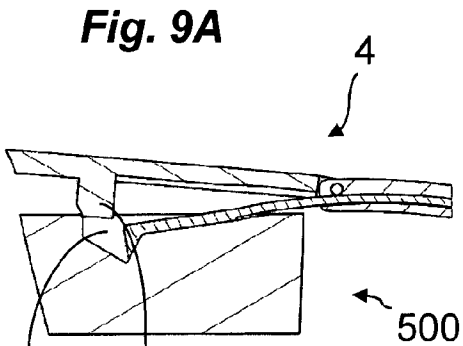
Figure 9B:
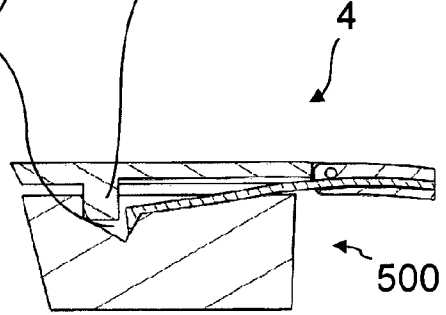
Figure 11A:
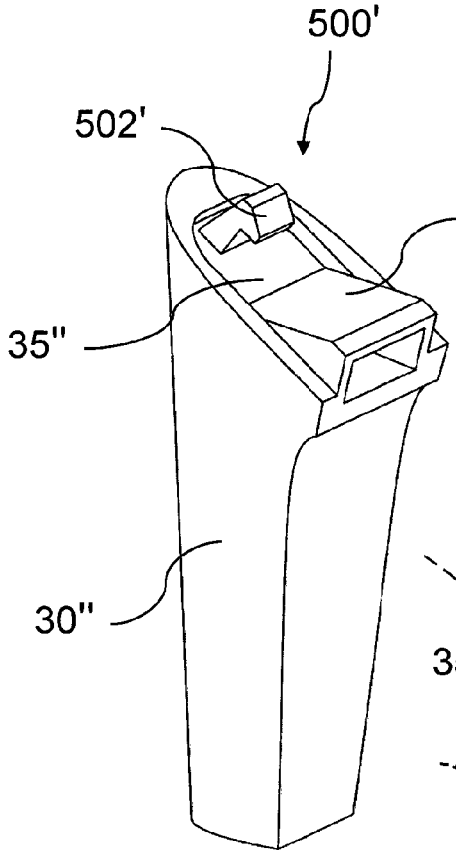
Figure 11B:
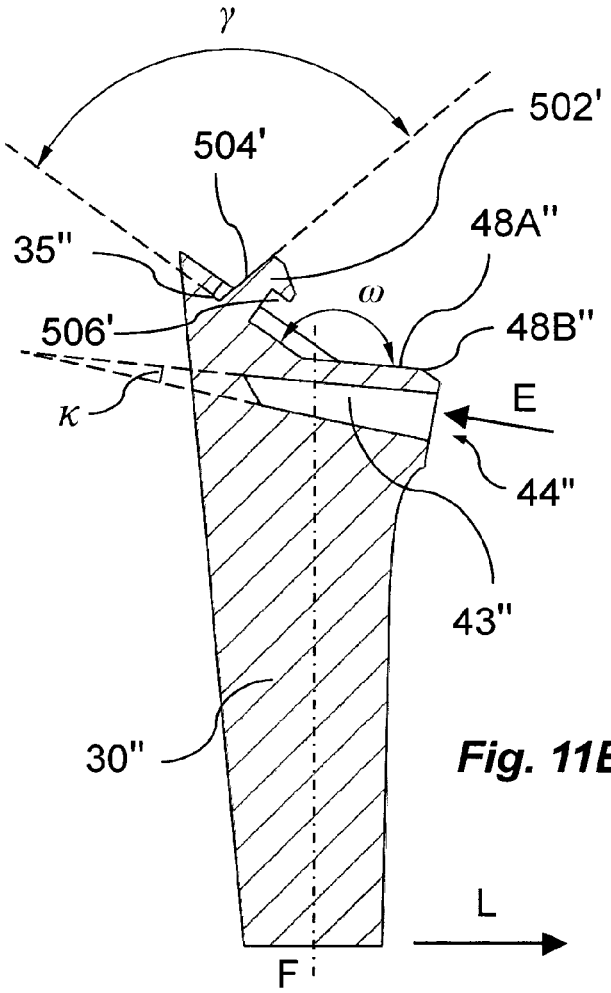
Figure 12A:
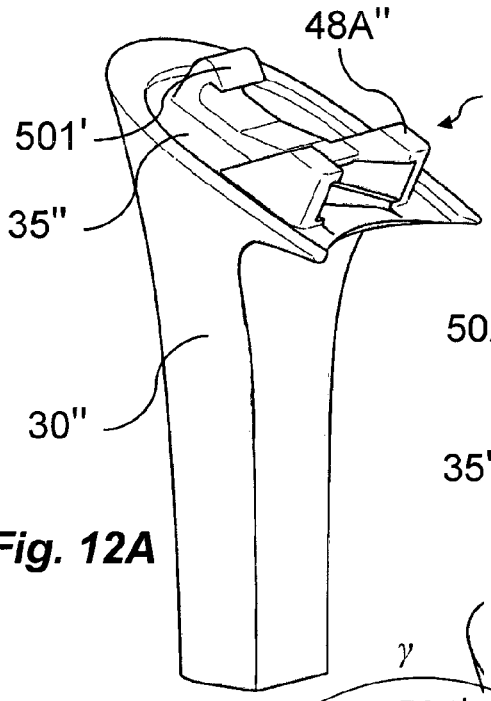
Figure 12B:
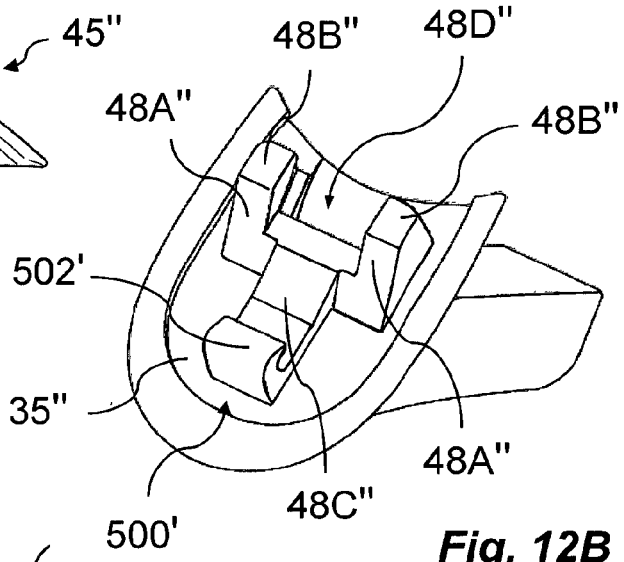
Figure 12C:
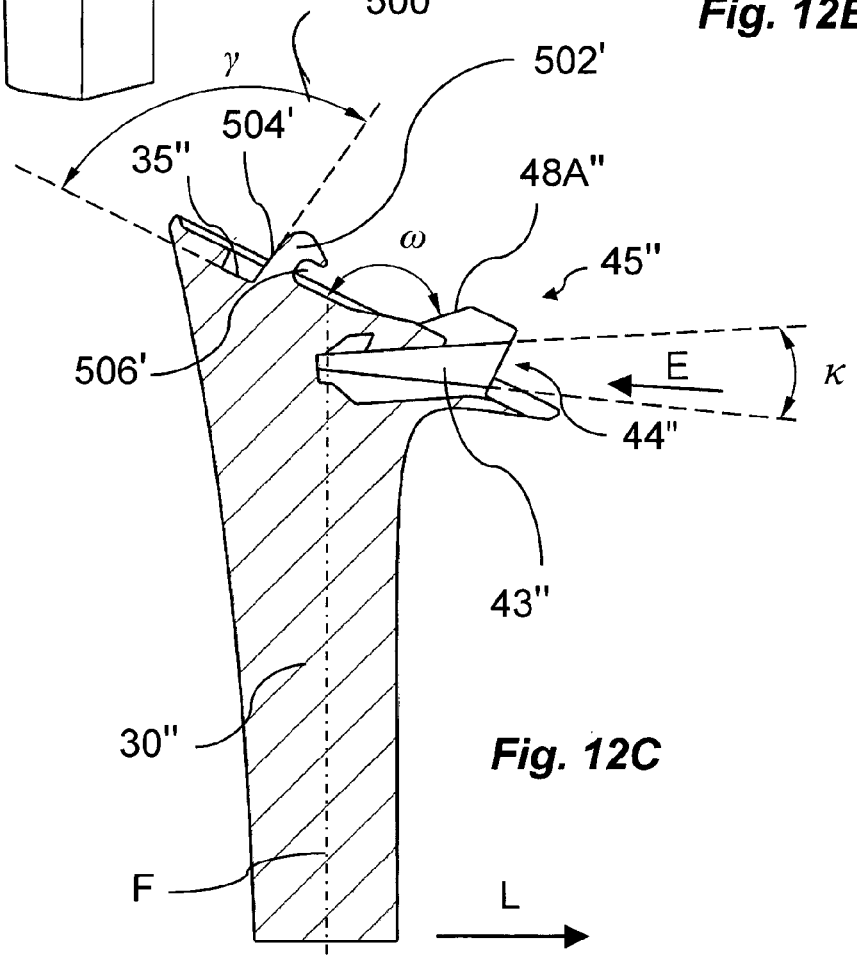
Figure 13A:
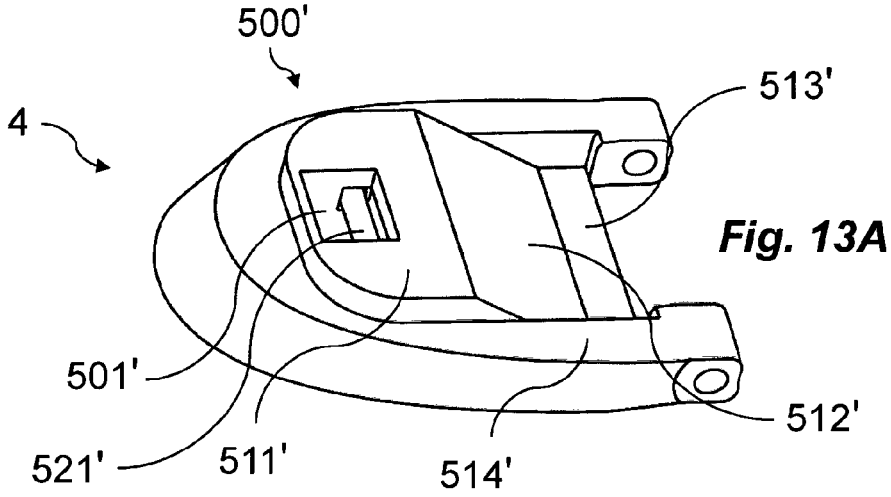
Figure 13B:
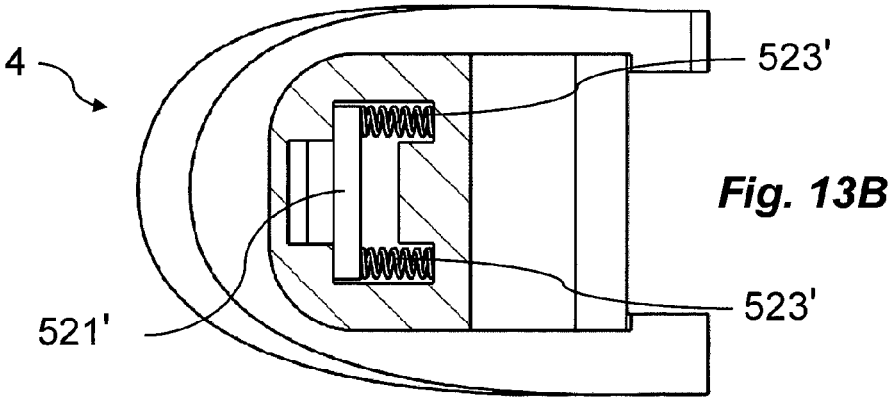
Figure 13C:
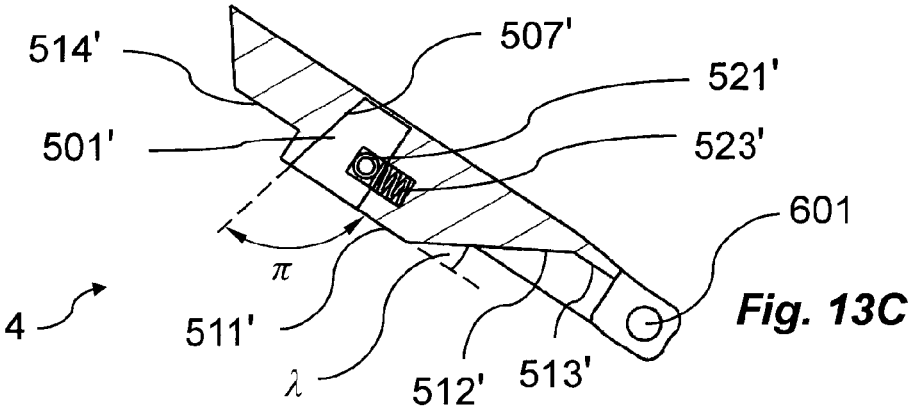
Figures 14A, 14B, 14C:
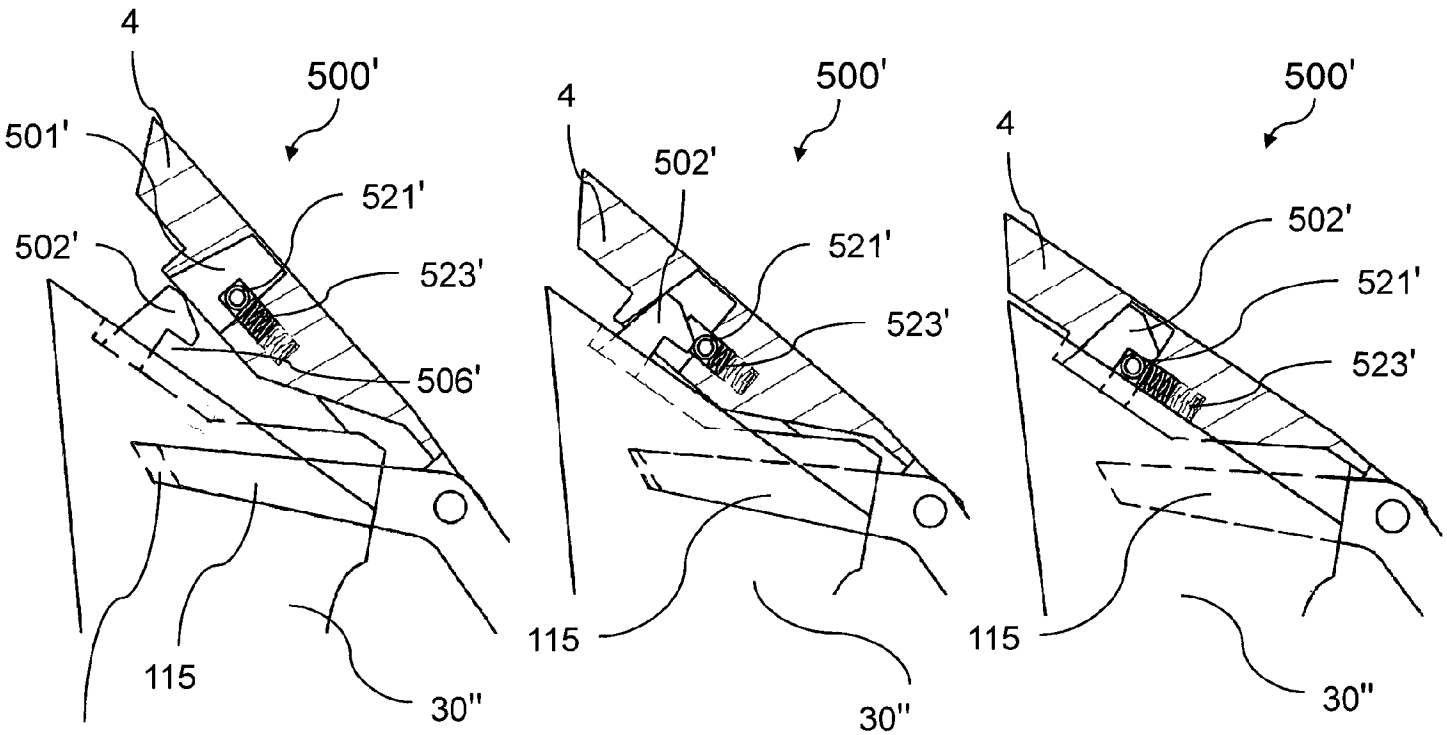
Figure 15:
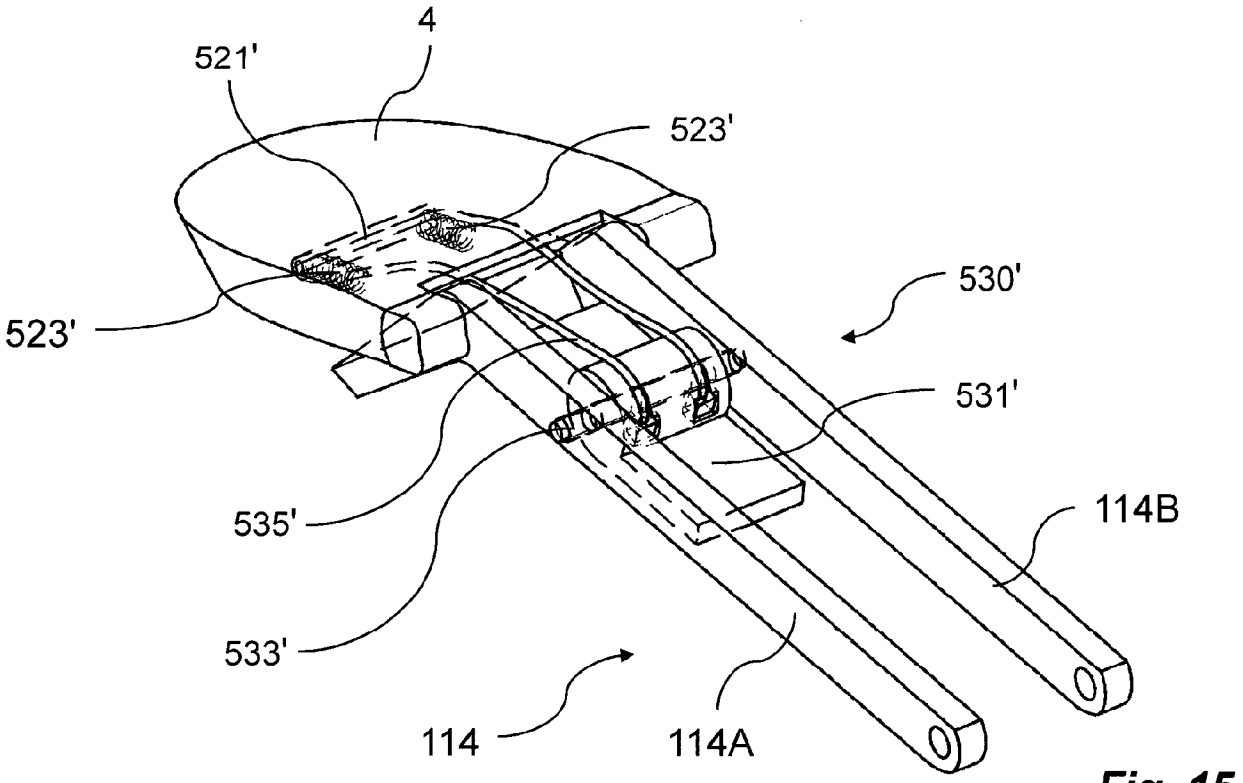
Figure 16A:
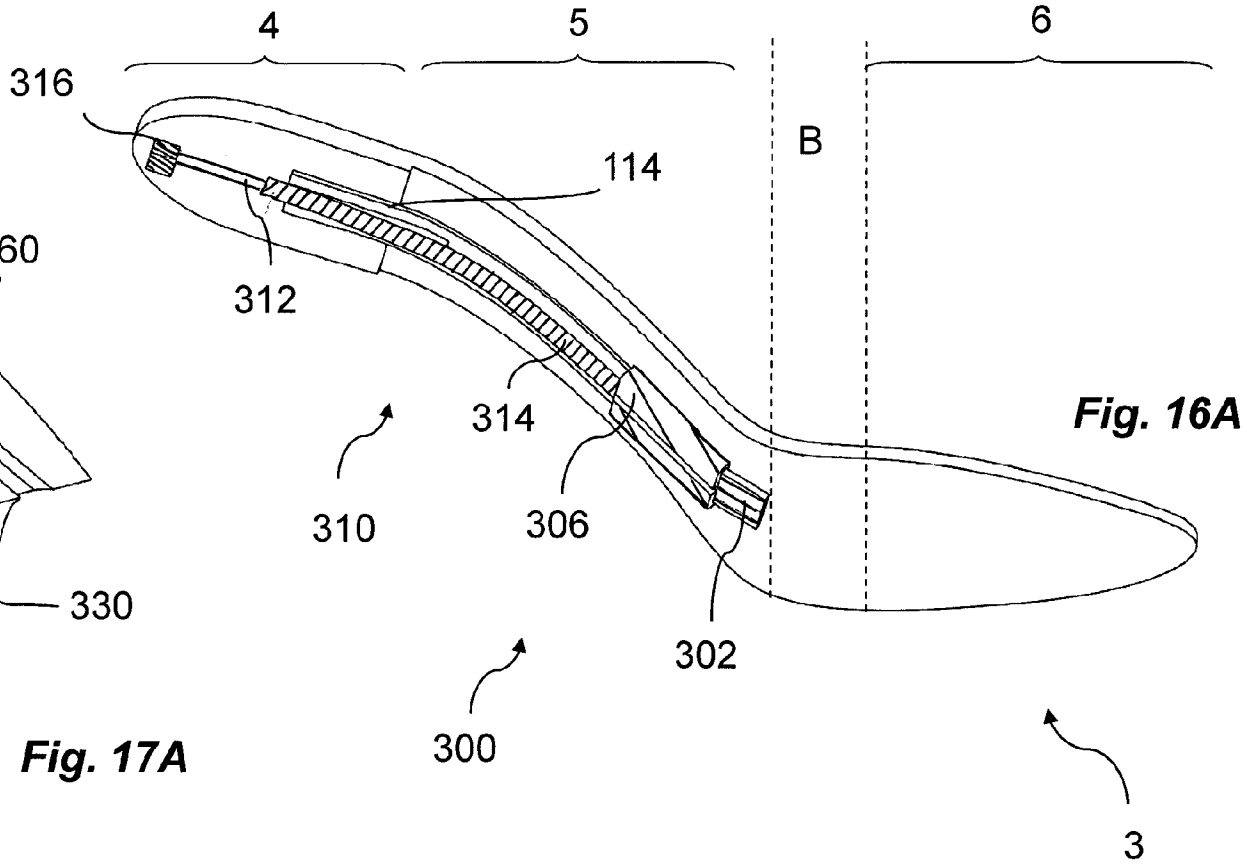
Figure 17A:
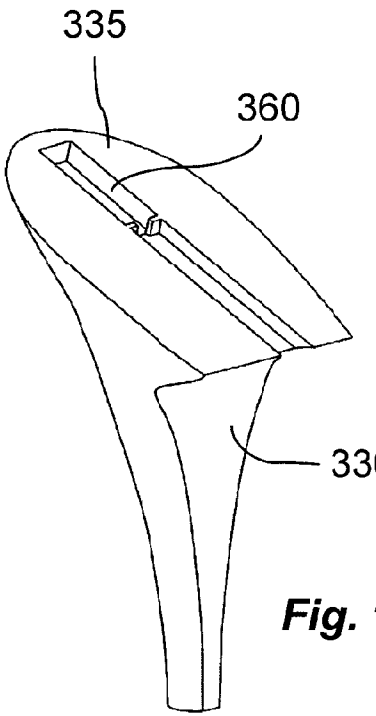
Figures 16B, 17B:
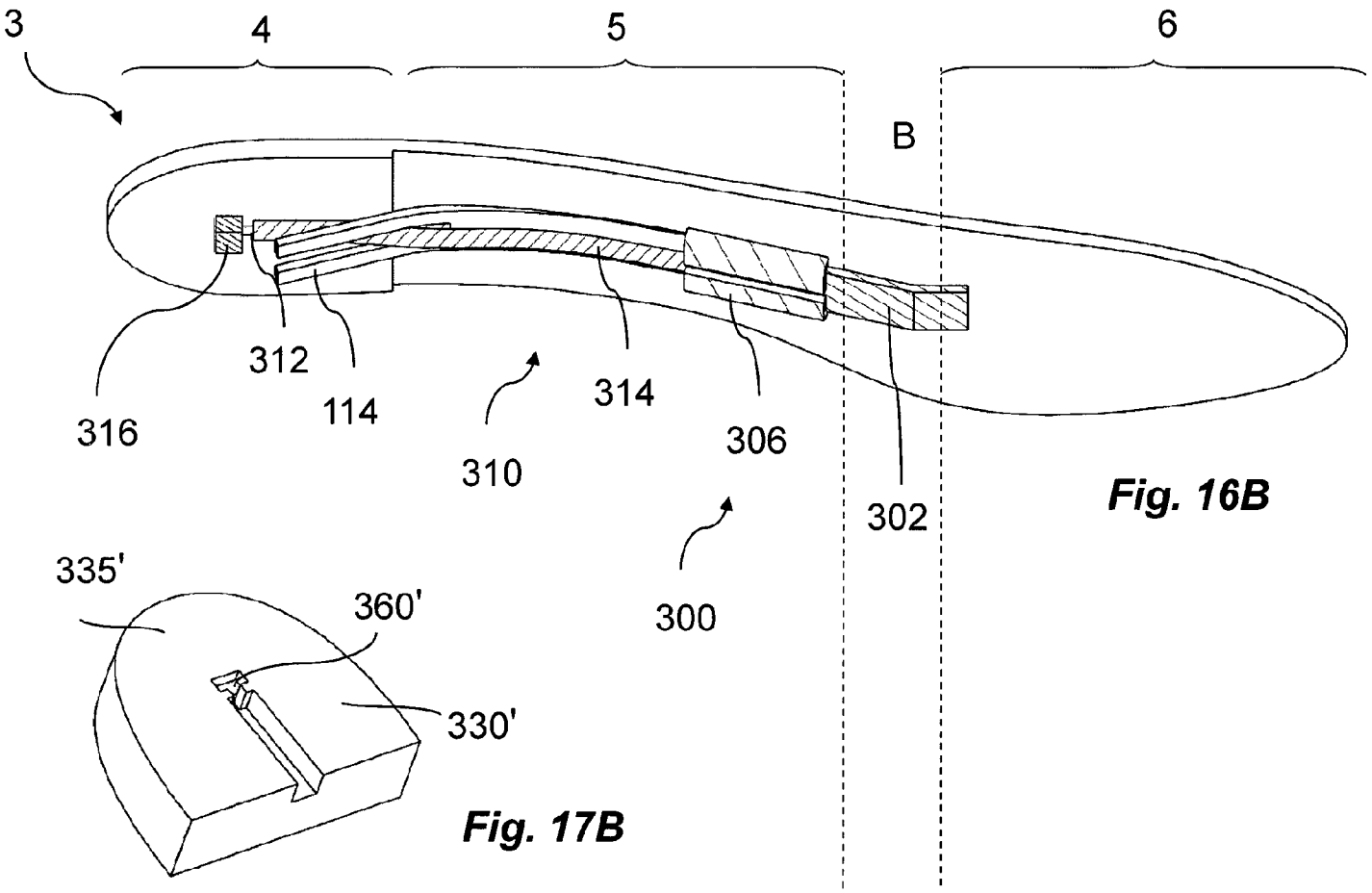
Figures 18A, 18B:
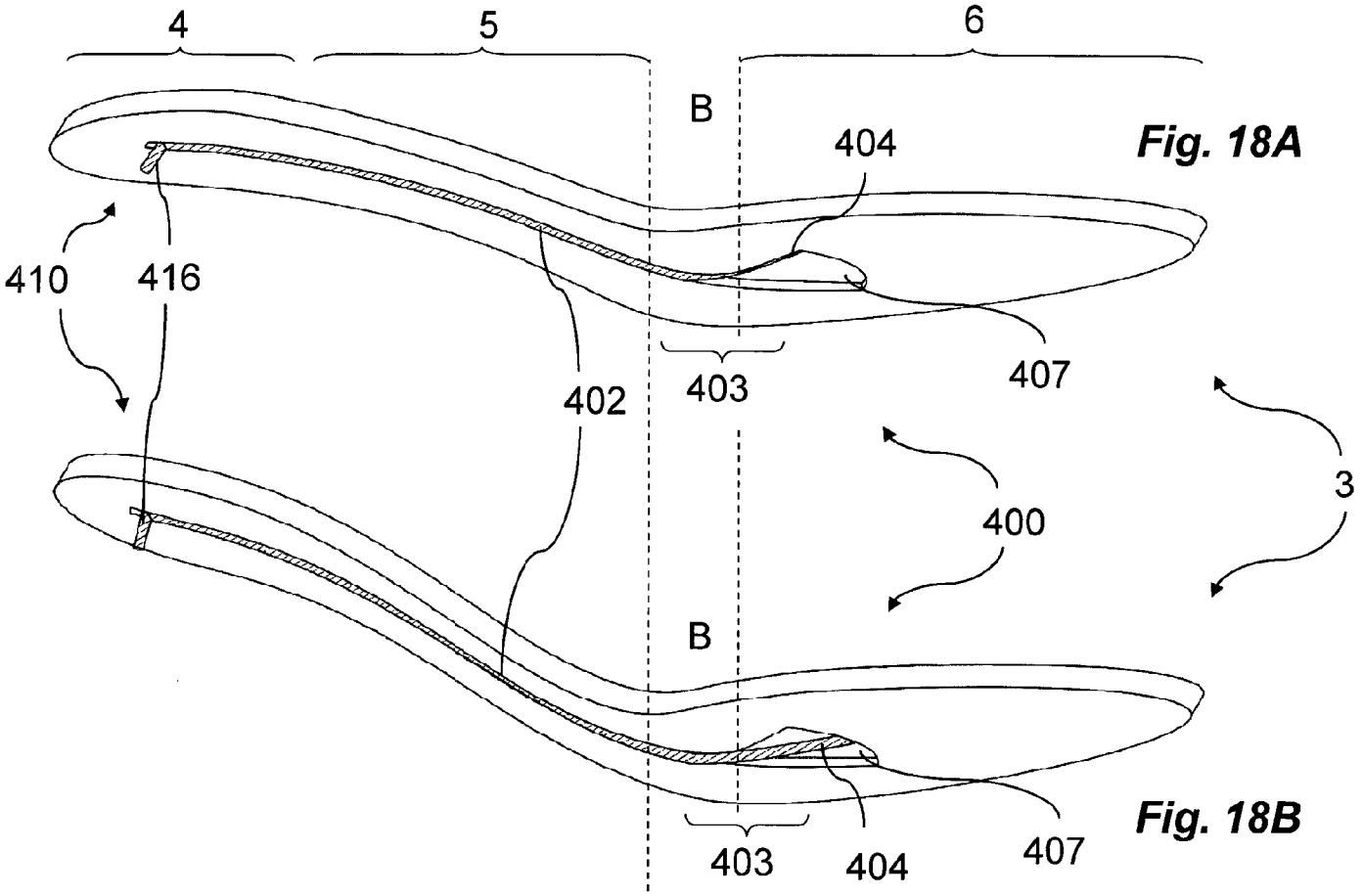
Figure 19A:
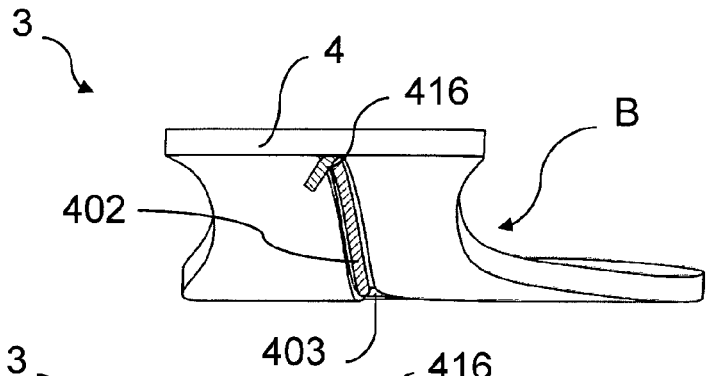
Figure 19B:
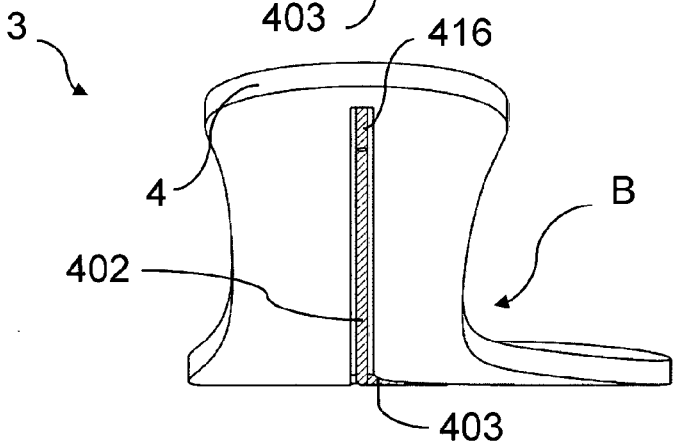
Figure 19C:
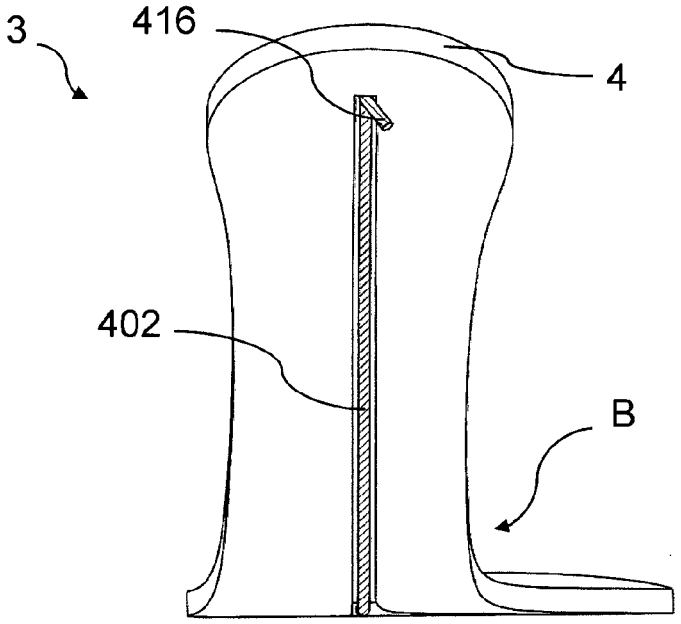
Figure 20A:
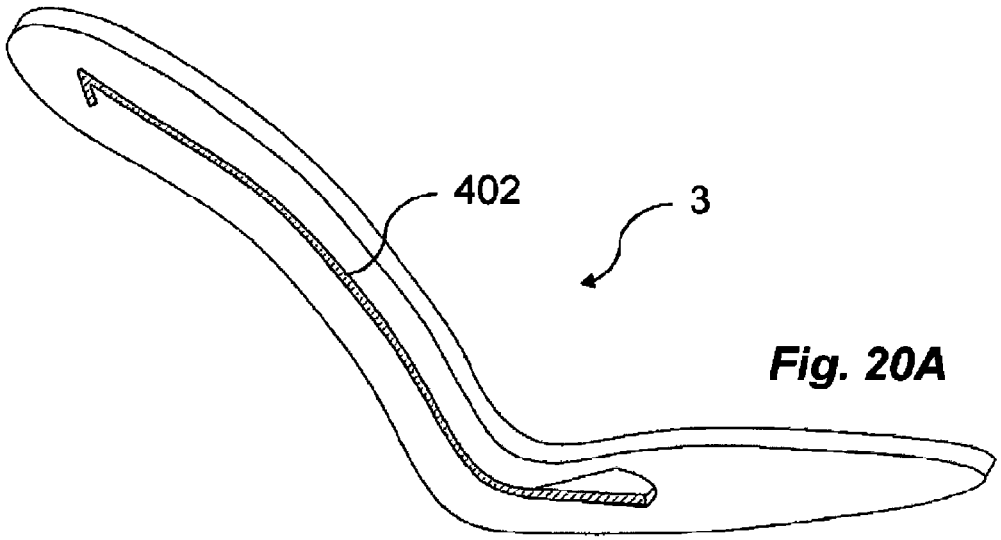
Figure 20B:
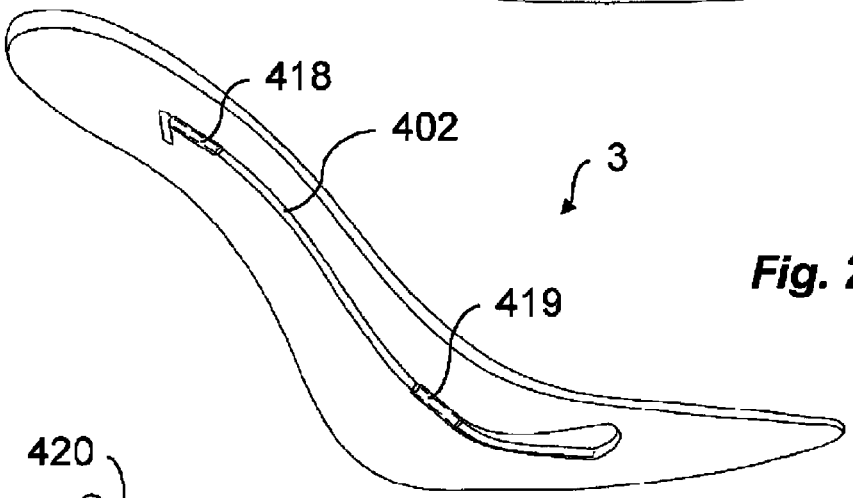
Figure 21:
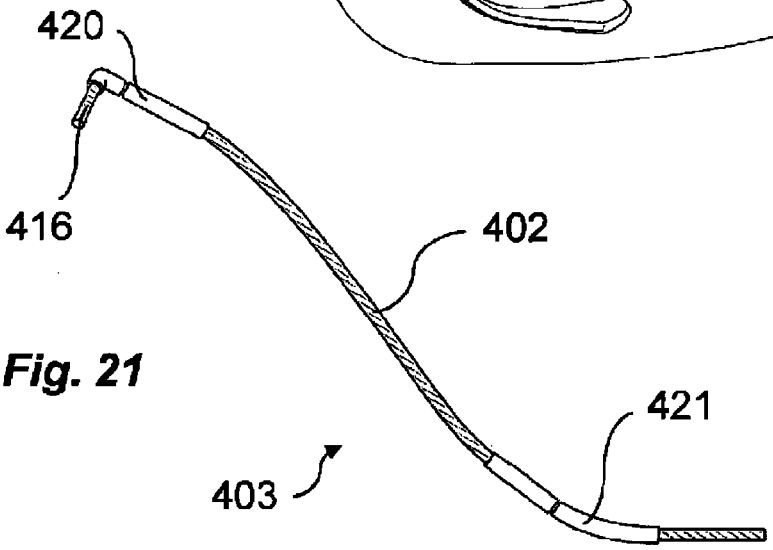
Figure 22C:
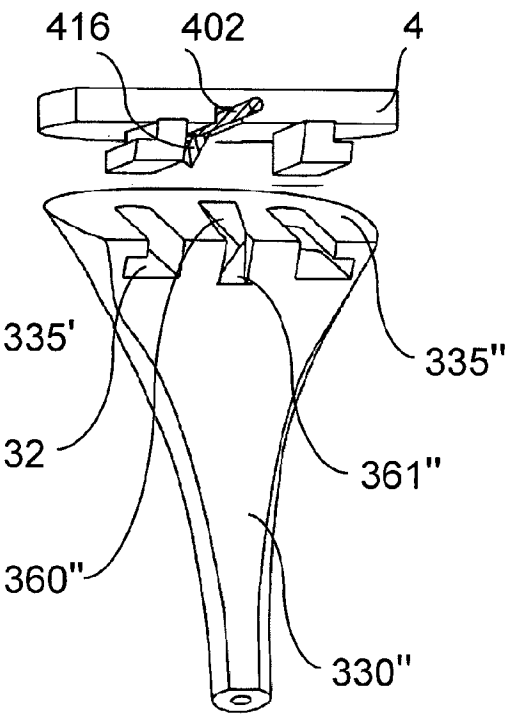
Figure 22B:
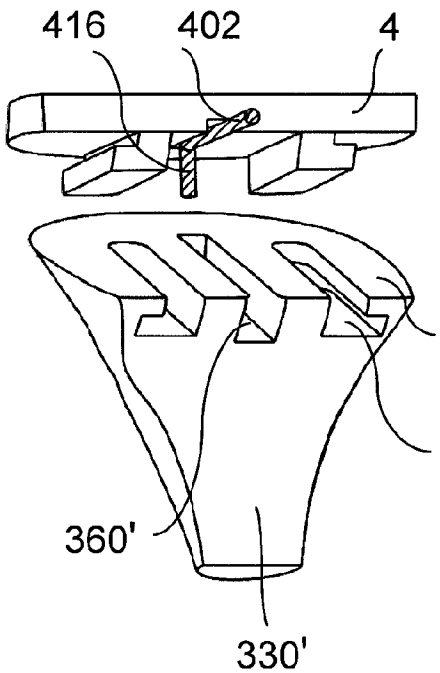
Figure 22A:
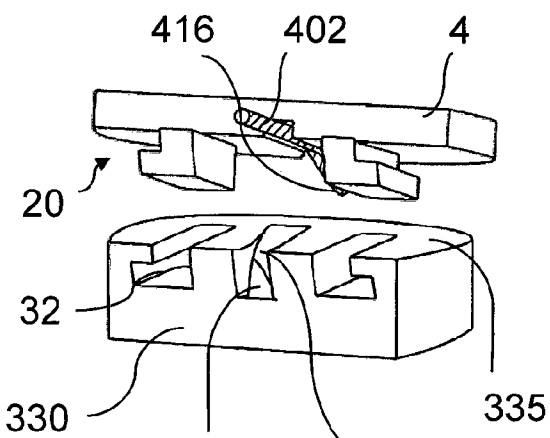
Figure 22D:
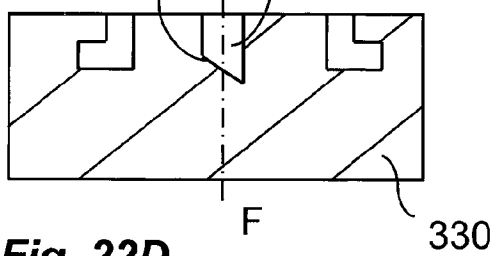
Figure 24A:
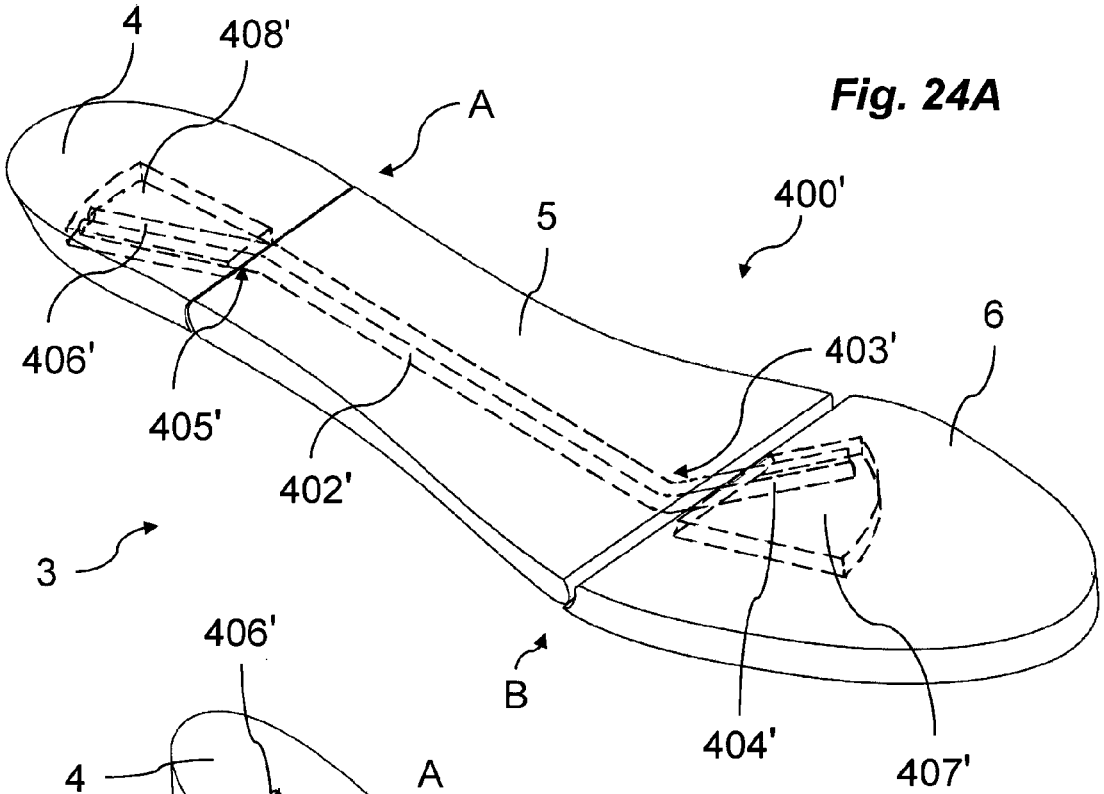
Figure 24B:
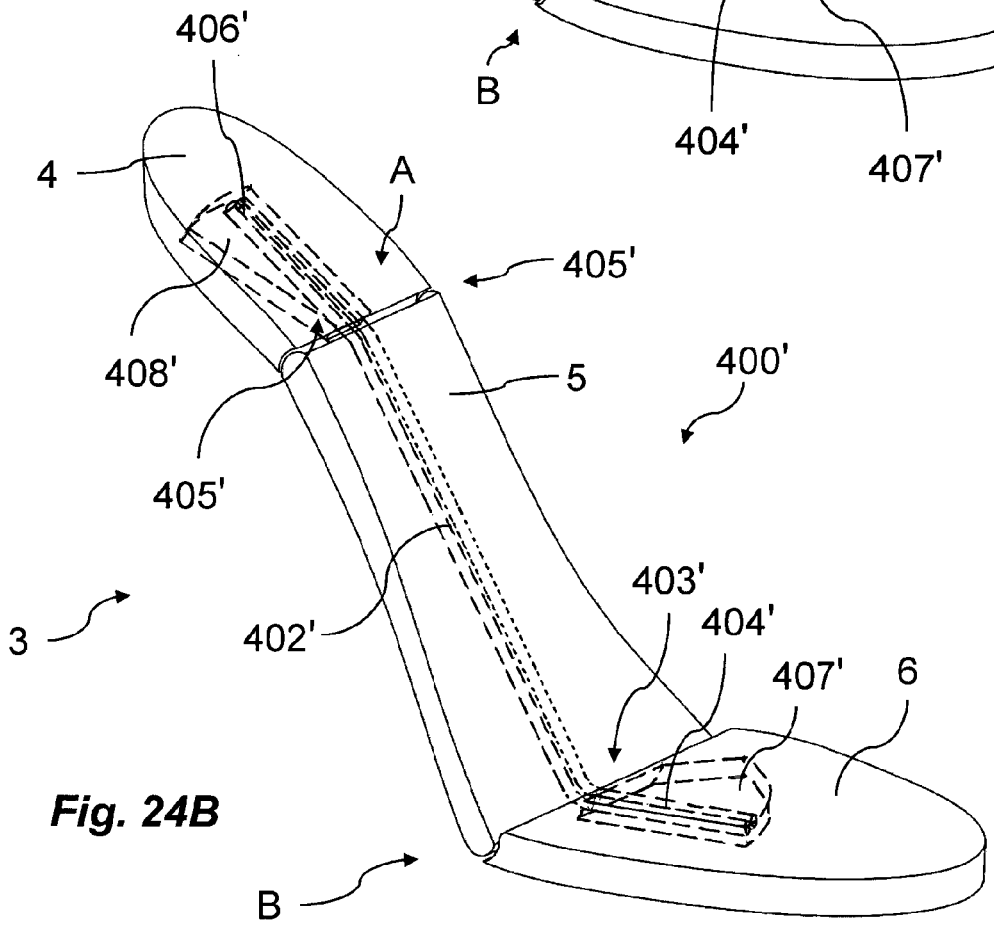
Figure 25A:
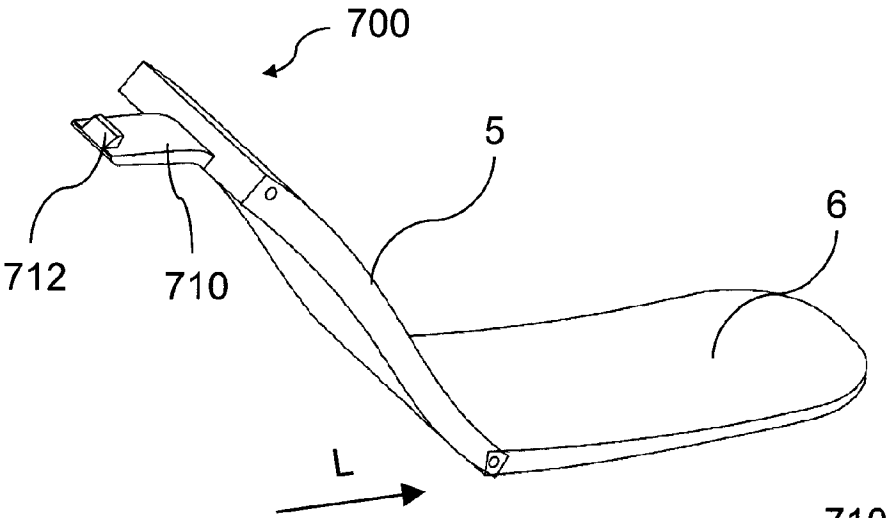
Figure 25B:
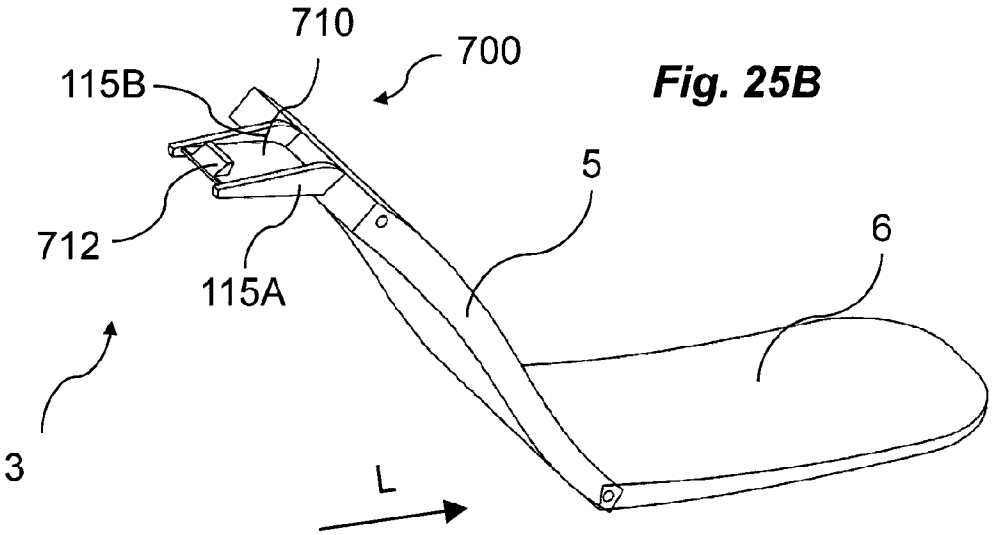
Figures 26A, 26B, 26C:
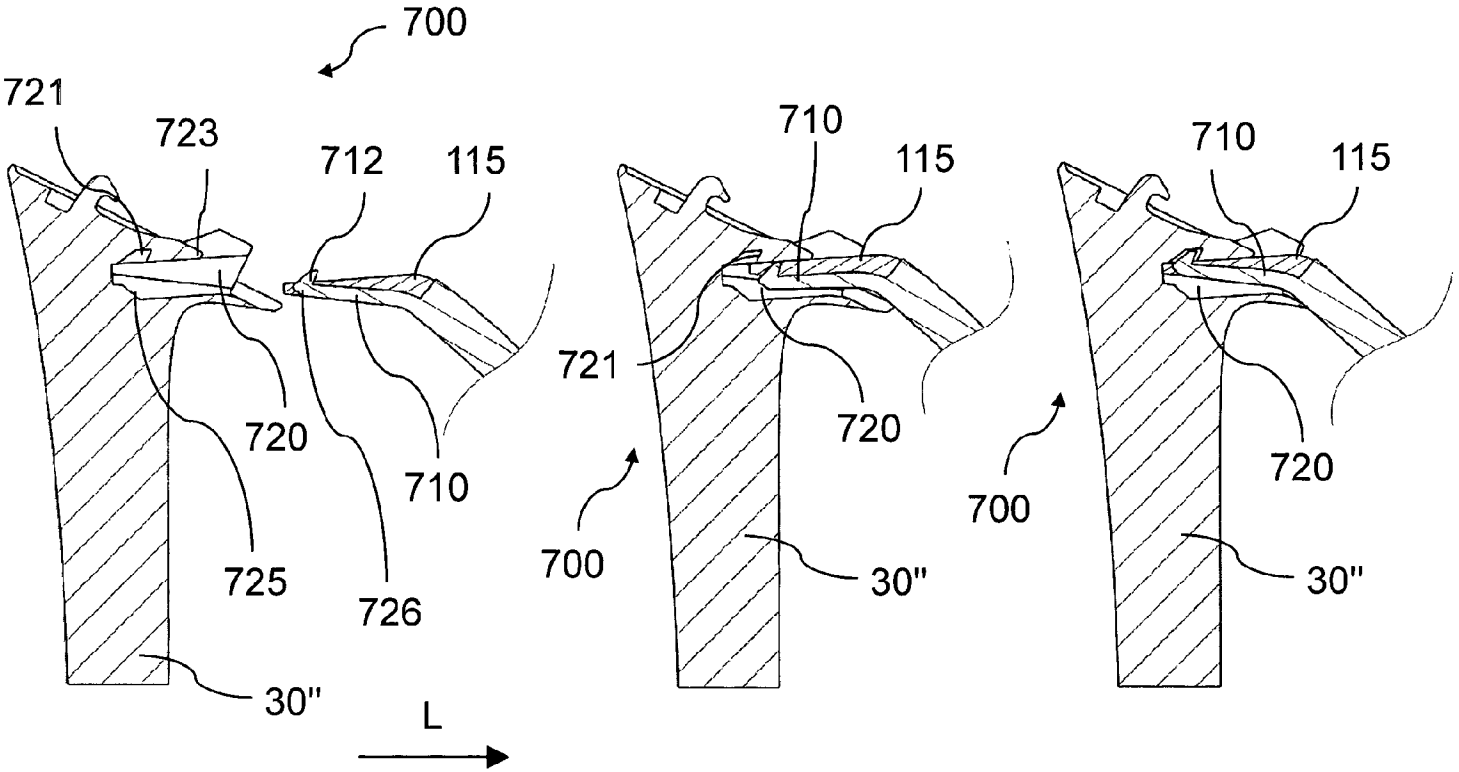
Figures 27A, 27B, 27C:
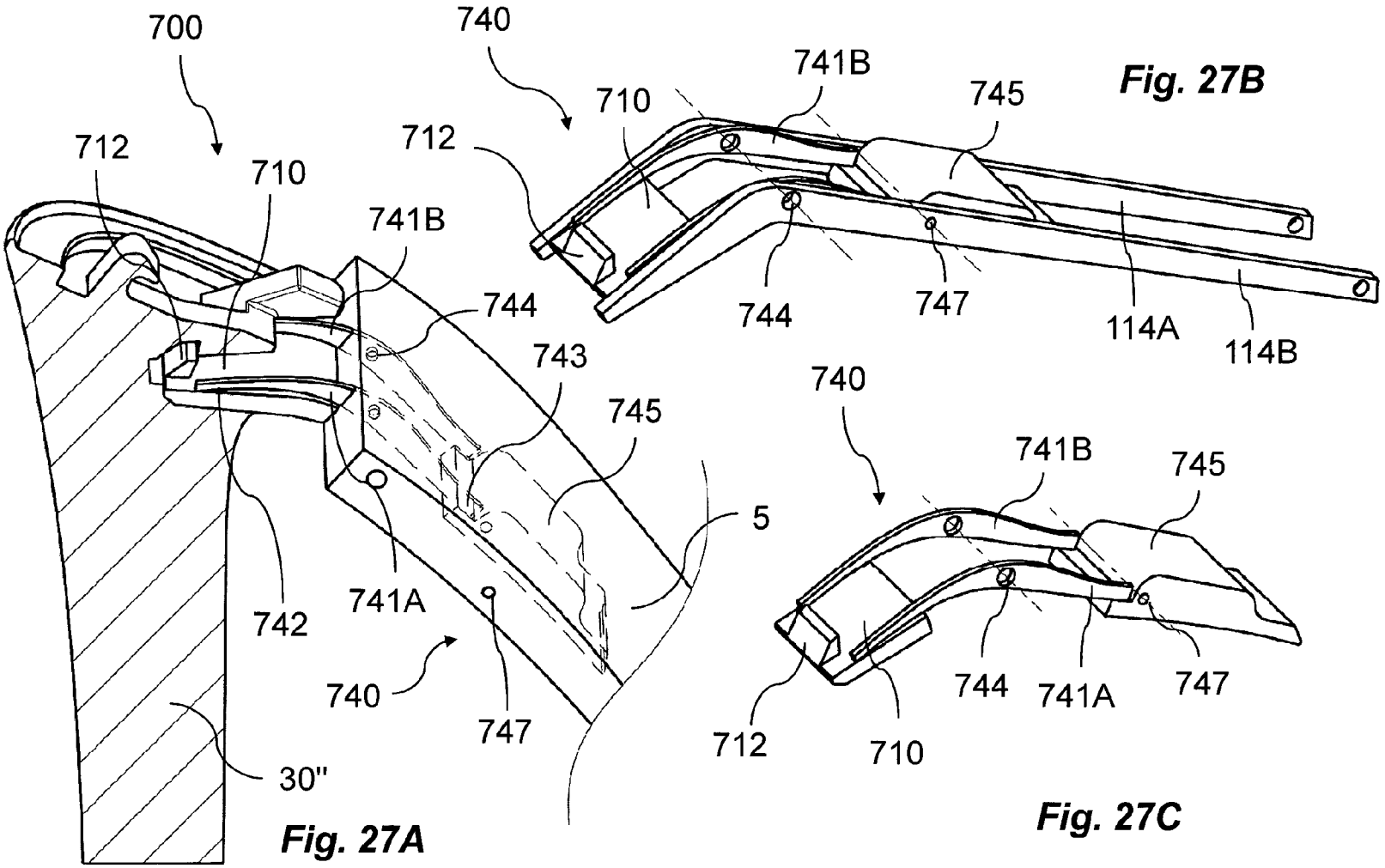
Figures 28A, 28B, 28C, 28D, 28E:
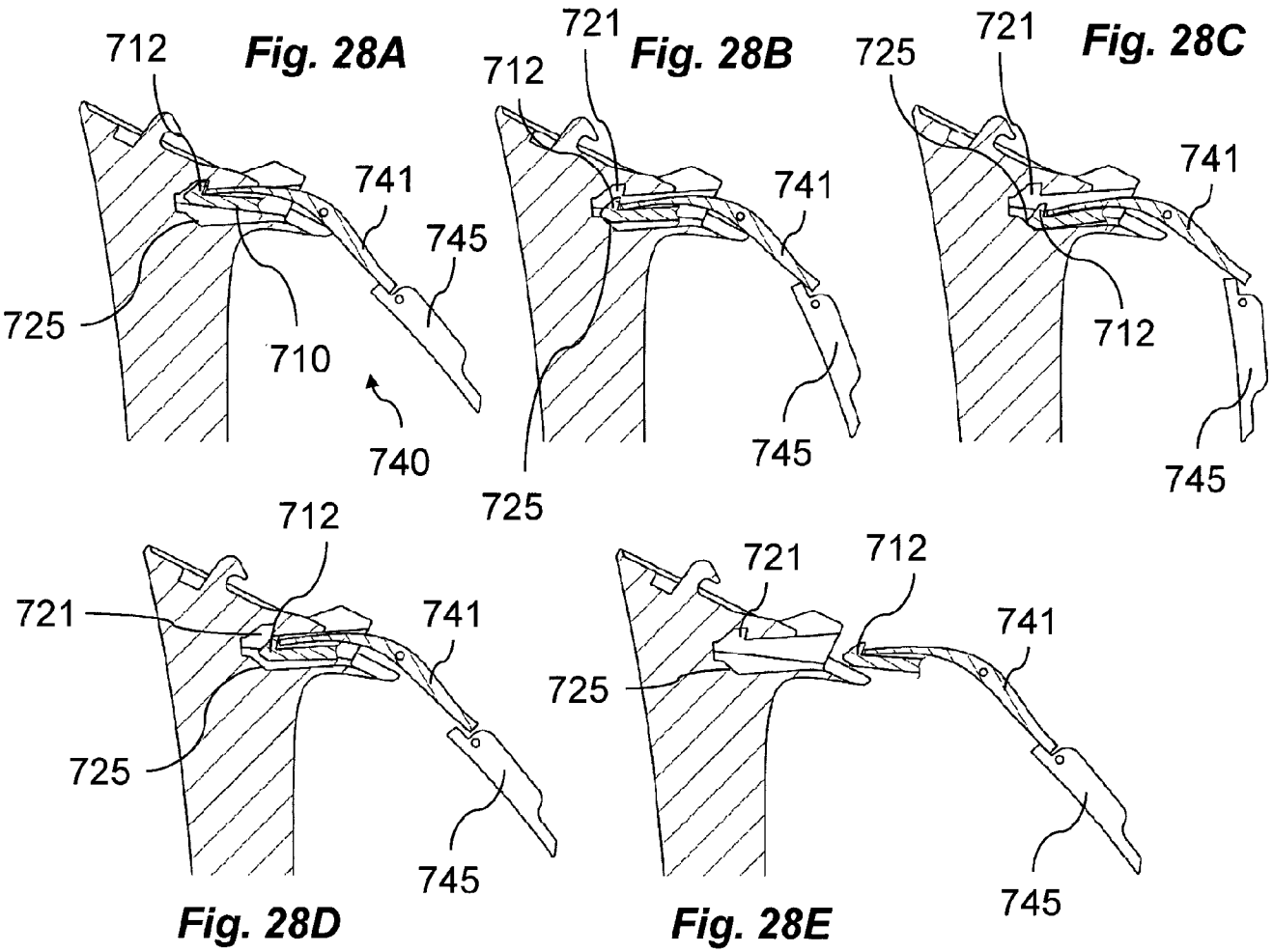

FIGS. 1A and 1B schematically show the change in sole shape when using heels of different heights, FIG. 1C schematically shows a comparison of the sole shape when using heels of different heights, FIGS. 2A and 2B schematically show a sole component with a fixture according to a first embodiment of the invention, FIGS. 2C and 2D schematically show a first type of changeable heels for the fixture according to FIGS. 2A and 2B, FIGS. 3A and 3B schematically show a sole component with a fixture according to a further embodiment of the invention, FIGS. 3C and 3D schematically show a further type of changeable heel for the fixture according to FIGS. 3A and 3B, FIGS. 4A to 4C schematically show a sole component with a first mechanism for adjusting a first transition region between the rear and the middle sole portion according to a first embodiment of the invention, FIG. 5A schematically shows a flat heel which can be used in conjunction with the first mechanism according to FIGS. 4A to 4C, FIG. 5B schematically shows a high heel which can be used in conjunction with the first mechanism according to FIGS. 4A to 4C, FIGS. 5C and 5D schematically show the functional principle of the first mechanism according to FIGS. 4A to 4C when attaching a flat heel and a high heel, FIGS. 5E to 5G schematically show a modification of the heels according to FIGS. 5A and 5B, FIGS. 5H and 5J schematically show a modification of the first mechanism according to FIGS. 4A to 4C, FIGS. 6A and 6B schematically show a sole component with a first mechanism for adjusting the first transition region between the rear and the middle sole portion according to a further embodiment of the invention, FIGS. 7A and 7B schematically show a high heel (in a perspective view and a top view) which can be used in conjunction with the first mechanism according to FIGS. 6A and 6B, FIG. 7C shows the cross-section C-C of FIG. 7B, FIG. 7D shows the cross-section D-D of FIG. 7B, FIGS. 7E and 7F schematically show a flat heel (in a perspective view and a top view) which can be used in conjunction with the first mechanism according to FIGS. 6A and 6B, FIG. 7G shows the cross-section A-A of FIG. 7F, FIG. 7H shows the cross-section B-B of FIG. 7F, FIGS. 8A and 8B schematically show a detail of the sole component with the first mechanism according to FIGS. 6A and 6B when mounting a high heel and a flat heel according to FIGS. 7A and 7E, FIGS. 9A to 10B show a locking system according to a first embodiment, FIGS. 11A and 11B show a heel according to FIGS. 5E to 5G with a locking system for locking the heel in accordance with a second embodiment, FIGS. 12A to 12C show the locking system of FIGS. 11A and 11B on a further heel modification, FIGS. 13A to 13C show a sole component for the locking system of FIGS. 11A to 12C, FIGS. 14A to 14C schematically show the functional principle of the locking system of FIGS. 11A to 13C, FIG. 15 schematically shows a mechanism for releasing the locking system of FIGS. 11A to 14C, FIGS. 16A and 16B schematically show a sole component with a second mechanism for adjusting the second transition region between the middle and front sole portion according to a first embodiment of the invention, FIG. 17A schematically shows a high heel according to the present invention, which can be used in conjunction with the second mechanism of FIGS. 16A and 16B, FIG. 17B schematically shows a flat heel according to the present invention, which can be used in conjunction with the second mechanism of FIGS. 16A and 16B, FIGS. 18A and 18B schematically show a sole component with a second mechanism for adjusting the second transition region between the middle and front sole portion according to a further embodiment of the invention, FIGS. 19A to 19C show a schematic rear view of the sole component of FIGS. 18A and 18B with various angular positions of the second mechanism, FIGS. 20A and 20B schematically show the mounting of a second supporting element of the mechanism of FIGS. 18A and 18B according to embodiments of the invention, FIG. 21 schematically shows the structure of the second supporting element of the mechanism of FIGS. 18A and 18B according to embodiments of the invention, FIGS. 22A to 22C schematically show heels according to the present invention, which can be used in conjunction with the second mechanism of FIGS. 18A and 18B, FIG. 22D shows a schematic cross-sectional view of the heel according to FIG. 22A, FIGS. 23A to 23C schematically show heels according to the present invention, which can be used in conjunction with the second mechanism of FIGS. 18A and 18B according to a further embodiment of the invention, FIGS. 23D to 23F shows schematic cross-sectional views of the heel according to FIG. 23A, FIGS. 24A and 24B schematically show a sole component with a second mechanism according to a further embodiment of the invention, FIGS. 25A and 25B schematically show a sole component with a donning aid according to the present invention for attaching a heel to the sole component in a temporary manner, FIGS. 26A to 26C show a schematic sequence illustrating the preliminary attachment of a heel to the sole component by means of the donning aid of FIGS. 25A and 25B, FIGS. 27A to 27C schematically show a mechanism according to the present invention for releasing the donning aid, FIGS. 28A to 28E show a schematic sequence illustrating the release of the donning aid by means of the mechanism of FIGS. 27A to 27C.

As shown in FIGS. 1A and 1B, the sole curvature should be adjusted in a first a region (A) which lies approximately between the foot's heel portion and the arch portion, and in a second region which lies approximately between the arch portion and the forefoot portion of the sole when using heels with different heights (flat heel in FIG. 1A; "high" heel illustrated by a block in FIG. 1B).

FIG. 1C schematically shows sole components 3 comprising a rear sole portion 4 (foot's heel portion), a middle sole portion 5 (midfoot portion) and a front sole portion 6 (forefoot portion). The overlay of a first sole shape 11 corresponding to the sole shape of a flat shoe with a second sole shape 12 corresponding to the sole shape of a high heel shows that the sole curvature in the first region A and the second region B should be greater when using a higher heel (sole shape 12). The angles $\alpha<180°$ between the rear sole portion 4 and the middle sole portion 5 and $\beta<180°$ between the middle sole portion 5 and the front sole portion 6 are preferably smaller for said sole shape 12.

The inventive shoes and sole components may be used with multiple different systems for heel fixation. FIGS. 2A-2D and 3A-3D show systems which have proved to be particularly advantageous in the context of the present invention.

FIGS. 2A and 2B show a sole component with a fixture 20 for fixing changeable heels. The fixture 20 is provided at the rear sole portion 4 and preferably comprises one or more projections 21 having a profile 22. The projections 21 and/or the profile 22 preferably extend parallel to the plane E of the rear sole portion and in the longitudinal direction of the sole.

FIGS. 2C and 2D show a first type of changeable heels. On its upper side 35 the heel 30 preferably comprises a groove 32 with a contour that is configured in accordance with the profile 22 of the rear sole portion 4. Hence, the profile 22 and the groove 32 are configured such that they engage with each other and prevent the heel from falling off when the shoe is lifted. To this end, the profile is preferably broader than a part of the projection provided thereover (undercut). The profile 22 and/or the contour of the groove may have, e.g., a dovetail shape, T-shape or L-shape. In FIGS. 2A and 2B the projection 21 is depicted with an L-profile for illustration purposes only.

The groove 32 extends parallel to the upper side 35 an in the longitudinal direction of the sole. The groove is open towards the front in the sole's longitudinal direction so that the heel 30 can be slid onto the rear sole portion 4 in the direction of arrow D (forwards in the longitudinal direction of the sole). The heel and/or shoe can further comprise a locking system (not shown) that locks the heel when it reaches a predefined position. The locking system preferably counteracts a movement of the fixed heel in a rearward direction. Different locking systems are further specified below.

FIGS. 3A and 3B show a sole component with a fixture 20' according to a further embodiment of the invention. The fixture 20' is provided at the rear sole portion 4 and comprises a projection 21' having a profile 22' which extends preferably along the lower end of the projection 21'.

The profile 22' extends in an inclined manner with respect to the plane E of the rear sole portion 4 and preferably away from the plane E in a downward and forward direction. When looking at the rear sole portion from the side (see FIG. 3B), the profile 22' preferably extends along a first imaginary line or straight line G which forms an angle of $70°>\theta>20°$ with the plane of the rear sole portion E. The angle preferably lies in a plane which is perpendicular to the plane E of the rear sole portion 4 and extends in the longitudinal direction of the sole. As is further illustrated in FIGS. 3A and 3B, the protrusion 21' may have a substantially trapezoidal shape.

FIGS. 3C and 3D show a changeable heel 30' for the fixture 20' of FIGS. 3A and 3B. The heels comprise a recess 31' extending from a elongate opening 34' at the upper side 35' of the heel 30' into the heel.

The recess 31' preferably comprises a substantially consistent contour 32' along a second imaginary line or straight line H, which is configured in accordance with the profile 22' of the fixture 20'. The contour 32' extends along the second imaginary straight line H which preferably extends in angle of $20°<\eta<70°$ with respect to the heel's longitudinal axis F, when the heel 30' is viewed from the side (see FIG. 3D). As can be taken from FIG. 3D, the straight line H preferably lies in a plane which is parallel to the heel's longitudinal axis and the sole's longitudinal direction. The straight lines G and H preferably coincide when the heel 30' is fixed to the rear sole portion 4. The heel 30' can thus be slid onto the fixture 20' rearwards in the sole's longitudinal direction along the straight line G and/or H (direction K).

As is further shown in FIGS. 3C and 3D, the contour 32' is preferably configured such that the recess 31' provides a plane which interacts with the profile 22' in order to prevent the heel from falling off (e.g. when the shoe is lifted). Therefore, the plane preferably faces rearwards in the sole's longitudinal direction and downwards in the heel's longitudinal direction, wherein the plane's normal vector which points into the clearance of the recess, is directed rearwards in the sole's longitudinal direction and downwards in the heel's longitudinal direction. In a cross-section of the recess, which extends parallel to the heel's longitudinal axis F and transversely to the sole's longitudinal direction, the contour 32' is preferably broader than a region of the recess 31' located thereover.

The recess 31' is preferably located inside the heel 30' and is solely open towards the upper side 35'. When the heel 30' is slid onto the rear sole portion 4, the recess 31' preferably provides a stop 33' at its front end portion (e.g. at a front wall), to which the projection of the fixture 21' may abut when the heel is fully slid onto the rear sole portion. When the rear sole portion 4 is subsequently exposed to load downwards in the heel's longitudinal direction F (e.g. by the wearer's weight), a self-reinforcing positive lock occurs.

The rear sole portion 4 and/or the heel can further comprise a locking which may, for instance, be mechanical or magnetical. By way of example, the rear sole portion 4 may comprise a projection which is provided and/or configured such that it engages with a recess in the upper side 35' of the heel 30' or abuts on a front side of the heel when the heel is fully attached. Alternatively or additionally, a projection may also be provided or configured at the upper side 35' such that it engages with a recess that is provided at the bottom side of the rear sole portion 4.

FIGS. 4A to 4C schematically show a first embodiment of a first mechanism 100 for adjusting the sole curvature in the first transition region A of a sole component 3.

The mechanism 100 comprises a supporting element 114. Said supporting element 114 is more rigid than a first transition region A, wherein the flexibility of the sole component may, for example, result from the materials used or from the use of a joint in the first transition region. The sole component may comprise a first hinge in the first transition region A and a second hinge in the second transition region B. The first hinge may extend along the first transition region A and the second joint along the second transition region B.

The supporting element 114 extends along the rear sole portion 4 and the middle sole portion 5. Along the middle sole portion 5, the supporting element 114 is fixedly connected to the sole component 3 at least along segments thereof. The supporting element 114 may comprise a substantially flat, elongate structure in this region.

A rear part 115 of the supporting element 114 extends along the rear sole portion 4, but is not connected and/or fixed to the rear sole portion 4. The distance between the rear sole portion 4 and the rear part 115, in particular the angle therebetween, may thus be varied, as shown in FIGS. 4A to 4C. This results in the adjustment of angle δ between the middle and the rear sole portion and thus in the adjustment of the sole curvature in the first transition region A. As can be seen in FIG. 4A, the curvature in the first transition region A is smaller when the angle between the rear part 115 and rear sole portion 4 increases. When the angle is smaller, the sole curvature increases (FIG. 4B). Hence, the sole curvature in the first transition region A is smaller when the rear part 115 of the first supporting element 114 is further spaced away from the rear sole portion 4. If, however, the rear part 115 is pushed closer to the sole component 4 the curvature will increase. Hence, the curvature in the first transition region A can be adapted according to the heel height, wherein a continuous adjustment is possible. Depending on the embodiment of the invention the rear part 115 of the supporting element 114 may be spaced away from or abut the rear sole portion 4 when the first mechanism is in a neutral position.

Depending on the embodiment, the inventive heels may be configured such that the supporting element 114 is pushed towards the rear sole portion or away from it when mounting the heel. According to an embodiment shown from the side and in a cross-section along the sole's longitudinal direction in FIGS. 5A and 5B, the heel 30" comprises a structure 41" in order to push the supporting element 114 away from the bottom side of the rear sole portion. The structure 41" is preferably formed by an opening 43" which extends from the upper side 35" rearwards in the sole's longitudinal direction and downward in the heel's longitudinal direction F into the heel 30" and is open towards the front in the sole's longitudinal direction. The opening 43" receives the rear part 115 of the supporting element 114 when the heel 30" is slid onto the rear sole portion 4. Thus, the opening 43" preferably forms a wedge-shaped structure 41", wherein the tapering end of the wedge-shaped structure is directed towards the front in the sole's longitudinal direction. Depending on the heel's height, the opening 43" may be configured steeper (FIG. 5A) or less steep (FIG. 5B) and consequently form a greater or smaller angle δ when the heel 30" is mounted to the sole component 3 (cf. FIGS. 4A to 4C).

Furthermore, the heel 30" may be configured for use with one of the above-described fixation systems 20, 20' and in particular for use with the fixation system 20. Thus, the heel 30" may, for example, comprise one or more of the above-described grooves 32.

According to a modification, the heels of FIGS. 5A and 5B (i.e. high as well as flat or medium heels) may be configured such that the opening 43" tapers or becomes increasingly narrow along the inserting direction of the rear part 115. Such a modification of the heel 30" is for instance shown in FIG. 5E (perspective view), 5F (first sectional plane parallel to the heel's longitudinal direction F and the sole's longitudinal direction L), and FIG. 5G (second sectional plane transverse to the first sectional plane and parallel to the inserting direction E). As shown, in particular, in FIG. 5F, the heel 30" may comprise an opening 43" which, in a first sectional plane that is parallel to the heel's longitudinal direction F, tapers from the entrance opening 44" through which the rear part 115 of the supporting element (not shown) may be inserted into the opening 43" at an angle κ in the direction of insertion E.

Likewise, the opening 43" may be configured such that it tapers at an angle ϵ from the entrance opening 44" in the inserting direction E in a second sectional plane that is transverse to the first sectional plane and parallel to the inserting direction E (see FIG. 5G). The angle κ and/or ϵ may each range between 2° and 70°, preferably between 5° and 40°, more preferably between 5° and 15° or amount to about 10°. For ensuring a fixing of the heel 30" that is free from play in several directions, the opening 43" may have a tapered configuration in several sectional planes, e.g., in the cross-section along the heel's longitudinal direction F (FIG. 5F) and in the cross-section along the inserting direction E (see FIG. 5G). As can be further taken from FIGS. 5E to 5G, the opening 43" for the rear part 115 of the supporting element 114, which forms the wedge-shaped structure 41" with the upper side 35" of the heel 30" (see FIG. 5F), may at least partially be arranged in a projecting structure that projects from the upper side 35". The projecting structure 45" may comprise an upper inclination 48A" which may form an angle ω with the upper side 35" ranging from 20° to 70°, 30° to 60° or 40° to 50°. The projecting structure 45" may further comprise a chamfer-like or inclined end stop surface 48B" which may extend substantially parallel (e.g., with a maximum deviation of ±1°, ±3° or ±5°) to the upper side 35". The upper inclination 48A" and/or the end stop surface 48B" may be configured such that they come into contact with the sole component when the heel 30" is fixed to the sole component. A projecting structure 45" according to FIGS. 5E and 5F may be used in combination with a tapering opening 43", but also independently thereof.

FIGS. 5H and 5J show a modification of the first supporting element 114 on a schematically illustrated sole component 3. This modification can be used with different heels according to the present invention, but proves to be particularly advantageous when combined with the heels types of FIGS. 5E to 5G and 11A to 12C (see below).

In the modification of the first supporting element 114 according to FIGS. 5H and 5J the supporting element 114 is formed by two rails 114A and 114B, wherein only one or more than two rails may also be used. The rails 114A, 114B extend along the middle sole portion 5, wherein the sole is not shown in the middle sole portions for better illustration of the rails 114A and 114B. For example, the rails 114A and 114B may be made of flat rolled steel.

The rails 114A and 114B provide a first hinge 601 via which the rear sole portion 4 is movably attached to the rails 114A, 114B, and a second joint 602 via which the front sole portion 6 is movably attached to the rails 114A, 114B. For this purpose, the rails 114A and 114B may each comprise a first hole for receiving an axis of the first hinge 601 and a second hole for receiving an axis of the second hinge 602.

In the shown embodiment the rails 114A and 114B are arranged in a substantially parallel or slightly tapering configuration. For use with the heels of FIGS. 5E to 5G and 11A to 12C, the rear parts 115A and 115B of the rails 114A and 114B may taper in the sole's longitudinal direction towards the rear (e.g., at the angle $\epsilon$). The supporting element 114, which is formed by both rails 114A and 114*b* together, thus becomes narrower. As can be further taken from FIG. 5H, the rear parts 115A and 115B (in FIG. 5H only the rear part 115A is visible, but the rear part 115B may be configured as a mirror image thereof) of each supporting element 114A, 114B may themselves become narrower (e.g., at the angle $\kappa$). In this way, together with the tapering opening 43", an essentially play-free fixation of different heels to the sole component may be achieved despite potential manufacturing tolerances.

As shown in FIGS. 6A and 6B, the first supporting element 114' comprises a projection 117' in the region of the supporting element's rear part 115' according to a second embodiment of the invention. In the shown example, the projection 117' extends away from the supporting element 114' in a downward direction and provides a surface 119' which substantially extends in the transverse direction of the sole component 3 and is inclined with respect to the plane of the rear sole portion 4. At that, the surface 119' preferably forms an angle of 70°>θ20° with the plane of the rear sole portion E, wherein said angle is preferably arranged in a plane which is perpendicular to the plane E of the rear sole portion 4 and extends in the longitudinal direction of the sole. The normal vector M of the surface 119', which points away from the projection 117', preferably points forwards in the sole's longitudinal direction and upwards in the heel's longitudinal direction.

According to embodiments of the invention, the projection 117' corresponds to the projection 21' of the fixture 20' described above with respect to FIGS. 3A and 3B. The surface 119' may be formed by a profile 122' which corresponds to the profile 22' of the fixture 20' and has an identical shape. Hence, the fixture 20' may be provided on the supporting element 114', wherein the projection 117' may be used for adjusting the first mechanism 100 and, at the same time, for fixing the heel to the shoe.

Alternatively, the projection 117' may be provided in combination with an additional fixture, such as the fixture 20' of FIGS. 3A and 3B. The additional fixture may, for instance, be provided on the rear sole portion 4.

The middle sole portion 4 may comprise a recess 8 for receiving the rear part of the supporting element 114'.

In FIGS. 6A and 6B, the supporting element 114' is shown to be integral with the middle sole portion 5. However, different elements and materials may be used for the supporting element 114' and the middle sole portion 5 (see FIGS. 4A to 4C) also in this embodiment of the invention.

FIGS. 7A to 7H show a further type of changeable heels according to embodiments of the invention. These heels are particularly advantageous when used in conjunction with the supporting element 114' according to FIGS. 6A and 6B.

The heels 30'" of FIGS. 7A to 7H comprise a recess 31'" for the projection 117' of the supporting element 114'. Said recess 31'" may comprise the same features as recess 31' described above with respect to the heels 30'.

In a sectional view along the sole's longitudinal direction (see FIG. 7C) the heels 30'" comprise a structure 46'" in order to push away the supporting element 114' from the bottom side of the rear sole portion. The structure 46'" is preferably formed by an opening 47'" extending from the upper side 35'" forwards in the sole's longitudinal direction and downwards in the heel's longitudinal direction F into the heel 30'". The opening 47'" is preferably provided such that it receives the profile 122' of the supporting element 114' when the heel 30'" is slid onto the rear sole portion.

The structure 46'" is preferably wedge-shaped, wherein the tapering end of the wedge-shaped structure is directed rearwards in the sole's longitudinal direction. Depending on the height of the heel, the opening 47'" may be configured steeper (7A to 7D) or less steep (FIGS. 7E to 7H).

In other words, in a sectional view along the sole's longitudinal direction, the heels 30'" comprise at least one surface 49'" formed by the opening 47'". The surface 49'" extends in an inclined direction with respect to the heel's longitudinal direction F, wherein the normal vector O of the surface 49'", which is directed into the clearance of the opening 47'", points rearwards in the sole's longitudinal direction and downwards in the heel's longitudinal direction.

As can be taken from a comparison of the cross-sections shown in FIGS. 7C and 7D as well as 7G and 7H, the recess 31'" has a contour that is broader in a lower region than in an upper region.

Depending on their height, the heels 30'" may further comprise a recess 37'" for receiving the pressed down rear part of the supporting element 114' (see FIGS. 7E and 7G).

Apart from one or more recesses 31'" for the projection 117' of the supporting element 114', the heels 30'" may also comprise one or more recesses 31'" for an additional fixture (e.g., a fixture 20') which, for example, may be provided directly at the rear sole portion.

FIGS. 8A and 8B show a sole component 3 with a high and a flat heel 30'", respectively. Depending on the design of the opening 47'" and/or the shape of the wedge-shaped structure 46'", the rear part 115' of the supporting element will be spaced away from the rear sole portion 4 to a greater or lesser extent. As depicted in FIG. 8B, the supporting element may be received in the recess 37'" of the heel.

Regardless of the embodiment of the first mechanism, the claimed sole components and/or heels may be provided with a locking system for locking different kinds of heels to the sole component. For this purpose, a projection is preferably provided on the heel or the sole component, wherein a recess or cutout into which said projection engages is provided on the other one of these two elements (i.e. on the sole component or heel).

A first embodiment of a locking system 500 according to the present invention is schematically shown in FIGS. 5C and 5D (in conjunction with a first mechanism according to the first embodiment) and in FIGS. 9A, 9B, 10A and 10B (in conjunction with a first mechanism according to the second embodiment). As can be seen in FIGS. 5C and 5D, the locking system 500 is provided by a recess 501 at the rear sole portion 4 which is provided such that a projection 502 on the heel engages with the recess 501 when the heel is fully slid onto the sole component. FIGS. 9A, 9B, 10A and 10B show that the arrangement of recess 501 and projection 502 may also be the other way around so that the recess 501 is provided on the heel while the projection 502 is provided on the sole component. In both cases the locking mechanism of the locking system 500 may be released by lifting the rear sole portion 4. This embodiment is thus particularly advantageous when the heel is pressed onto the rear sole portion by the fixture and/or the first supporting element.

FIGS. 11A, 11B and 12A to 12C show heels with a locking system 500' according to a second embodiment. At its upper side 35", the heel 30" comprises a recess in which a locking element is arranged in the form of a protruding hook 502'. The hook 502' provides an undercut forming a recess 506' which is open towards the front in the sole's longitudinal direction L. The hook 502' comprises an inclined surface 504' at its rear side opposite the recess 506', said inclined surface 504' being arranged at an angle γ with respect to the bottom of the recess provided on the upper side 35". The angle γ may differ from angle ω between the inclined surface 48A'" of the projecting structure 45" and the upper side. Angle γ may range between approximately 90° to 150°, approximately 91° to 120° or approximately 95° to 110°.

FIGS. 13A to 13C show a rear sole part 4 comprising a recess 501' for receiving the hook 502' of the heels 30" according to FIGS. 11A to 12C. The recess 501' comprises a deflectable locking element 521' (e.g., in the form of a small hollow tube) which is moved in the sole's longitudinal direction towards the front against the force of the springs 523' when the hook 502' is inserted, and engages with the recess 506' of the hook 502' when the heel 30" is fully slid onto the sole component. In this way, the heel 30" is locked on the rear sole part 4.

As can be further taken from FIGS. 13A to 13C, a first abutment surface 511', a second abutment surface 512' and a third abutment surface 513' may be provided for the heel at the rear sole portion 4. While the first abutment surface may be configured to abut the bottom of the recess on the upper side 35" of the heel 30" when the heel 30" is mounted to the sole component, the second abutment surface 512' is preferably arranged at an angel λ with respect to the first abutment surface 511' and thus provides an abutment surface for the upper inclination 48A" of the heel 30". Angle λ may therefore have an angular measure of 180° minus the angle ω between the upper side 35" and the upper inclination 48A". The third abutment surface 513' may provide an abutment surface for the end stop 48B", wherein rubber puffers may be arranged on said third abut surface 513' or other abutment surfaces to compensate for manufacturing tolerances between different heels. The third abutment surface 513' may be essentially parallel to the first abutment surface.

The recess 501' may further comprise a wall 507' being arranged at an angle π with respect to the first abutment surface 511' and providing an abutment surface for the inclined surface 504' of the hook 502'. Angle π may thus have an angular measure of 180° minus angle γ between the upper side 35" and the inclined surface 504' of the hook 502'. Due to the abutment of heel 30" on the second abutment surface 512' via the upper inclination 48A" and the abutment on the wall 507' via the inclined surface 504' of the hook 502', a substantially play-free connection may be achieved between the heel 30" and the rear sole portion 4. For this purpose, angles λ and π preferably have different measures.

In addition, an abutment surface 514' may be provided at the rear sole part 4. Said abutment surface 514' may extend substantially parallel to the first abutment surface 511', but is preferably not arranged in the same plane. The fourth abutment surface 514' may extend in U-shape around the first abutment surface 511', the second abutment surface 512' and/or the third abutment surface 513'.

As illustrated in the schematic sequence of FIGS. 14A to 14C, the rear part 115 of the first supporting element is initially inserted into the opening 43" of the heel 30" for locking the heel 30" to the rear sole portion 4 (FIG. 14A). The rear sole portion 4 is then pivoted in order to insert the hook 502' into the recess 501', wherein said hook 502' deflects the locking element 521' against the force of the springs 523' (FIG. 14B). When the heel 30" reaches its final position on the sole component (FIG. 14C) the locking element 521' snaps into the recess 506', whereby the heel 30" is locked.

FIG. 15 shows a mechanism 530' for releasing a heel (not shown) from the sole component (only partially depicted) according to the present invention. For better illustration, the mechanism is shown in conjunction with the locking system of FIGS. 11A to 14C, yet the mechanism is not limited thereto.

The locking element 521' may be moved against the force of the springs 523' via the mechanism 530' until the locking element 521' is moved out of the recess 506' (see FIGS. 14A to 14C). The engagement between the hook 502' and the locking element 521' is thereby released so that the heel can be taken off the sole component.

The mechanism 530' comprises an actuation element 531' which can be grasped by the user and thus provides an interface for the user. In the exemplary embodiment of FIG. 15, the actuation element 531' is configured as a lever. Said lever is rotatably attached to the sole component, for example, to the first supporting element 114. For this purpose, the lever may, for example, be arranged between two rails 114A and 114B which form the supporting element 114. Yet, the mechanism 530' is not limited thereto.

The actuation element 531' is mechanically coupled to the locking element 521'. In the exemplary embodiment of FIG. 15, the coupling is achieved by means of a string or wire 535' (e.g., a synthetic string, such as a nylon string) which extends from the actuation element 531' to the locking element 521' and back. A tensile force is exerted by actuation of the actuation element 531', which is transferred onto the locking element 521' via the string and moves it.

With reference again to FIGS. 12A to 12C, it can be seen that the projecting structure 45" of the heel 30" essentially forms the shape of a T in a top view of the upper side 35". A ridge 48C" projecting from the base of the recess on the upper side 35" of the heel 30" extends from the inclined surface 48A" to the hook 502'. A section 48D" between the left and right tip of the T-shaped structure may be recessed, wherein one horn that may provide the upper inclination 48A" and the end stop surface 48B" remains at each right and left tip. The T-shaped structure may be arranged completely within the recess on the upper side 35", as also shown in the exemplary embodiment of FIGS. 12A to 12C.

FIGS. 16A and 16B show a first embodiment of a second mechanism 300 for adjusting the second transition region B between the middle sole portion 5 and the front sole portion 6.

The mechanism 300 comprises a slidable supporting element 302 which may be slid along the sole's longitudinal direction from a first position (FIG. 16A), which causes a first sole curvature in the transition region B to a second position (FIG. 16B) which causes a second sole curvature in the transition region B. At that, the first sole curvature differs from the second sole curvature.

In the transition region B the sole component 3 is preferably more flexible than the supporting element 302. The transition region B may, for example, comprise a joint (see, e.g., FIGS. 5H and 5J) and/or have a more flexible design than the rear, middle and/or front sole portions 4, 5, 6.

In the first position (FIG. 16A) the supporting element 302 does preferably not project into the transition region 13 and/or into the front sole portion 6. The sole curvature in the transition region B thus corresponds to the manufacturing curvature of the sole component 3.

When the supporting element is slid into the second position (FIG. 16B), it projects into the second transition region B and into the front sole portion 6. As the supporting element is guided along the transition region B and/or in the front sole portion 6 (e.g., in an opening in the front sole portion 6 which is not shown for reasons of clarity), the transition region B and/or the front sole portion 6 in this case follows the shape of the supporting element 302. The movement of the supporting element 302 thus leads to a change in sole curvature in the transition region B.

As further shown in FIGS. 16A and 16B, the supporting element 302 is preferably also guided in a guide 306 in the region of the middle sole portion. In the shown example said guide is configured as a rail. The guide 306 holds the supporting element 302 to the middle sole portion 5 when the supporting element 302 is slid forwards and extends into the transition region B. In this way, buckling or bending of the supporting element along the middle sole portion is prevented.

According to the depicted embodiment of the invention, the second mechanism further comprises a Bowden mechanism 310 with a Bowden cable 312 and a Bowden cable sleeve 314. The Bowden cable 312 extends from the rear sole portion 4 to the supporting element 302 and is fixedly connected therewith. Hence, movement of the Bowden cable results in movement of the supporting element 302. The supporting element 302 may thus be moved between the first and second position through actuation of the transmission link (Bowden cable).

Preferably, the transmission link is actuated during attachment and/or removal of the heel. For this purpose, an actuator 316 is provided at the rear end of the Bowden cable 312, which interacts with changeable heels to allow adjustment of the moving device during attachment and/or removal of the heel. The actuator 316 is fixedly connected to the Bowden cable 312.

The Bowden cable sleeve 314 may be fixed to the sole component 3 and/or to the first supporting element 114, wherein the Bowden mechanism may extend through the cutout of the first supporting element (see FIGS. 16A and 16B).

The second mechanism of FIGS. 16A and 16B may be used with different first supporting elements 114, 114'.

As shown in FIGS. 17A and 17B, the claimed heels 330, 330' may comprise a recess 360, 360' on their upper side 335, 335', said recess being provided and/or configured such that it interacts or avoids interaction with an element of the second mechanism according to the embodiment of FIGS. 16A and 16B when the heel is being attached to the sole component. The heel 330 of FIG. 17A comprises, for example, an elongate recess 360 designed such that no movement of the actuator 316 occurs when the heel is pushed on or pulled off the rear sole portion 4. Therefore, the recess is designed such that it does not contact the actuator 316. The longer dimension of the recess 360 preferably extends in the sole's longitudinal direction, wherein the recess may extend approximately 20 to 30 mm in said direction (length of the recess).

On the other hand, the recess 360' of the heel 330' shown in FIG. 17B is shorter (e.g., 5 mm at most or 10 mm at most) and has approximately the shape of the actuator 316. When the heel 306' is attached, the actuator 316 is received in the recess 360' and slid with the heel 306' whereby the mechanism 300 is adjusted. In the exemplary embodiment of FIG. 17B the recess 360' is configured such that the actuator is moved forward when the heel 330' is slid onto the rear sole portion 4 from the rear to the front. Hence, the shape of the sole component changes from that shown in FIG. 16A into that of FIG. 16B.

FIGS. 18A to 19C show a further second mechanism 400 for adjusting the second transition region B according to a further embodiment of the invention from the side and from the rear in different positions.

The mechanism 400 comprises a rotatable supporting element 402 which is configured as an elongate shaft in the illustrated example. The supporting element 402 extends from the middle sole portion 5 into the transition region B and preferably also into the front sole portion 6 and/or the rear sole portion 4.

In the front end portion the second supporting element 402 comprises a curved portion 403 that has a predetermined, defined curvature and extends at least in the transition region B. A front end portion 404 of the supporting element 402 may follow the curved portion 403. Preferably, said front end portion is received in a recess 407 in the region of the front sole portion 6, which allows for a movement of the end portion 404 in the plane of the front sole portion 6.

The supporting element 402 is rotatably mounted in the region of the middle sole portion 5 and/or the rear sole portion 4. During rotation of the supporting element 402 from a first angular position (FIGS. 18A and 19A) to a second angular position (FIGS. 18B, 19B and 19C), the front end portion 404 turns in the recess 407. Hence, the projection of the curved portion 403 onto a projection plane which extends along the rotation axis of the supporting element 402 and is perpendicular to the plane of the front sole portion 6, alters its curvature and preferably increases when the supporting element 402 is rotated from the first into the second position. In such case, the second sole curvature is larger than the first one.

The curved portion 403 of the supporting element 402 preferably spans an imaginary plane of curvature in which also the radius of curvature is located. Said plane of curvature may be perpendicular to the plane of the front sole portion 6 when the supporting element 402 is rotated into the second angular position (see FIG. 19C).

The rotation of the supporting element 402 further causes the front end portion 404 to project into the recess 401 to a varying extent.

The supporting element 402 may further comprise a crank 416 by means of which the supporting element is rotated. The crank 416 is preferably provided in the region of the rear sole portion 4.

FIGS. 19A to 19 C show a rear view of the sole component 3, wherein the supporting element 402 is depicted at different angular positions resulting in different sole curvatures in the transition region B because the curved portion 402 is turned.

By way of example, FIGS. 20A and 20B show various options for rotatable mounting of the supporting element 402. The supporting element 402 may, for example, be mounted in a recess of the sole component (FIG. 20A) or in a mounting arrangement, for instance, the sleeves (e.g., brass tubes) of FIG. 20B, which preferably are fixedly connected to the sole component 3 (e.g., by gluing, welding, soldering etc.). When combined with the crank 416 or other projections of the supporting element 402, the mounting arrangement may also prevent an axial movement of the second supporting element in the sole's longitudinal direction.

As is further shown in FIG. 21, the crank 416 and/or the curved portion 403 may be formed by sliding a sleeve (e.g., a brass tube) over the rear end portion of the second supporting element 402 and by bending the sleeve together with the supporting element.

FIGS. 22A to 22D show heels with different heights 330, 330', 330" having a recess 360, 360', 360" which interacts with the crank 416 of the supporting element 402 of the second mechanism according to FIGS. 18A-19C. In particular, the shape of recess 360, 360', 360" is configured such that the recess interacts with the crank 416 when the heel 330, 330', 330" is fixed to sole component 3.

According to an embodiment, the recess 360, 360" comprises a surface 361, 361" for adjusting the crank 416, said surface 361, 361" being inclined with respect to the heel's longitudinal direction F in a cross-section of the heel that extends parallel to the heel's longitudinal axis and is traverse to the sole's longitudinal direction (FIG. 22D). The surface 361, 361" gets in contact with the crank 416 when the heel is slid onto the sole component so that the crank is rotated according to the inclination of the surface 361, 361". In the shown embodiment the angle formed between the inclined surface 361, 361" and the upper side 335, 335" of the heel 330, 330" preferably becomes flatter in the sole's longitudinal direction so that the crank 416 is gradually rotated until a desired final position is reached.

According to a further embodiment shown in FIGS. 23A-23F, the recess or groove 360, 360', 360" may wind along the sole's or groove's longitudinal direction. Depending on the heel's height, the groove may be wound differently so that the desired rotation of the crank is achieved when the heel is slid onto the rear sole portion 4 (see FIGS. 23A, 23B and 23C, each depicting the achieved rotation of the crank).

Preferably, the groove 360, 360" winds gradually in the sole's longitudinal direction and forms different angles relative to the heel's longitudinal axis in different cross-sections that extend parallel to the heel's longitudinal direction. The groove 360 extends, for example, substantially parallel to the heel's longitudinal direction F (see FIG. 23D) in the region of the entrance opening through which the crank 416 may enter the groove at an angle $\varphi_1$ relative to the heel's longitudinal direction F (see FIG. 23E) in a first cross-section parallel to the heel's longitudinal direction F, and at an angle $\varphi_2>\varphi_1$ relative to the heel's longitudinal axis F (see FIG. 23F) in a second cross-section likewise parallel to the heel's longitudinal direction F, but further away from the entrance opening of the groove 360 than the first intersection. The crank 416 is therefore adjusted when the heel is attached as shown in the illustrations of FIGS. 23A to 23 C.

FIGS. 22A to 23F show heels 330, 330', 330" with grooves 32 for a fixture 20 at the rear sole portion 4. Yet, it is to be pointed out that the other fixtures described above are equally suitable (e.g., the fixture 20', where the heel is preferably slid rearwards onto the sole component 3 in the sole's longitudinal direction). In this case, the angle between the surface 361, 361" and the upper side of the heel 335, 335" preferably becomes flatter towards the front in the sole's longitudinal direction.

FIGS. 24A and 24B show a modification of the second mechanism 400' of FIGS. 18A to 21 on a sole component 3. The sole component is shown in an arrangement for a flat heel (FIG. 24A) and in an arrangement for a high heel (FIG. 24B).

The second supporting element 402' of FIGS. 24A and 24B comprises a first curved or angled portion 403' in the second transition region B and a second curved or angled portion 405' in a first transition region A. The front end portion 404' of the second supporting element 402' is flexibly received in the front sole portion 6, and the rear end portion 406' is flexibly received in the rear sole portion 4. In the shown embodiment the front sole portion 6 comprises a recess 407' for receiving the front end portion 404', and the rear sole portion 4 comprises a recess 408' for receiving the rear end portion 406'.

By means of a second supporting element 402' according to FIGS. 24A and 24B, the sole curvature in the first transition region A is coupled to the sole curvature in the second transition region B. The adjustment of the sole curvature in the first transition region A may lead to rotation of the supporting element 402' via the second curved or angled portion 405', which, in turn, leads to a change in sole curvature in the second transition region B through rotation of the second curved or angled portion 403'. Hence, the sole curvature in the first transition region A determines the sole curvature in the second transition region B (and vice versa).

Consequently, by adjusting the sole curvature and/or the angle in the first transition region A, the mechanism of FIGS. 24A and 24B may also adjust the sole curvature and/or angle in the second transition region B (and vice versa). It is, for example, possible to adjust the sole curvature in the first transition region A via one of the mechanisms described above, which then automatically leads to the adjustment of the second transition region B by means of the modified second mechanism 400' of FIGS. 24A and 24B. Therefore, a further mechanism for rotating the supporting element (e.g., a gear or crank) is not necessarily required, but may be provided in addition.

FIGS. 25A and 25B show a sole component 3 with a claimed donning aid 700 which allows a provisional fixation of a heel to the sole component 3 before locking the heel. The donning aid 700 according to the present invention may, however, also be used on the sole component 3 without a further locking system. For better illustration of the donning aid 700, FIGS. 25A and 25B only depict the front sole portion 6 and the middle sole portion 5, wherein the skilled person will understand that the sole component 3 may also comprise a rear sole portion.

In the embodiment shown in FIGS. 25A and 25B the donning aid 700 comprises an cantilevered arm 710 extending rearwards from the middle sole portion 5 in the sole's longitudinal direction L. A locking protrusion 712 is provided on the arm 710 configured to engage with a corresponding recess of a heel. The cantilevered arm 710 is preferably not rigid, but configured such that it is elastically deflected during attachment of a heel.

As further shown in FIG. 25B, the cantilevered arm 710 may be provided in the region of the first supporting element's rear part. In this way, the cantilevered arm 710 may preferably be inserted into the same recess of the heel as the rear part of the first supporting element. In the exemplary embodiment shown in FIG. 25B, the cantilevered arm 710 is arranged between the rear part 115A of a first rail and the rear part 115B of a second rail which together form the first supporting element. The cantilevered arm 710 is moveable with respect to the rear part 115A, 115B of the first supporting element.

FIGS. 26A to 26C show a sequence demonstrating the provisional fixation of a heel to the sole component by use of the donning aid 700. Although a heel 30" is shown in these Figures, the claimed donning aid may also be used with other kinds of heels according to the present invention.

The heel 30" comprises an opening 720 for receiving the cantilevered arm 710, wherein said opening 720 may optionally correspond to the opening 43" for the receiving the rear part 115 of the first supporting element (see FIG. 26A). When pushing the heel 30" onto the rear part 115, the cantilevered arm 710 is deflected downwards (see FIG. 26B), and, when reaching an undercut 721 in the opening 720, engages with the undercut 721 so that a removal of the heel 30" from the rear part 115 is counteracted (see FIG. 26C). In the shown embodiment of the heel 30" the undercut 721 is provided at the upper ceiling 723 of the opening 720.

FIGS. 27A to 27C show a mechanism 740 for releasing the donning aid 700, which allows for decoupling of the locking protrusion 712 from the undercut 721 (see FIG. 26A) and thus enables removal of the heel 30" from the sole component.

In the exemplary embodiment illustrated in FIGS. 27A to 27C the mechanism 740 comprises two levers 741A and 741B which act upon the cantilevered arm 710 in an end portion 742 thereof in order to deflect the cantilevered arm 710. On their other end portion 743 the levers 741A and 741B are coupled to a user interface 745. The actuation of the user interface 745 (in the shown embodiment configured as a lever which may be rotated around a fulcrum 747) is transferred onto the cantilevered arm 710 via the levers 741A and 741B, thereby deflecting the cantilevered arm 710 (downwards in the heel's longitudinal direction according to the shown embodiment). Rotating the user interface 745 around the fulcrum 747 thus leads to the downwards deflection of locking protrusion 712 which is thereby decoupled from the undercut 721.

As further shown in FIGS. 27A and 27B, the cranks 741A and 741B and/or the user interface may be rotatably mounted via the first supporting element which, in this example, is formed by two rails 114A and 114B. The levers 741A and 741B and/or the user interface 745 may be arranged between the rails 114A and 114B. In addition, the levers 741A and 741B may optionally have a curved configuration by which means a particularly space-saving arrangement of the cranks may be achieved. Instead of two levers 741A and 741B one single crank or more than two cranks may be provided as long as they fulfill the required functionality.

Moreover, the donning aid 700 may be configured such that the cantilevered arm 710 is prevented from snapping into the undercut 721 again after being released. For this purpose, an inclination 725 and/or 726 may be provided in the opening 720 and/or on the cantilevered arm 710 (see FIG. 26A), said inclination leading to a rearwards movement of the heel in the sole's longitudinal direction L during deflection of the cantilevered arm 710 when releasing the donning aid 700. In this way, the cantilevered arm 710 may no longer engage with the undercut 721 of the heel.

FIGS. 28A to 28E show a sequence demonstrating the releasing of the donning aid by means of the mechanism 740 according to FIGS. 27A to 27C. As described above, the locking element 712 is deflected by means of the lever 741 which is actuated through the user interface 745. The cantilevered arm 710 slides along the inclination 725 (see FIGS. 28B and 28C) thereby triggering a relative movement between the heel 30" and the sole component (not shown in detail) on which the mechanism 740 is provided. The locking protrusion 712 can thus no longer move into engagement with the recess 721 when the user interface is released and the cantilevered arm 710 snaps back (see FIG. 28D). Hence, the donning aid no longer impedes removal of the heel 30" so that the heel may be detached from the sole component (see FIG. 28E). According to embodiments of the invention, the user interface 745 and the actuation element 531' of the mechanism for releasing the locking system 500' may be configured as a single component (e.g. as a single lever).

The invention therefore discloses improved mechanisms which, irrespective of the heel height of a changeable heel, ensure ideal adjustment of the sole shape. Furthermore, improved fixtures are disclosed which allow for easy and safe fixation of changeable heels to the sole of a shoe. Hence, the shoes according to the present invention may be adapted depending on the situation, whereby the user is provided with a fully functional shoe irrespective of the heel height.

In addition, the heel's changeability allows for a customized design, e.g., of its shape and color.

As far as the term "substantially" has been used, also the embodiments which fully provide the respective feature are encompassed.

The invention particularly refers to the following aspects:

Aspect 1: Sole component (3) for a shoe suitable for use with different heels, wherein the sole component (3) comprises a front (6), a middle (5) and a rear sole portion (4);
wherein the sole component (3) comprises a mechanism (100) for adjusting the sole curvature in a transition region (A) between the middle (5) and the rear (4) sole portion; wherein the mechanism (100) comprises a supporting element (114, 114').

Aspect 1a: Sole component (3) according to aspect 1, wherein the supporting element may be pushed away from the sole component (3) in the region of rear sole portion (4) in order to reduce the curvature of the sole component (3) in the transition region (A) and/or wherein the supporting element may be pushed towards the sole component (3) in the region of the sole portion (4) in order to increase the curvature of the sole component (3) in the transition region (A).

Aspect 2: Sole component (3) according to aspect 1 or 1a, wherein the supporting element is more rigid than the transition region (A) of the sole component (3).

Aspect 3: Sole component (3) according to any one of the preceding aspects, wherein the transition region (A) is more flexible than the rear sole portion (4) and/or the middle sole portion (5).

Aspect 4: Sole component (3) according to aspect 3, wherein the transition region (A) comprises a hinge (601).

Aspect 5: Sole component (3) according to aspect 4, wherein the middle sole portion (5) may be rotated about a rotation axis relative to the rear sole portion (4), wherein the axis of rotation preferably is transverse to the sole's longitudinal direction.

Aspect 6: Sole component (3) according to any one of the preceding aspects, wherein the sole component (3) comprises a leaf spring which is fixedly connected to the rear sole portion (4) and the middle sole portion (5).

Aspect 7: Sole component (3) according to any one of the preceding aspects, wherein the supporting element (114, 114') comprises a front part extending into the region of the middle sole portion (5) and/or being fixedly connected to the middle sole portion (5).

Aspect 8: Sole component (3) according to aspect 7, wherein the front part and the middle sole portion (5) are configured integrally.

Aspect 9: Sole component (3) according to any one of the preceding aspects, wherein the supporting element (114, 114') comprises a rear part (115, 115') which extends along the rear sole portion (4) and which is preferably not fixed to or connected with the rear sole portion (4).

Aspect 10: Sole component (3) according to any one of the preceding aspects, wherein an angle and/or a distance between a rear part (115, 115') of the supporting element (114, 114') and the rear sole portion (4) is adjustable.

Aspect 11: Sole component (3) according to aspect 10, wherein reducing the distance and/or angle between the rear part (115, 115') and the rear sole portion (4) leads to an increase in curvature in the transition region (A).

Aspect 12: Sole component (3) according to aspect 10 or 11, wherein increasing the angle and/or distance between the rear part (115, 115') and the rear sole portion (4) leads to a decrease in curvature in the transition region (A).

Aspect 13: Sole component (3) according to aspects 9 to 12, wherein the rear part (115, 115') extends below the rear sole portion (4).

Aspect 14: Sole component (3) according to any one of the preceding aspects, wherein the supporting element (114, 114') is loose from the rear sole portion (4) along a rear part (115, 115').

Aspect 15: Sole component (3) according to any one of the preceding aspects, wherein the supporting element (114, 114') may be pushed away from the sole component (3), in particular a rear part (115, 115') from the rear sole portion (4).

Aspect 16: Sole component (3) according to aspect 15, wherein the rear part of the supporting element may be pushed away from the rear sole portion (4) by means of a wedge-shaped structure (41", 46") on a heel, which may be slid between the supporting element (114, 114') and the rear sole portion (4).

Aspect 17: Sole component (3) according to aspects 9 to 16, wherein, in a neutral position without heel, the rear part (115, 115') is spaced from the rear sole portion (4), wherein the distance between the rear part (115, 115') and the rear sole portion (4) preferably increases in the sole's longitudinal direction towards the rear.

Aspect 18: Sole component (3) according to any one of the preceding aspects, wherein supporting element (114, 114') comprises a projection (117, 117').

Aspect 19: Sole component (3) according to aspect 18, wherein the projection (117, 117') extends away from the supporting element (114, 114') in a lateral and/or downwards direction.

Aspect 20: Sole component (3) according to aspect 18 or 19, wherein the projection (117, 117') provides at least one surface (119') which extends substantially transversely to the sole's longitudinal direction.

Aspect 21: Sole component (3) according to aspects 18, 19 or 20, wherein the projection (117, 117') provides at least one surface (119') whose normal vector (M), which is directed away from the projection (117, 117'), points forwards in the sole's longitudinal direction and/or upwards in the heel's longitudinal direction (F).

Aspect 22: Sole component (3) according to aspects 20 or 21, wherein the surface (119') extends inclined to the plane of the rear sole portion (4).

Aspect 23: Sole component (3) according to aspect 20, 21 or 22, wherein the surface (119') extends away from the plane of the rear sole portion (4) in the sole's longitudinal direction towards the front.

Aspect 24: Sole component (3) according to aspects 18 to 23, wherein the projection (117, 117') may be used for adjustment of the mechanism (100).

Aspect 25: Sole component (3) according to aspects 18 to 24, wherein the projection (117, 117') may be used for fixation of a heel to the rear sole portion (4).

Aspect 26: Sole component (3) according to any one of the preceding aspects, wherein the supporting element (114, 114') has a substantially flat and/or elongated configuration along the middle sole portion (5).

Aspect 27: Sole component (3) according to any one of the preceding aspects, wherein the supporting element (114, 114') comprises a cutout through which an element of the second mechanism (300, 400) may extend.

Aspect 28: Sole component (3) according to any one of the preceding aspects, wherein the first supporting element (114, 114') is made of one of the following materials or a combination thereof: steel, metals, metal alloys, plastics or composites.

Aspect 29: Sole component (3) according to any one of the preceding aspects, wherein the first supporting element (114, 114') is made of V2A steel plate.

Aspect 29a: Sole component (3) according to any one of the preceding aspects, wherein an angle between the rear part (11, 115') of the supporting element (114, 114') and the middle sole portion (5) remains essentially the same when the sole curvature in the transition region (A) is changed.

Aspect 29b: Sole component (3) according to any one of the preceding aspects, wherein the rear sole portion (4) is jointly fixed to the supporting element (114, 114').

Aspect 29c: Sole component (3) according to any one of the preceding aspects, wherein the front sole portion (6) is jointly fixed to the supporting element (114, 114').

Aspect 29d: Sole component (3) according to any one of the preceding aspects, wherein the supporting element (114, 114') is formed by several, preferably two, rails (114A, 114B).

Aspect 29e: Sole component (3) according to any on the preceding aspects, wherein the rear part (115, 115) of the supporting element (114, 114') tapers or becomes narrower towards the rear in the sole's longitudinal direction.

Aspect 30: Sole component (3) for a shoe suitable for use with different heels, wherein the sole component (3) comprises a front (6), a middle (5) and a rear sole portion (4);

wherein the sole component (3) comprises a mechanism (300, 400) for adjusting the sole curvature in a transition region (B) between the front (6) and the middle (5) sole portion;

wherein the mechanism (300, 400) comprises a slidable and/or rotatable supporting element (302, 402) which is provided and/or configured such that sliding and/or rotating the supporting element (302, 402) leads to a change of the sole curvature in the transition region (B).

Aspect 31: Sole component (3) according to aspect 28, wherein sliding and/or rotating the supporting element (302, 402) leads to a change of the angle between the front sole portion (6) and the middle sole portion (5).

Aspect 32: Sole component (3) for a shoe suitable for use with different heels, wherein the sole component (3) comprises a front (6), a middle (5) and a rear sole portion (4);

wherein the sole component (3) comprises a mechanism (300) for adjusting the sole curvature in a transition region (B) between the front sole portion (6) and the middle sole portion (5);

wherein the mechanism (300) comprises a slidable supporting element (302) which is provided and/or configured such that it may slide in the sole's longitudinal direction from a first position, which causes a first sole curvature in the transition region (B) to a second position which causes a second sole curvature in the transition region (B).

Aspect 33: Sole component (3) according to aspect 32, wherein the first sole curvature differs from the second sole curvature.

Aspect 34: Sole component (3) according to aspect 32 or 33, wherein the supporting element (302) is configured as an elongate supporting steel plate.

Aspect 35: Sole component (3) according to aspect 32, 33 or 34, wherein the supporting element (302) is guided in a guide (306) at least along a segment thereof in the region of the middle sole portion (5).

Aspect 36: Sole component (3) according to aspects 32 to 35, wherein the guide (306) is fixedly connected to the sole component (3).

Aspect 37: Sole component (3) according to aspect 36, wherein the guide (306) is fixedly connected to the middle sole portion (5).

Aspect 38: Sole component (3) according to aspects 35, 36 or 37, wherein the guide (306) hinders buckling and/or bending of the supporting element (302) in the front region of the middle sole portion (5) and/or in the transition region (B).

Aspect 39: Sole component (3) according to aspects 32 to 38, wherein the supporting element (302) does not project into the front sole portion (6) in the first position.

Aspect 40: Sole component (3) according to aspects 32 to 39, wherein in the first position the sole curvature in the transition region (B) corresponds to the manufacturing curvature of the sole component (3).

Aspect 41: Sole component (3) according to aspects 32 to 40, wherein the supporting element (302) projects into the transition region (B) and/or into the front sole portion (6) when it is slid into the second position.

Aspect 42: Sole component (3) according to aspects 32 to 41, wherein the transition region (B) essentially adopts the shape of the supporting element (302) when the supporting element (302) is slid into the second position.

Aspect 43: Sole component according to aspects 32 to 42, wherein the mechanism (300) comprises a moving device (310) which is provided or configured such that the supporting element (302) is slidable during attachment and removal of a heel.

Aspect 44: Sole component (3) according to aspect 43, wherein the moving device (310) comprises a transmission link (312) which preferably extends from the rear sole portion (4) to the supporting element (302).

Aspect 45: Sole component (3) according to aspect 44, wherein the transmission link (312) is fixedly connected to the supporting element (302).

Aspect 46: Sole component (3) according to aspect 44 or 45, wherein the transmission link (312) is bendable.

Aspect 47: Sole component (3) according to aspects 43 to 46, wherein the moving device (310) is configured as a Bowden mechanism.

Aspect 48: Sole component (3) according to aspects 43 to 47, wherein the Bowden mechanism comprises a Bowden cable sleeve which is fixed to the sole component (3) and/or to a supporting element (114, 114) of a mechanism (100) for adjusting the sole curvature in a transition region (A) between the rear sole portion (4) and the middle sole portion (5).

Aspect 49: Sole component (3) according to aspects 43 to 48, wherein the moving device (310) comprises an actuator (316) for interacting with changeable heels.

Aspect 50: Sole component (3) for a shoe suitable for use with different heels, wherein the sole component (3) comprises a front (6), a middle (5) and a rear sole portion (4);

wherein the sole component (3) comprises a mechanism (400) for adjusting the sole curvature in a transition region (B) between the front (6) and the middle (5) sole portion;

wherein the mechanism (400) comprises a rotatable supporting element (402) which is provided in such a way that it may assume a first angular position which causes a first sole curvature in the transition region (B) and a second angular position which causes a second sole curvature in the transition region (B);

wherein the first sole curvature is different from the second sole curvature.

Aspect 51: Sole component (3) according to aspect 50, wherein the supporting element (402) is configured as a shaft, preferably a shaft with a first and/or second curved and/or angled portion.

Aspect 52: Sole component (3) according to aspect 50 or 51, wherein the first sole curvature is smaller than the second sole curvature and wherein the supporting element (402) comprises a curved and/or angled portion (403) along the transition region (B).

Aspect 53: Sole component (3) according to aspect 52, wherein, when the supporting element (402) is in the first angular position, a projection of the curved portion (403) onto a projection plane that extends along the rotation axis of the supporting element (402) and is perpendicular to the plane of the front sole portion (6) has a first curvature, which preferably corresponds to the first sole curvature.

Aspect 54: Sole component (3) according to aspect 53, wherein, when the supporting element (402) is in the second angular position, the projection of the curved portion (403) onto the projection plane assumes a second curvature that is larger than the first curvature and preferably corresponds to the second sole curvature.

Aspect 55: Sole component (3) according to aspects 50 to 54, wherein the supporting element (402), when assuming the second angular position, extends further into the front sole portion (6) in the longitudinal direction of the sole than when assuming the first angular position.

Aspect 56: Sole component (3) according to aspects 50 to 55, wherein the supporting element (402) comprises a crank (416) and/or a gear in the region of the rear sole portion (4) for adjusting the angular position.

Aspect 57: Sole component (3) according to aspects 50 to 56, wherein the sole component (3) further comprises a changeable heel (30, 30', 30", 30'", 330, 330', 330") designed for fixation in the region of the rear sole portion (4) and which may, preferably, be slid onto the sole component in the region of the rear sole portion (4).

Aspect 58: Sole component (3) according to aspect 57, wherein the heel (330, 330', 330") comprises at least one recess (360, 360', 360") provided such that it interacts with the crank (416) during fixation of the heel (330, 330', 330") onto the sole component (3) and thereby adjusts the angular position of the supporting element (402).

Aspect 59: Sole component (3) according to aspects 30 to 58, wherein the second supporting element is integrated into the sole component (3).

Aspect 60: Sole component (3) according to aspects 30 to 59, wherein the transition region (B) is more flexible than the supporting element (302, 402).

Aspect 61: Sole component (3) according to aspects 30 to 60, wherein the transition region (B) essentially adopts the shape determined by the second supporting element.

Aspect 62: Sole component (3) according to aspects 30 to 61, wherein the transition region (B) is more flexible than the front, middle and/or rear sole portion (6, 5, 4).

Aspect 63: Sole component (3) according to aspects 30 to 62, wherein the transition region (B) comprises a hinge (602).

Aspect 64: Sole component (3) according to aspect 63, wherein the front sole portion (6) is rotatable relative to the middle sole portion (5) along an axis of rotation, wherein the axis of rotation preferably extends substantially transversely to the sole's longitudinal direction.

Aspect 65: Sole component (3) according to aspects 30 to 64, wherein the supporting element (302, 304) is made of one of the following materials or a combination thereof: steel, metal, metal alloys, plastics, composites.

Aspect 66: Sole component (3) according to aspects 30 to 65, wherein the supporting element (302, 402) is made of spring steel.

Aspect 67: Sole component (3) according to aspects 30 to 66, wherein the sole component comprises a leaf spring which is fixedly connected to the middle sole portion (5) and/or the front sole portion (4).

Aspect 68: Sole component (3) according to aspects 30 to 67, wherein, due to manufacturing, the sole component (3) comprises a sole curvature for a heel with a heel height of at least 2, preferably at least 5 cm in a neutral position.

Aspect 69: Sole component (3) according to aspects 30 to 68, wherein, due to manufacturing, the sole component (3) comprises a sole curvature for a heel with a heel height of no more than 7 cm, preferably no more than 3 cm in a neutral position.

Aspect 69a: Sole component (3) according to any one of the preceding aspects, wherein the supporting element (400') comprises a second curved and/or angled portion (405') in a transition region (A) between the rear sole portion (4) and the middle sole portion (5).

Aspect 69b: Sole component (3) according to any one of the preceding aspects, wherein the supporting element (400') is moveably received on or in the rear sole portion (4).

Aspect 69c: Sole component (3) according to any one of the preceding aspects, wherein the change in sole curvature in the transition region (A) between the rear sole portion (4) and the middle sole portion (5) leads to a change in sole curvature in the transition region (B) between the middle sole portion (5) and the front sole portion (6) via the supporting element (400').

Aspect 69d: Sole component (3) according to any one of the preceding aspects, wherein the supporting element (400, 400') is formed by a plurality of shafts, wherein the shafts preferably rest against each other.

Aspect 70: Sole component (3) according to aspects 30 to 69d with a mechanism (100) of the sole component according to any one of aspects 1 to 29.

Aspect 71: Sole component (3) according to aspect 70, wherein the moving device (310) and/or the supporting element (402) of the mechanism (300, 400) for adjusting the transition region (B) between the front and middle sole portion (4, 5) extends through the cutout of the supporting element (114) of the mechanism (100) for adjusting the transition region (A) between the middle and rear sole portion (5, 6).

Aspect 72: Sole component (3) according to any one of the preceding aspects, wherein the front sole portion (6) is a ball or forefoot region.

Aspect 73: Sole component (3) according to any one of the preceding aspects, wherein the middle sole portion (5) is an arch or midfoot region.

Aspect 74: Sole component (3) according to any one of the preceding aspects, wherein the rear sole portion (4) is a region of a foot's heel.

Aspect 75: Sole component (3) according to any one of the preceding aspects, wherein the sole component (3) comprises an insole, a liner and/or an outsole.

Aspect 76: Sole component (3) according to any one of the preceding aspects, wherein the sole component (3) is an insole.

Aspect 77: Sole component (3) for a shoe suitable for use with different heels (30, 30', 30", 30'", 330, 330', 330"), wherein the sole component (3) comprises a rear sole portion (4) having one or more fixtures (20, 20') for changeable heels (30, 30', 30", 30'", 330, 330', 330").

Aspect 78: Sole component (3) according to aspect 77, wherein the fixture (20, 20') comprises at least one projection (21, 21') having a profile (22, 22') which is provided or configured such that it may engage with a recess of a heel (30, 30', 30", 30'", 330, 330', 330") to prevent said heel (30, 30', 30", 30'", 330, 330', 330") from falling off when the shoe is lifted.

Aspect 79: Sole component (3) according to aspect 78, wherein the profile (22, 22') comprises an undercut.

Aspect 80: Sole component (3) according to aspect 78 or 79, wherein the profile is a dovetail profile, T-profile or L-profile.

Aspect 81: Sole component (3) according to aspects 77 to 80, wherein the fixture (20, 20') is configured such that a relative movement between the heel (30, 30', 30", 30'", 330, 330', 330") and the sole component (3) is required for fixing the heel (30, 30', 30", 30'", 330, 330', 330") to the sole component (3).

Aspect 82: Sole component (3) according to aspect 81, wherein the relative movement comprises at least one directional component in the sole's longitudinal direction.

Aspect 83: Sole component (3) according to aspects 77 to 82, wherein the fixture (20, 20') is provided and/or configured such that the heel (30, 30", 330, 330', 330") may be slid onto the sole component (3) substantially in the sole's longitudinal direction from rear to front.

Aspect 84: Sole component (3) according to aspects 78 to 83, wherein the projection extends substantially in the sole's longitudinal direction and preferably parallel to the plane (E) of the rear sole portion (4).

Aspect 85: Sole component (3) according to aspects 77 to 82, wherein the fixture (20, 20') is provided and/or configured such that the fixation is reinforced when the heel (30', 30'") is exposed to a load along the heel's longitudinal axis (F).

Aspect 86: Sole component (3) according to aspects 77 to 85, wherein the profile (22, 22') extends along an imaginary straight line (G) that forms an angle (θ) $89° > \theta > 1°$, preferably $70° > \theta > 20°$ with the plane (E) of the rear sole portion (4).

Aspect 87: Sole component (3) according to aspect 86, wherein the angle (θ) lies in a plane which is perpendicular to the plane (E) of the rear sole portion (4) and extends in the heel's longitudinal direction.

Aspect 88: Sole component (3) according to aspect 85, 86, or 87, wherein the profile (22') extends in a direction that has at least one component in the heel's longitudinal direction (F).

Aspect 89: Sole component (3) according to aspects 85 to 88, wherein, when following the rear sole portion (4) in a direction from the rear to the front in the sole's longitudinal direction, the profile (22') extends away from the rear sole portion (4) in a downward direction.

Aspect 90: Sole component (3) according to aspects 85 to 89, wherein, in a cross-section transverse to the sole's longitudinal direction, the profile (22') is broader than a part of the projection (21') located thereover that connects the profile (22') to the rear sole portion (4).

Aspect 91: Sole component (3) according aspects 85 to 90, wherein the projection (21') has a substantially triangular or trapezoidal shape and/or wherein the distance between a lower edge of the projection (21') and the rear sole portion (4) increases in the sole's longitudinal direction towards the front.

Aspect 92: Sole component (3) according to aspects 77 to 91 further comprising one or more mechanisms (100) of the sole component according to aspects 1 to 29 and/or one or more mechanisms (300, 400) of the sole component according to aspects 30 to 76.

Aspect 93: Sole component (3) according to aspect 92, wherein the fixture (20, 20') is provided on a supporting element (114').

Aspect 94: Sole component (3) according to any one of the preceding aspects, wherein the sole component (3) comprises a locking system (500, 500') in order to lock a heel when reaching a determined position.

Aspect 95: Sole component (3) according to aspect 94, wherein the locking system (500, 500') counteracts a movement of the mounted heel in a rearward or forward direction.

Aspect 96: Sole component (3) according to aspect 94 or 95, wherein the locking system (500, 500') comprises a groove or recess (501') and/or a projection (502, 502').

Aspect 96a: Sole component (3) according to aspects 94 to 96, wherein the heel and/or the sole component (3) comprises an interlocking element in the form of a hook (502'), a ratchet or a snap-in lug.

Aspect 96b: Sole component (3) according to aspects 94 to 96a, wherein the interlocking element provides an undercut for locking the heel to the sole component, wherein the undercut preferably comprises a recess which is open towards the front or the rear in the sole's longitudinal direction.

Aspect 96c: Sole component (3) according to aspects 94 to 96b, wherein the interlocking element is configured as a hook.

Aspect 96d: Sole component (3) according to aspects 94 to 96c, wherein the interlocking element provides an inclined surface which is preferably located at the side of the interlocking element facing away from and/or lying opposite the undercut.

Aspect 96e: Sole component (3) according to aspects 94 to 96d, wherein the inclined surface is arranged at the rear and/or front side of the hook.

Aspect 96f: Sole component (3) according to aspect 96e, wherein the inclined surface is arranged at an angle $\gamma$ of 90° to 150°, 91° to 120° or 95° to 110° relative to upper side of the heel.

Aspect 96g: Sole component (3) according to aspect 96f, wherein the angle $\gamma$ is formed between the inclined surface and the bottom of a recess which is provided on the upper side of the heel, wherein the sole component (in particular the rear sole portion) may preferably be received in the recess.

Aspect 96h: Sole component (3) according to aspects 94 to 96g, wherein a recess for receiving the supporting element at the sole component comprises a deflectable and/or moveable locking element.

Aspect 96i: Sole component (3) according to aspect 96h, wherein the locking element is moved when inserting the interlocking element and engages with the undercut of the interlocking element when the heel is completely slid onto the sole component.

Aspect 96j: Sole component (3) according to aspects 94 to 96i, wherein the locking element is pushed forwards or rearwards in the sole's longitudinal direction by the interlocking element when the heel is slid onto the sole component.

Aspect 96k: Sole component (3) according to aspects 94 to 96j, wherein the locking element is coupled to one or more springs (e.g., coil springs).

Aspect 96m: Sole component (3) according to aspects 94 to 96k, wherein the locking element is provided by a, preferably hollow, cylindrical or prism-shaped body.

Aspect 96n: Sole component (3) according to any one of the preceding aspects, wherein the rear sole portion provides a first, second and/or third abutment surface for the heel (preferably for the upper side of the heel).

Aspect 96o: Sole component (3) according to aspect 96n, wherein the first abutment surface is configured such that it abuts the bottom of the recess on the upper side of the heel when the heel is mounted to the sole component.

Aspect 96p: Sole component (3) according to aspect 96n or 96o, wherein the second abutment surface is arranged at an angle, ranging from 10° to 60°, 20° to 40° or 25° to 35° relative to the first abutment surface.

Aspect 96q: Sole component (3) according to aspect 96n, 96o, or 96p, wherein the second abutment surface is configured to adjoin and/or to be adjacent to the first abutment surface.

Aspect 96r: Sole component (3) according to aspects 96n to 96q, wherein the third abutment surface is substantially parallel to the first abutment surface, but preferably not arranged in the same plane.

Aspect 96s: Sole component (3) according to aspects 96n to 96r, wherein the third abutment surface is arranged adjacent to the second abutment surface and/or connected to the first abutment surface via the second abutment surface.

Aspect 96t: Sole component (3) according to sole component (3) according to aspects 96n to 96s, wherein the rear sole portion provides a fourth abutment surface.

Aspect 96u: Sole component (3) according to sole component (3) according to aspect 96t, wherein the fourth abutment surface is substantially parallel to the first abutment surface.

Aspect 96v: Sole component (3) according to sole component (3) according to aspect 96t or 96u, wherein the fourth abutment surface extends in U-shape around the first, second and/or third abutment surface.

Aspect 96w: Sole component (3) according to aspects 94 to 96v, wherein the recess for receiving the interlocking element comprises a wall which is arranged at an angle $\pi$ relative to the first abutment surface, wherein the angle $\pi$ ranges between 60° to 140°, 80° to 120° or 91° to 110° and preferably has an angle measure of 180° minus angle $\gamma$ of the interlocking element.

Aspect 96x: Sole component (3) according to aspects 94 to 96w, wherein the wall is a back wall of the recess on which the inclined surface of the locking element abuts when the heel is mounted to the sole component.

Aspect 96y: Sole component (3) according to aspects 94 to 96x, wherein angles $\pi$ and $\gamma$ differ from each other.

Aspect 96z: Sole component (3) according to aspects 94 to 96y, wherein the heel and/or the sole component (3) comprise a mechanism for releasing the locking system.

Aspect 96aa: Sole component (3) according to aspect 96z, wherein the mechanism allows for an elastic movement of the interlocking element and/or the locking element, preferably such that the undercut of the interlocking element and the locking element may be decoupled and/or detached from each other.

Aspect 96ab: Sole component (3) according to aspect 96z or 96aa, wherein the mechanism for releasing the locking system comprises an actuation element which provides an interface for the user.

Aspect 96ac: Sole component (3) according to aspect 96ab, wherein the actuation element is a lever which is mechanically coupled to the locking element.

Aspect 96ad: Sole component (3) according to aspect 96ac, wherein the lever is rotatably supported at the sole component (e.g., at the middle sole portion).

Aspect 96ad: Sole component (3) according to aspect 96z to 96ad, wherein the locking element is connected to the actuation element via one or more strings (e.g., nylon strings) or wires.

Aspect 96ae: Sole component (3) according to any one of the preceding aspects further comprising a donning aid by means of which a heel may be retained and/or provided on the sole component before locking the heel to the sole component via a locking system.

Aspect 96af: Sole component (3) according to aspect 96ae, wherein the donning aid comprises a cantilevered arm.

Aspect 96ag: Sole component (3) according to aspect 96af, wherein the cantilevered arm extends rearwards from the middle sole portion in the sole's longitudinal direction and/or is provided under the rear sole portion.

Aspect 96ah: Sole component (3) according to aspect 96af or 96ag, wherein a locking protrusion is provided at the rear end portion of the arm.

Aspect 96ai: Sole component (3) according to aspects 96af, 96ag or 96ah, wherein the heel comprises an opening for receiving the rear part of the first supporting element, and wherein the cantilevered arm is inserted into the same opening.

Aspect 96aj: Sole component (3) according to aspects 96af to 96ai, wherein the cantilevered arm is configured such that it is elastically deflected when mounting the heel to the sole component and/or the donning aid and, upon reaching an undercut in the heel, snaps into said undercut.

Aspect 96ak: Sole component (3) according to aspects 96af to 96aj, wherein the cantilevered arm is moveable with respect to the rear end of the first supporting element.

Aspect 96am: Sole component (3) according to any one of the preceding aspects, further comprising a mechanism for releasing the donning aid, wherein the mechanism preferably allows for elastic deflection of the cantilevered arm (e.g., downwards in the heel's longitudinal direction).

Aspect 96an: Sole component (3) according to aspect 96am, wherein the mechanism comprises one or more levers which are positioned around a first fulcrum in a seesaw-like manner.

Aspect 96ao: Sole component (3) according to aspect 96am or 96an, wherein the first fulcrum is arranged between the first and second ends and/or in the middle sole portion.

Aspect 96ap: Sole component (3) according to aspect 96am, 96an or 96ap, wherein the mechanism comprises a user interface by means of which the seesaw-like lever(s) may be deflected.

Aspect 96aq: Sole component (3) according to aspects 96an to 96ap, wherein the seesaw-like lever(s) has/have an arcuate shape.

Aspect 96ar: Sole component (3) according to aspects 96ae to 96aq, wherein the mechanism for releasing the donning aid is configured such that the cantilevered arm is prevented from snapping into the undercut again after being released.

Aspect 97: Changeable heel (30, 30', 30", 30'", 330, 330', 330") for use with a sole component (3) according to any one of the preceding aspects.

Aspect 98: Changeable heel (30, 30', 30", 30'", 330, 330', 330") according to aspect 97, wherein the heel may be fixed to a sole component (3) according to any one of the preceding aspects.

Aspect 99: Changeable heel (30, 30', 30", 30'", 330, 330', 330") according to aspect 98, wherein the heel may be fixed in the region of the rear sole portion (4).

Aspect 100: Changeable heel (30, 30', 30", 30'", 330, 330', 330") according to aspects 97 to 99, wherein the heel comprises a groove (32) at an upper side (35, 35", 335, 335, 335', 335"), said groove being configured analogously to the projection (21, 21') of a sole component according to aspects 78 to 97.

Aspect 101: Changeable heel (30, 30', 30", 30'", 330, 330', 330") according to aspect 100, wherein the groove (32) has a contour that is configured analogously to the profile (22, 22') of the projection (21, 21').

Aspect 102: Changeable heel (30, 30', 30", 30'", 330, 330', 330") according to aspect 100 or 101, wherein the groove (32) comprises an undercut.

Aspect 103: Changeable heel (30, 30", 330, 330', 330") according to aspect 100, 101 or 102, wherein the groove (32) extends parallel to the upper side and in the sole's longitudinal direction Aspect 104: Changeable heel (30, 30", 330, 330', 330") according to aspect 100 to 103, wherein the groove (32) is open towards the front.

Aspect 105: Changeable heel (30, 30", 330, 330', 330") according to aspect 100 to 104, wherein the heel may be slid forwards in the sole's longitudinal direction onto the rear sole portion (4).

Aspect 106: Changeable heel (30', 30'") according to aspects 97 to 102, wherein the heel comprises a recess (31', 31) with a contour (32') extending from the heel's upper side (35', 35'") along an imaginary straight line (H) into the heel.

Aspect 107: Changeable heel (30', 30'") according to aspect 106, wherein the straight line (H) lies in a plane that is parallel to the heel's longitudinal direction (F) and the sole's longitudinal direction and, wherein the straight line (H) extends at an angle $1° < \eta < 89°$ relative to the heel's longitudinal direction.

Aspect 108: Changeable heel (30', 30'") according to aspect 107, wherein the angle is $20° < \eta < 70°$.

Aspect 109: Changeable heel (30', 30'") according to aspect 106, 107 or 108, wherein the straight line (H) corresponds to an imaginary straight line (G) along which a profile (22, 22') of fixture (22') of the sole component (3) is extending when the heel is mounted to the sole component (3).

Aspect 110: Changeable heel (30', 30''') according to aspects 106 to 109, wherein the contour (32') is configured analogously to the profile (22, 22').

Aspect 111: Changeable heel (30', 30''') according to aspects 106 to 110, wherein the profile (22, 22') may be inserted into the heel along the contour (32').

Aspect 112: Changeable heel (30', 30''') according to aspects 106 to 111, wherein the contour (32') comprises an undercut and/or is broader than a part of the recess (31', 31''') located thereover in a cross-section transverse to the sole's longitudinal direction.

Aspect 113: Changeable heel (30', 30''') according to aspects 106 to 112, wherein the contour (32') comprises a plane that extends rearwards/upwards in the sole's longitudinal direction and is inclined with respect to the heel's longitudinal direction (F).

Aspect 114: Changeable heel (30', 30''') according to aspect 113, wherein the normal vector of the plane, which points into the clearance of the recess (31', 31'''), is directed rearwards in the sole's longitudinal direction and downwards in the heel's longitudinal direction (F).

Aspect 115: Changeable heel (30', 30''') according to aspects 106 to 114, wherein the recess (31', 31''') provides a stop (33').

Aspect 116: Changeable heel (30', 30''') according to aspects 106 to 115, wherein the recess (31', 31''') is located inside the heel and/or is solely open towards the upper side (35', 35''').

Aspect 117: Changeable heel (30'', 30''') according to aspect 116, wherein the other outer surfaces of the heel are not penetrated by the recess (31', 31''').

Aspect 118: Changeable heel (30'', 30''') according to aspects 97 to 117, wherein the heel is provided or configured such that fixing the heel to a sole component (3) leads to an adjustment of a mechanism (100) for adjusting a sole curvature in a transition region (A) between a rear sole portion (4) and a middle sole portion (5).

Aspect 119: Changeable heel (30'', 30''') according to aspect 118, wherein the heel comprises on its upper side (35'', 35''') a recess (31''') and/or an opening (43'', 47''') for receiving a rear part (115, 115') of a supporting element (114, 114') of the mechanism (100).

Aspect 120: Changeable heel (30'') according to aspect according to aspect 119, wherein the opening (43'') extends from the upper side (35'') and/or the front side of the heel rearwards in the sole's longitudinal direction and downwards in the heel's longitudinal direction (F) into the heel and/or is open towards the front in the sole's longitudinal direction.

Aspect 121: Changeable heel (30'') according to aspect 119 or 120, wherein the heel comprises an essentially wedge-shaped structured (41'') that is provided and/or configured such that it is inserted between the first supporting element (114) and the rear sole portion (4) when sliding the heel forwards in the sole's longitudinal direction.

Aspect 122: Changeable heel (30'') according to aspect 121, wherein a tapering end of the wedge-shaped structure (41'') is directed substantially forwards in the sole's longitudinal direction.

Aspect 123: Changeable heel (30'') according to aspect 121 or 122, wherein the wedge-shaped structure is provided and/or configured such that it may interact with a projection and/or a rail of the supporting element.

Aspect 124: Changeable heel (30''') according to aspect 119, wherein the opening (47''') extends from the upper side (35''') of the heel forwards in the sole's longitudinal direction and downwards in the heel's longitudinal direction into the heel.

Aspect 125: Changeable heel (30''') according to aspect 124, wherein the opening (47''') is provided and/or configured such that it receives a projection (122') at the rear part (115') of the supporting element (114') when the heel is slid onto the rear sole portion (4).

Aspect 126: Changeable heel (30''') according to aspect 124 or 125, wherein the opening (47''') provides at least one surface (49''') having an inclined extension relative to the heel's longitudinal direction (F).

Aspect 127: Changeable heel (30''') according to aspect 126, wherein the normal vector (O) of the surface (49'''), that points into the clearance of the opening (47'''), is directed rearwards in the sole's longitudinal direction and downwards in the heel's longitudinal direction.

Aspect 128: Changeable heel (30''') according to aspects 124 to 127, wherein, in a sectional plane extending parallel to the sole's longitudinal direction and parallel to the heel's longitudinal direction (F) through the opening (47'''), the heel comprises a substantially wedge-shaped structure (46''') whose tapering end is substantially directed rearwards in the sole's longitudinal direction.

Aspect 129: Changeable heel (30'', 30''') according to aspects 119 to 128, wherein the opening (43'', 47''') serves for fixation of the heel to the sole component (3).

Aspect 130: Changeable heel (330, 330', 330'') according to aspects 97 to 129, wherein the heel is provided and/or configured such that the fixation of the heel to the sole component (3) leads to an adjustment of the mechanism (300, 400) for adjusting a sole curvature in a transition region (B) between a middle sole portion (5) and a front sole portion (6).

Aspect 131: Changeable heel (330, 330', 330'') according to aspect 130, wherein the heel comprises a recess or groove (360, 360', 360'') which is provided and/or configured such that it interacts with an element of the mechanism (300, 400) or such that the element of the mechanism (300, 400) is not moved when fixing the heel to the sole component (3).

Aspect 132: Changeable heel (330, 330'') according to aspect 131, wherein the recess (360, 360'') is provided and/or configured such that it interacts with a gear of the mechanism (300, 400).

Aspect 133: Changeable heel (330, 330'') according to aspect 131 or 132, wherein the heel is configured such that the fixation of the heel (330, 330', 330'') to the sole component (3) causes the rotation of a rotatable supporting element (402).

Aspect 133a: Changeable heel according to aspect 133, wherein the groove causes the rotation of a rotatable supporting element (402).

Aspect 134: Changeable heel (330, 330'') according to aspect 133a, wherein the groove (360, 360'') is provided and/or configured such that it interacts with a crank (416) of the supporting element (402).

Aspect 135: Changeable heel (330, 330'') according to aspect 133a or 134, wherein the groove (360, 360'') comprises a surface (361, 361'') that extends along the direction of fixation and is at least partially inclined relative to a plane spanned by the heel's longitudinal direction (F) and the sole's longitudinal direction.

Aspect 136: Changeable heel (330, 330'') according to aspect 135, wherein the surface (361, 361'') is inclined relative to the heel's longitudinal direction (F) in a cross-section extending parallel to the heel's longitudinal direction (F) and transversely to the sole's longitudinal direction.

Aspect 137: Changeable heel (330, 330") according to aspects 133 to 136, wherein the depth of the groove (360, 360") decreases in the sole's longitudinal direction.

Aspect 138: Changeable heel (330, 330") according to aspects 133 to 137, wherein the groove (360, 360") narrows, rotates and/or winds along a direction in which the heel has to be moved relative to the rear sole portion (4) during attachment.

Aspect 139: Changeable heel (330, 330") according to aspects 133 to 138, wherein the groove (360, 360") is configured at different angles ($\varphi_1$, $\varphi_2$) relative to the heel's longitudinal direction (F) in different cross-sections extending parallel to the heel's longitudinal direction (F) and transversely to the sole's longitudinal direction.

Aspect 140: Changeable heel (330, 330") according to aspect 139, wherein the groove is configured at a first angle ($\varphi_1$) in a first cross-section and at a second angle ($\varphi_2$) in a second cross-section relative to the heel's longitudinal direction (F), wherein the second cross-section is further away from an entrance opening of the groove through which the crank (416) may enter the groove (360,360") than the first cross-section, and wherein the second angel ($\varphi_2$) is larger than the first angle $\varphi_1$.

Aspect 141: Changeable heel (330, 330', 330") according to aspects 133 to 140, wherein the groove (360, 360', 360") is wider in the region of the entrance opening and/or symmetrical relative to the heel's longitudinal direction (F).

Aspect 142: Changeable heel (330, 330', 330") according to aspects 131 to 141, wherein the groove (360, 360") is open towards the front and/or upper side (335, 335', 335') of the heel.

Aspect 143: Changeable heel (30, 30', 30", 30'", 330, 330', 330") according to aspects 97 to 142, wherein the heel comprises a locking system (500, 500') which locks the heel when reaching a defined position.

Aspect 144: Changeable heel (30, 30', 30", 30'", 330, 330', 330") according to aspect 143, wherein the locking system (500, 500') counteracts a rearward or forward movement of the mounted heel.

Aspect 145: Changeable heel (30, 30', 30", 30'", 330, 330', 330") according to aspect 143 or 144, wherein the locking system (500, 500') comprises a groove (501) or a projection (502').

Aspect 145a: Changeable heel according to aspects 143 to 145, wherein the locking system comprises the features according to any one of aspects 95 to 96ad, wherein said features are preferably provided on the heel.

Aspect 146: Shoe with a sole component (3) according to aspects 1 to 96 and/or a changeable heel according to aspects 97 to 145.

Aspect 147: Kit consisting of a sole component according to aspects 1 to 96 and/or a changeable heel according to aspects 97 to 145.

Aspect 148: Set with at least two changeable heels of different heights according to aspects 97 to 145.

Aspect 149: Locking system for locking a changeable heel to a sole component, wherein the locking system may comprise the features according to any one of the claims 95 to 96*ad* (on the heel or on the sole component).

Aspect 150: Donning aid for a changeable heel, wherein the donning aid may comprise the features according to any one of the claims 96*ae* to 96*ar* (on a heel or on a sole component).

The invention claimed is:

1. Sole component for a shoe suitable for use with different removable heels, wherein the sole component extends in a longitudinal direction and comprises a front, a middle and a rear sole portion;

wherein the sole component comprises a mechanism for adjusting the sole curvature in a transition region between the front and the middle sole portion;

wherein the mechanism comprises at least one shaft that extends from the middle sole portion into the front sole portion and wherein said shaft is movably received in the front sole portion;

wherein the shaft rotates in the middle sole portion and rotates around an axis of rotation of the shaft that extends along the middle sole portion in the longitudinal direction of the sole component, wherein the shaft is rotatable from a first angular position to a second angular position wherein the transition region has a first sole curvature when the shaft is in the first angular position, and the transition region has a second sole curvature when the shaft is in the second angular position;

wherein the first sole curvature is different from the second sole curvature; and wherein the shaft extends further into the front sole portion in the longitudinal direction of the sole component when the shaft is in the second angular position.

2. Sole component according to claim 1, wherein the at least one shaft has a curved or angled portion.

3. The sole component according to claim 1, wherein the first sole curvature is smaller than the second sole curvature, wherein the at least one shaft comprises a first curved or angled portion along the transition region, wherein the at least one shaft comprises a second curved or angled portion in a further transition region between the middle sole portion and the rear sole portion, wherein a front end portion of the at least one shaft is received in a recess of the front sole portion and a rear end portion of the at least one shaft is received in a recess of the rear sole portion, so that the adjustment of the sole curvature via the second curved or angled portion in the further transition region between the middle sole portion and the rear sole portion leads to a rotation of the at least one shaft, which in turn causes a change in sole curvature in the transition region between the front and the middle sole portion via a rotation of the first curved or angled portion.

4. The sole component according to claim 1, wherein the sole component comprises a locking system in order to lock the heels when reaching a determined position.

5. The sole component according to claim 1, wherein the sole component comprises a mechanism for adjusting the sole curvature in a transition region between the middle and the rear sole portion, wherein the mechanism comprises a further supporting element.

6. The sole component according to claim 5, wherein the further supporting element may be pushed away from the sole component in the region of the rear sole portion in order to reduce the curvature of the sole component in the transition region between the middle and the rear sole portion or wherein the further supporting element may be pushed towards the sole component in the region of the rear sole portion in order to increase the curvature of the sole component in the transition region between the middle and the rear sole portion.

7. The sole component according to claim 5, wherein the further supporting element comprises a rear part which extends along the rear sole portion and which is not connected with the rear sole portion.

8. The sole component according to claim 7, wherein the rear part extends below the rear sole portion.

9. The sole component according to claim 7, wherein an angle between the rear part of the further supporting element and the middle sole portion remains essentially the same when the sole curvature in the transition region between the middle and the rear sole portion is changed.

10. The sole component according to claim 5, wherein the further supporting element comprises a front part being fixedly connected to the middle sole portion.

11. The sole component according to claim 1, wherein the sole component is configured in such a way that the fixing of a changeable heel leads to the rotation of the at least one shaft.

12. Changeable heel for fixing to a sole component according to claim 1, wherein the heel is configured such that the fixing of the heel to the sole component causes the rotation of at least one shaft.

13. Changeable heel according to claim 12, wherein the heel is configured such that fixing the heel to the sole component leads to an adjustment of a mechanism for adjusting a sole curvature in a transition region between a rear sole portion and a middle sole portion.

14. Changeable heel according to claim 13, wherein the heel comprises an opening for receiving a rear part of a supporting element of the mechanism, wherein the opening extends from an upper side or a front side of the heel rearwards in the sole's longitudinal direction and downwards in the heel's longitudinal direction into the heel.

15. Changeable heel according to claim 13, wherein the heel comprises a wedge-shaped structure which is slid between the supporting element of the mechanism and the rear sole portion.

16. Changeable heel according to claim 15, wherein the wedge-shaped structure is configured such that it is slid forwards in the sole's longitudinal direction between the supporting element of the mechanism and the rear sole portion during attachment of the heel.

17. Shoe with the sole component according to claim 1.

18. Shoe with a heel according to claim 9.

19. The sole component according to claim 1, wherein a front end portion of the shaft is movably received in the front sole portion.

20. The sole component according to claim 1, wherein a rear end portion of the shaft moves in the rear sole portion.

21. The sole component according to claim 1, further comprising a hinge extending along the transition region.

22. The sole component according to claim 1, wherein the shaft extends further into the front sole portion in the longitudinal direction of the sole component when the sole component is in a high heel arrangement than when the sole component is in a flat heel arrangement.

* * * * *